US007465879B2

(12) United States Patent
Glew

(10) Patent No.: US 7,465,879 B2
(45) Date of Patent: Dec. 16, 2008

(54) CONCENTRIC-ECCENTRIC HIGH PERFORMANCE, MULTI-MEDIA COMMUNICATIONS CABLES AND CABLE SUPPORT-SEPARATORS UTILIZING ROLL-UP DESIGNS

(75) Inventor: Charles A. Glew, Pawcatuck, CT (US)

(73) Assignee: Cable Components Group, Pawcatuck, CT (US)

( * ) Notice: Subject to any disclaimer, the term of this patent is extended or adjusted under 35 U.S.C. 154(b) by 0 days.

(21) Appl. No.: 11/408,452

(22) Filed: Apr. 21, 2006

(65) Prior Publication Data

US 2006/0237219 A1 Oct. 26, 2006

Related U.S. Application Data

(60) Provisional application No. 60/674,526, filed on Apr. 25, 2005.

(51) Int. Cl.
*H01B 7/00* (2006.01)

(52) U.S. Cl. ..... 174/113 R; 174/113 C

(58) Field of Classification Search ..... 174/36, 174/110 R, 113 R, 113 C, 120 R, 115, 116, 174/70 R, 72 R, 72 C; 138/111, 113, 114, 138/115

See application file for complete search history.

(56) References Cited

U.S. PATENT DOCUMENTS 508,842 A * 11/1893 Poalini ..... 209/137
1,804,478 A * 5/1931 Parker ..... 138/112
2,144,872 A * 1/1939 Cruser ..... 174/95
2,916,055 A * 12/1959 Brumbach ..... 138/111
3,357,455 A * 12/1967 Plummer ..... 138/106
3,819,443 A 6/1974 Simons et al.
3,964,563 A * 6/1976 Allen ..... 180/217
4,086,427 A * 4/1978 Nasuta et al. ..... 174/88 C (Continued)

FOREIGN PATENT DOCUMENTS

DE 3217401 A1 * 11/1983

(Continued)

OTHER PUBLICATIONS http:// www. sumitomoelectric.com/products/opticalfibercable/rib-boncables/litpipeinriser Sumitomo.

(Continued)

*Primary Examiner*—William H Mayo, III
(74) *Attorney, Agent, or Firm*—Guerry L. Grune; ePatent Manger.com

(57) ABSTRACT

The present invention includes a high performance communications cable or cable support-separator and/or jacket and includes one or more core support-separators having various shaped profiles. The core may be formed of conductive or insulative material and may be comprised of polymer blends that include olefin and/or fluoropolymer and/or chlorofluoropolymer based resins with or without inorganic additives such as nano-clay composites, $C_{60}$ based compounds, etc. The core support-separator has both a central region as well as a plurality of shaped sections that extend outward from the central region that are either solid or partially solid, foamed or foamed with a solid skin surface. The invention includes incorporation of hollow ducts that can be used to provide for insertion of optical or metal transmission media either before, during, or after installation of the cable.

45 Claims, 19 Drawing Sheets

U.S. PATENT DOCUMENTS 4,271,104 A 6/1981 Anderson et al.
4,586,427 A * 5/1986 Thiel ..... 91/369.2
4,605,818 A 8/1986 Arroyo et al.
4,709,730 A * 12/1987 Zwilling ..... 138/111
4,732,628 A * 3/1988 Dienes ..... 156/48
4,755,629 A 7/1988 Beggs et al.
4,804,020 A * 2/1989 Bartholomew ..... 138/111
5,036,891 A * 8/1991 Vogelsang ..... 138/115
5,069,254 A * 12/1991 Vogelsang ..... 138/111
5,146,528 A 9/1992 Gleim et al.
5,418,878 A 5/1995 Sass et al.
5,444,184 A 8/1995 Hassel
5,544,270 A 8/1996 Clark et al.
5,703,330 A * 12/1997 Kujawski ..... 174/72 A
5,789,711 A 8/1998 Gaeris et al.
5,821,466 A 10/1998 Clark et al.
5,887,243 A 3/1999 Harvey et al.
5,952,615 A 9/1999 Prudhon
5,969,295 A 10/1999 Boucino et al.
6,008,455 A 12/1999 Lindstrom et al.
6,074,503 A 6/2000 Clark et al.
6,091,025 A 7/2000 Cotter et al.
6,150,612 A 11/2000 Grandy et al.
6,365,836 B1 4/2002 Blouin et al.
6,596,944 B1 7/2003 Clark et al.
6,639,152 B2 10/2003 Glew et al.
6,680,922 B1 1/2004 Jorgensen
6,686,537 B1 2/2004 Gaeris et al.
6,689,958 B1 2/2004 McKenney et al.
6,748,146 B2 6/2004 Parris
6,751,441 B1 6/2004 Murray et al.
6,774,311 B1 * 8/2004 Byun ..... 174/95
6,792,184 B2 9/2004 Conrad et al.
6,800,811 B1 10/2004 Boucino
6,812,408 B2 11/2004 Clark et al.
6,818,832 B2 11/2004 Hopkinson et al.
6,855,889 B2 2/2005 Gaeris
7,112,745 B2 * 9/2006 Hatori ..... 174/71 R
2002/0037376 A1 * 3/2002 Fenton ..... 428/34.9
2004/0002559 A1 1/2004 Troutman et al.
2004/0055779 A1 3/2004 Wiekhorst et al.
2004/0055781 A1 3/2004 Cornibert et al.
2004/0118593 A1 6/2004 Augustine et al.
2004/0149483 A1 8/2004 Glew
2004/0198875 A1 10/2004 Kaprinidis et al.
2004/0216914 A1 * 11/2004 Vexler et al. ..... 174/121 A
2004/0217329 A1 11/2004 Easter
2004/0256139 A1 12/2004 Clark et al.
2005/0006132 A1 1/2005 Clark
2005/0006133 A1 1/2005 Greiner
2005/0023028 A1 2/2005 Clark
2005/0029007 A1 2/2005 Nordin et al.
2005/0051355 A1 3/2005 Bricker et al.
2005/0056454 A1 3/2005 Clark
2005/0063650 A1 3/2005 Castellani et al.

FOREIGN PATENT DOCUMENTS

DE 2 258 286 A * 1/1991
DE WO 01/01535 A1 * 1/2001
EP 0957494 B1 11/2004
JP 07122123 A2 5/1995
JP 07-245023 * 9/1995
WO WO 96/024143 8/1996
WO WO2004/021367 3/2004
WO WO 2004042446 A1 5/2004

OTHER PUBLICATIONS http:// www. corningcablesystems.com/web/corp/engserv.nsf/ethml/faqrib Corning.
http:// www. electronichouse.com/products/weekly/slideshow/243/5395.html Peelable cable Belden.
http:// bwccat.belden.com /ecat/jsp/Index.jsp?&P1=undefined &P2=undefined&P3=undefined&P4=undefined&&P5= undefined &P6= undefined Belden types of peelable cables.
EIA / TIA CAT 6 Specifications Draft, Version 2.0, Jun. 21, 2005.

* cited by examiner

CONCENTRIC-ECCENTRIC HIGH PERFORMANCE, MULTI-MEDIA COMMUNICATIONS CABLES AND CABLE SUPPORT-SEPARATORS UTILIZING ROLL-UP DESIGNS

This application takes priority from U.S. Provisional Application No. 60/674,526, titled, "Concentric-Eccentric High Performance Support-Separators for Multi-Media Cables Including Conduit Tubes Utilizing Roll-up Designs", filed on Apr. 25, 2005.

FIELD OF INVENTION

This invention relates to high performance multi-media communications cables utilizing paired or unpaired electrical conductors or optical fibers that meet stringent electrical as well as smoke and flame suppression requirements. More particularly, it relates to unique cables having a central core defining individual conductor pair channels. The communications cables have interior core support-separators that define a clearance through which conductors or optical fibers may be disposed and these separators as well as the cables and the method for producing such are the subject of the present invention. The invention also pertains to conduit tubes that could be used in conjunction with or separately from the separators with the defined clearance channels. These conduit tubes may be round, square, rectangular, elliptical or in any feasible geometric shape that would allow for any communications media conductor to be placed or subsequently blown (by pneumatic or other means) into place along the length of these tubes. In the present invention, the tubes are used for providing both asymmetry and symmetry using both eccentric and concentric shapes to ensure optimal electrical, optical, and-mechanical properties. Additionally and concurrently, the present invention relates to composite electrical insulation exhibiting reduced flame spread and reduced smoke evolution, while maintaining favorable and optimal electrical properties within the conductors and/or cables. The present invention also relates to insulated electrical conductors and jacketed plenum cable formed from the flame retardant and smoke suppressant composite insulation(s). The focus of the present invention also includes the unique concept of a providing an eventually rolled-up version of an initially flat-ribbon like construction that ensures separator function. The rolled-up versions must be capable of supporting multi-media communications transmission mediums—including optical fiber, low voltage power and low voltage communications copper conductors, and may be comprised of non-conductive, semi conductive, and conductive materials that may be organic or inorganic, filled and from virgin resin or regrind and with no filler or any combination thereof, and also optionally comprising tapes, shields, foamed, solid or hollow tubes as well as foamed, solid, or hollow flat-ribbons that once rolled upon themselves function as support-separators.

This invention also relates to high performance multi-media communications cables utilizing paired or unpaired electrical conductors or optical fibers that also meet the newer transmission requirements of three main standards developed as IEEE 802.11 (a), (b), and (g) adopted in both in the United States under the National Electric Code (NEC) and internationally through the guidelines established by the International Electrotechnical Commission (IEC). Additional standards have been proposed within IEEE 802.3(a)(f) for integrating communications cabling and low voltage power source capabilities within the same cable structure. Allowable voltages and wattages will be greater than the current standards Specifically, the present invention also relates to cables having a central core defining individual conductor pair channels that are capable of meeting the needs of the recently created wireless LAN (local area network) market place. Specifically, wireless networks for laptop computing and wireless network access points (antennae) that transmit and receive wireless signals need to comply with IEEE standard 802.11a, 802.11b and 802.11g. Low voltage conductors that are included in the central core either for or as antennae are also capable of being used for additional purposes including the need for transmission of power or frequency other than specifically for wireless applications such as powering hubs and routers for a communications network or providing alternative voice or data transmission lines or even in lieu of batteries that would be used to power cameras or other network remote devices. The power from these devices is converted from the 110 VAC to 12-24 VDC, but can be as high as 48 VDC at a maximum of 12 W. Currently the conductors being used are 22-24 AWG used, but larger AWG conductors are anticipated in order to maintain higher wattages associated with increased low voltages as determined by the application.

BACKGROUND OF THE INVENTION

Many communication systems utilize high performance cables normally having four pairs or more that typically consist of two twisted pairs transmitting data and two receiving data as well as the possibility of four or more pairs multiplexing in both directions. A twisted pair is a pair of conductors twisted about each other. A transmitting twisted pair and a receiving twisted pair often form a subgroup in a cable having four twisted pairs. High-speed data communications media in current usage includes pairs of wire twisted together to form a balanced transmission line as well as the possibility of four or more pairs multiplexing in both directions. Optical fiber cables may include such twisted pairs or replace them altogether with optical transmission media (fiber optics).

In conventional cable, each twisted pair of conductors for a cable has a specified distance between twists along the longitudinal direction. That distance is referred to as the pair lay. When adjacent twisted pairs have the same pair lay and/or twist direction, they tend to lie within a cable and when twisted pairs are closely placed, such as in a communications cable, electrical energy may be transferred from one pair of a cable to another adjacent or outlying pair and this energy transfer between conductor pairs is undesirable and referred to as crosstalk. Therefore, in many conventional cables, each twisted pair within the cable has a unique pair lay in order to increase the spacing between pairs and thereby also reducing the cross-talk between twisted pairs of a cable. Additionally undesirable energy may be transferred between adjacent cabling conductors which is known as alien cross-talk or alien near-end cross talk (anext).

The Telecommunications Industry Association and Electronics Industry Association have defined standards for crosstalk, including TIA/EIA-568 A, B, and C including the most recent edition of the specification. The International Electrotechnical Commission has also defined standards for data communication cable crosstalk, including ISO/IEC 11801. One high-performance standard for 100 MHz cable is ISO/IEC 11801, Category 5. Additionally, more stringent standards are being implemented for higher frequency cables including Category 6 and Category 7, which includes frequencies of 200 and 600 MHz, respectively and the most recent proposed industrial standard raising the speeds to 10 Gbit (10 GBASE-T) over copper with Ethernet or other cable designs. Industry standards cable specifications and known commercially available products are listed in Table 1 and a set of updated standards is forthcoming from the EIA committee and should be considered as part of this disclosure. IEEE 802.3(a)(f) was presented as a topic of discussion in the Nov.

14-19, 2004 IEEE plenary session and includes topics such as Carrier Sense Multiple Access with Collision Detection (CSMA/CD) Access Method and Physical Layer Specifications, Data Terminal Equipment (DTE) and Power via Media Dependent Interface (MDI). Changes to MDI most pertinent to the present invention is that even low power conductors may emit undesirable energy into the twisted pair conductors promoting undesirable cross-talk between the power source and the communications conductors. As higher power is allowed in the MDI and data bit rates increase, the communications conductors become even more susceptible to cross-talk and data transmission reliability issues. Present Category 6 standards are listed in Tables 2A -2G.

Another feature of this invention will be to selectively add conductive materials in appropriate amounts to non-conductive or semi-conductive materials that comprise the separator structure (prior to roll-up or after roll-up depending on the design of choice) in order to attenuate any cross talk between the conductor and other communications or power conducting cables. Additionally, when conductive material is added to the configuration of the separators of the present invention, this would act as a shield against alien near end cross talk (anext), or stray interference from adjacent cables or from disrupting communication signals from adjacent cables (far end crosstalk—text).

Addition of conductive materials (metallization and the like) in relatively small concentrations either within the insulation of the separators or on exterior surfaces also decreases the weight of the cable. Presently, shielding, such as aluminized Mylar®, on curved linear surfaces is difficult in that it provides for unique and costly designs. This invention minimizes this difficulty by allowing for application of the aluminized film (PE, PET, Mylar®, etc.) on a flat or ribbon configuration prior to adding curved linearity to provide (upon roll-up) the cable support-separator.

Cabling exists today that is claimed to operate reliably without cross talk between the power cable and the communication cables at 48 VDC and up to 12 W (0.25 A). As the IEEE looks forward to providing the next generation of cable standards, the need for higher power is becoming a reality. Cabling that will enable up to 6 OVDC and 30 W, within a cable structure comprising fiber optic or twisted pair communications, and no crosstalk between the power cable and the communications lines as well as ensuring reliable communications operation (not subject to alien cross talk from other communications cable), is required. This invention discloses several cabling and separator system configurations allowing for component constructions that will meet the newly proposed IEEE standards.

TABLE 2A

Return Loss Requirements for Category 6 Cable
Return loss @ 20° C. ± 3° C. (68° F. ± 5.5° F.),
worst pair for a length of 100 m (328 ft)

| Frequency MHz | Category 6 dB |
|---|---|
| $1 \leqq f \leqq 10$ | $20 + 5 \log (f)$ |
| $10 \leqq f \leqq 20$ | 25 |
| $20 \leqq f \leqq 250$ | $25 - 7 \log (f/20)$ |

TABLE 2B

Insertion Loss Requirements for Category 6 Cable
Insertion loss @ 20° C. ± 3° C. (68° F. ± 5.5° F.),
worst pair for a length of 100 m (328 ft)

| Frequency MHz | Category 6 dB |
|---|---|
| .772 | 1.8 |
| 10.0 | 6.0 |
| 250.0 | 32.8 |

TABLE 2C

Near End Crosstalk Requirements For Category 6 Cable
Horizontal cable NEXT loss @ 20° C. ± 3° C. (68° F. ± 5.5° F.),
worst pair-to-pair, for a length of 100 m (328 ft)

| Frequency MHz | Category 6 dB |
|---|---|
| 0.150 | 86.7 |
| 10.0 | 59.3 |
| 250.0 | 38.3 |

TABLE 2D

Power Sum Near End Crosstalk Requirements
for Category 6 Cable
PSNEXT loss @ 20° C. ± 3° C. (68° F. ± 5.5° F.),
for a length of 100 m (328 ft)

| Frequency MHz | Category 6 dB |
|---|---|
| 0.150 | 84.7 |
| 10.0 | 57.3 |
| 250.0 | 36.3 |

TABLE 1

INDUSTRY STANDARD CABLE SPECIFICATIONS

| ALL DATA AT 100 MHz | TIA CAT 5e | TIA CAT 6 DRAFT 10 Nov. 15, 2001 | ANIXTER XP6 R3.00XP November 2000 | ANIXTER XP7 R3.00XP November 2000 |
|---|---|---|---|---|
| MAX TEST FREQUENCY | 100 MHz | 250 MHz | 250 MHz | 350 MHz |
| ATTENTUATION | 22.0 db | 19.8 db | 21.7 db | 19.7 db |
| POWER SUM NEXT | 32.3 db | 42.3 db | 34.3 db | 44.3 db |
| ACR | 13.3 db | 24.5 db | | |
| POWER SUM ACR | 10.3 db | 22.5 db | 12.6 db | 23.6 db |
| POWER SUM ELFEXT | 20.8 db | 24.8 db | 23.8 db | 25.8 db |
| RETURN LOSS | 20.1 db | 20.1 db | 21.5 db | 22.5 db |

TABLE 2E

| Equal Level Near End Crosstalk Requirements For Category 6 Cable ELNEXT loss @ 20° C. ± 3° C. (68° F. ± 5.5° F.), worst pair-to-pair for a length of 100 m (328 ft) | |
|---|---|
| Frequency MHz | Category 6 dB |
| .772 | 70.0 |
| 10.0 | 47.8 |
| 250.0 | 19.8 |

TABLE 2F

| Power Sum Equal Level Near End Crosstalk Requirements for Category 6 Cable PSELNEXT loss @ 20° C. ± 3° C. (68° F. ± 5.5° F.), for a length of 100 m (328 ft) | |
|---|---|
| Frequency MHz | Category 6 dB |
| .772 | 67.0 |
| 10.0 | 44.8 |
| 250.0 | 16.8 |

TABLE 2G

| Proposed Requirements for Alien Near -end Cross-talk for Category 6 Cable Proposed Requirement for Channel Power Sum Alien Near-End Cross-talk | |
|---|---|
| Frequency | Category 6 dB |
| PSANEXT $\geqq 60 - 10\log(f)$ | $1 \leqq f \leqq 100$ MHz |
| PSANEXT $\geqq 60 - 15\log(f)$ | $100 \leqq f \leqq 625$ MHz |

In conventional cable, each twisted pair of conductors for a cable has a specified distance between twists along the longitudinal direction. That distance is referred to as the pair lay. When adjacent twisted pairs have the same pair lay and/or twist direction, they tend to lie within a cable more closely spaced than when they have different pair lays and/or twist direction. Such close spacing increases the amount of undesirable cross-talk that occurs. Therefore, in many conventional cables, each twisted pair within the cable has a unique pair lay in order to increase the spacing between pairs and thereby to reduce the crosstalk between twisted pairs of a cable. Twist direction may also be varied.

Along with varying pair lays and twist directions, individual solid metal or woven metal air shields are used to electro-magnetically isolate pairs from each other or isolate the pairs from the cable jacket or low power conduction. Shielded cable exhibits better cross-talk isolation but is more time consuming and costly to manufacture, install, and terminate. Individually shielded pairs must generally be terminated using special tools, devices and techniques adapted for the job, also increasing cost and difficulty.

One popular cable type meeting the above specifications is Unshielded Twisted Pair (UTP) cable. Because it does not include shielded pairs, UTP is preferred by installers and others associated with wiring building premises, as it is easily installed and terminated. However, UTP fails to achieve superior cross-talk isolation such as required by the evolving higher frequency standards for data and other state of the art transmission cable systems, even when varying pair lays are used.

Another popular cable type is the "Banana Peel®" cable manufactured by Belden Electronics and published as PCT Application WO2004/021367A3 which allows the user to "peel" individual conductor sets from the central core cable support-separator. The wire jackets are bonded together with a suitable adhesive. This design aids in stripping and termination of the individual conductive media by the installer.

Some cables have used supports in connection with twisted pairs. These cables, however, suggest using a standard "X", or "+" shaped support, hereinafter both referred to as the "X" support. Protrusions may extend from the standard "X" support. The protrusions of these prior inventions have exhibited substantially parallel sides.

The document, U.S. Pat. No. 3,819,443, hereby incorporated by reference, describes a shielding member comprising laminated strips of metal and plastics material that are cut, bent, and assembled together to define radial branches on said member. It also describes a cable including a set of conductors arranged in pairs, said shielding member and an insulative outer sheath around the set of conductors. In this cable the shielding member with the radial branches compartmentalizes the interior of the cable. The various pairs of the cable are therefore separated from each other, but each is only partially shielded, which is not so effective as shielding around each pair and is not always satisfactory.

The solution to the problem of twisted pairs lying too closely together within a cable is embodied in three U.S. Pat. No. 6,150,612 to Prestolite, U.S. Pat. No. 5,952,615 to Filotex, and U.S. Pat. No. 5,969,295 to CommScope incorporated by reference herein, as well as an earlier similar design of a cable manufactured by Belden Wire & Cable Company as product number 1711A. The prongs or splines in the Belden cable provide superior crush resistance to the protrusions of the standard "X" support. The superior crush resistance better preserves the geometry of the pairs relative to each other and of the pairs relative to the other parts of the cables such as the shield. In addition, the prongs or splines in this invention preferably have a pointed or slightly rounded apex top which easily accommodates an overall shield. These cables include four or more twisted pair media radially disposed about a "+"-shaped core. Each twisted pair nests between two fins of the "+"-shaped core, being separated from adjacent twisted pairs by the core. This helps reduce and stabilize crosstalk between the twisted pair media. U.S. Pat. No. 5,789,711 to Belden describes a "star" separator that accomplishes much of what has been described above and is also herein incorporated by reference.

However, these core types can add substantial cost to the cable, as well as excess material mass which forms a potential fire hazard, as explained below, while achieving a crosstalk reduction of typically 3 dB or more. This crosstalk value is based on a cable comprised of a fluorinated ethylene-propylene (FEP) insulated conductors with PVC jackets as well as cables constructed of FEP jackets with FEP insulated conductors. Cables, where no separations between pairs exist, will exhibit smaller cross-talk values. When pairs are allowed to shift based on "free space" within the confines of the cable jacket, the fact that the pairs may "float" within a free space can reduce overall attenuation values due to the ability to use a larger conductors to maintain 100 ohm impedance. The trade-off with allowing the pairs to float is that the pair of conductors tend to separate slightly and randomly. This undesirable separation contributes to increased structural return loss (SRL) and more variation in impedance. One method to overcome this undesirable trait is to twist the conductor pairs with a very tight lay. This method has been proven impractical because such tight lays are expensive and greatly limit the cable manufacturer's throughput and overall production yield. An improvement included by the present invention to structural return loss and improved attenuation is to provide grooves within channels for conductor pairs such that the pairs are fixedly adhered to the walls of these grooves or at least forced within a confined space to prevent floating simply by geometric configuration. This configuration is both described here within and referenced in U.S. Pat. No. 6,639,152 filed Aug. 25, 2001 as well as the international application PCT/US02/13831 filed at the United States Patent and Trademark Office on May 1, 2002. Both the patent and the pending application are hereby specifically incorporated by reference.

In addition to the preceding portion of the invention, U.S. Pat. Nos. 6,680,922, 5,887,243, 5,444,184, 5,418,878, and 6,751,441 are hereby also incorporated by reference regarding the use of lower voltage power conductors for wireless fidelity applications and the like.

U.S. Pat. No. 6,680,922 refers to a packet-centric wireless point to multi-point telecommunications system comprising a wireless base station coupled to a data network, workstations, subscriber customer premise equipment (CPE) in wireless communication, sharing a wireless bandwidth using a packet-centric protocol and at least one layer above layer 4 of Open Systems Interconnect (OSI) model.

U.S. Pat. No. 5,887,243 includes a method of generating and delivering an individualized mass medium program presentation at a receiver station, a computer for generating and communicating information, and at least one output device operatively connected to a viewer with at least one data storage location.

U.S. Pat. No. 5,444,184 references an apparatus for transmitting communication signals and electrical power signals between two remote locations, comprising at least two twisted pairs having at least one twisted pair for transmitting the communication signals, and having conductors connected in parallel for transmitting electrical power signals; and a transformer means being connected to at least two twisted pairs for separating the transmission of the communication signals and the electrical power signals. The patent describes a communication cable that has at least two twisted pairs and at least two power conductors and may further comprises three paired power conductors for transmission of three phase power, the three paired power conductors being used for transmitting three communication channels.

U.S. Pat. No. 5,418,878 describes an invention that seeks to provide an electrical telecommunications cable construction in which pair-to-pair capacitance unbalance and crosstalk is minimized. Accordingly, this invention provides an electrical telecommunications cable comprising a plurality of pairs of individually insulated conductors, the conductors in each pair twisted together, and spacer means holding the pairs of conductors spaced apart. The spacing means is provided by projections extending inwardly from the jacket or outwardly and are spaced circumferentially around the jacket to provide spacers so the pairs of conductors are separated from one another by the projections.

U.S. Pat. No. 6,751,441 describes a premises, connected to receive broadband service(s) and also connected to a cable system, and provides a broadband interface which connects to in-premises cabling which is coupled to consumer receivers such as television sets, PDAs, and laptops. Connected to the broadband interface is an adjunct device which channels broadband, data and voice signals supplied to an in-premises wireless system as distinguished from the signals supplied to the cable connected consumer receivers. The adjunct device formats the broadband and voice signals or any broadband service into packet format suitable for signal radiation and couples them to the in-premises coax cabling, via a diplexer, at a selected location. At a second cable location a second diplexer, connected to the cable, separates the broadband, data and voice signals and couples them to a signal radiation device (i.e., an RF antenna or leaky coaxial cable) that radiates the signal to the immediate surrounding location. Various devices, near the second cable location for specific services, receive the wireless signals (i.e., broadband, data and voice) from the radiating antenna.

U.S. Pat. No. 6,596,544 by Clark, et. al., and assigned to CDT/Mohawk, describes a data cable comprising a non-conductive central core providing channels for a plurality of twisted pairs of conductors all enclosed in a non-conductive unshielded jacket.

U.S. Pat. No. 6,596,503 by Clark, et. al., and assigned to CDT/Mohawk, describes a method of inserting communication media onto the channels for constructing a data communications cable.

U.S. Pat. No. 4,605,818 by Arroyo, et. al., and assigned to AT&T/Bell Labs, describes a cable construction comprising a central core, data communications media and a jacket enclosing the core and communications media wherein the jacket is comprised of an impregnated woven material, with impregnated additives proportional to the number and type of media to resist heat, effectively delaying the decomposition of the media and core enclosed within.

U.S. Pat. No. 6,008,455 by Lindstrom, et. al., and assigned to Ericsson, describes fixating three or more conductors in a mutually parallel and spaced relationship to minimize data transmission skew and to avoid bit error.

U.S. Pat. No. 4,271,104 by Anderson, et. al., and assigned to Honeywell, describes a method for producing a unitary ribbon like sheet of optic fiber which is effectively optically separated into a plurality of parallel optical paths forming the optically transparent material into a ribbon like sheet.

U.S. Pat. No. 6,818,832 by Hopkinson, et. al., and assigned to Commscope Solutions Properties, LLC, describes a cable comprising a plurality of twisted pairs of conductors and a crossweb running longitudinally along at least a portion of a length of the twisted pairs of conductors wherein at least one of the fins has a substantially elliptical shape thereby spacing the adjoining conductor pair at a maximum spacing within a cable.

U.S. Pat. No. 6,365,836 by Blouin, et. al., and assigned to NORDX/CDT, describes a generally cross-shaped core with a plurality of twisted pairs of insulated conductors with each twisted pair of insulated conductors in stable positions apart from each other and a jacket generally surrounding the plurality of twisted pairs of insulated conductors and the core being held at a distance away from adjacent cabling as defined by the jacket outer surface.

U.S. Pat. No. 6,091,025 by Cotter, et. al., and assigned to Khamsin Technologies, LLC, describes core support-separators comprising two identical portions that when placed back to back define a quadrant cross-section of channels in which to place twisted pairs of communication media.

U.S. Pat. No. 4,755,629 by Beggs, et. al., and assigned to AT&T/Bell Labs, describes a communications cable, which comprises a dielectric material and which includes a plurality of portions each of which is associated individually with a pair of the conductors. Each of the dielectric portions have a thickness which is equal at least to the radius of the metallic conductor of an associated insulated conductor to suitably space each pair of insulated conductors.

U.S. Pat. No. 6,748,146 by Parris, and assigned to Corning Cabling Systems, describes at least one optical fiber being at least partially embedded within at least one material with at least one material forming a housing that protects the optical fiber.

U.S. Pat. No. 6,855,889 by Gaeris, and assigned to Belden Wire & Cable Co., describes a twisted-pair cable separator spline comprising: a longitudinally extending spline having a plurality of spaced longitudinally extending open pockets, a cross-section of said spline having a major axis and a minor axis and at least one pocket being on the major axis, and at least one pocket being on the minor axis, and wherein the major axis has a length greater than a length of said minor axis.

U.S. Pat. No. 6,812,418 by Clark, et. al., and assigned to CDT/Mohawk, describes a configurable tape separator that separates the first twisted pair of insulated conductors from the second twisted pair of insulated conductors without completely surrounding any one twisted pair of the plurality of twisted pairs of insulated conductors all enclosed within a surrounding sheath.

U.S. Pat. No. 6,800,811 by Boucino, and assigned to Commscope Solutions Properties, LLC, describes a communications cable comprising a cable jacket and a spacer extending within the cable jacket with the spacer having a longitudinally extending center portion and plurality of longitudinally extending wall portions radiating from the center portion with the longitudinally extending wall portions increasing in thickness over only a portion of the walls wherewith, within a jacket, the spacer and the cable jacket defining a plurality of compartments for the twisted pair of conductors.

U.S. Pat. No. 6,686,537 by Gaeris, et. al., and assigned to Belden Wire & Cable Co., describes an individual bound lateral shielded twisted pair data cable and a first composite tape having a non-metal base and a layer of metal on one side of the base, and a second composite tape having a non-metal base and a layer of metal on both sides of the base and wrapped around a twisted pair of conductors.

U.S. Pat. No. 5,146,528 by Gleim, et. al., and assigned to Deutsch Thompson-Brandt Gmbh, describes a cable for conducting simultaneously electricity and light comprised of optically conductive material for conducting light therethrough, so that electrical signals can be conducted through said core simultaneously with light signals through said insulation layer.

U.S. Pat. No. 6,792,184 by Conrad, et. al., and assigned to Coming Cabling Systems, describes a fiber optic ribbon having plurality of optical fibers arranged in a generally planar configuration.

U.S. Pat. No. 6,689,958 by McKinney, et. al., and assigned to Parlex Corp., describes a ribbon cable having a length and a width where the ribbon cable comprises a plurality of parallel spaced conductors located in a first plane, each of the plurality of conductors having conductor end portions at opposing ends and a central conductor portion between the conductor end portions, the conductor end portions having a generally circular cross section and a drain wire located generally in a second plane spaced from the first plane by a predetermined distance and a conductive shield layer laminated to one of the opposing surfaces of an insulating material and the shield layer being conductively coupled to the drain wire.

U.S. patent application 20050063650A1 by Castellani, et. al., describes a telecommunication cable comprising a tubular element of polymeric material and at least one transmission element housed within.

U.S. patent application 20040217329A1 by Easter, et. al., describes a semiconductive resin layer in contact with a crosslinked wire and cable insulation layer, wherein the insulation layer is crosslinked using a peroxide cure system to lightly bond the semiconductive resin layer and cable insulation layer.

U.S. patent application 20040149483A1 by Glew, and assigned to Cable Components Group, LLC., describes communications cable comprising an interior support, a central region with an external radial and axial surface, and an interior support comprising at least one anvil shaped core support-separator section radially and axially defined by the central region.

U.S. patent application 20050006133A1 by Greiner, et. al., describes a multiconductor arrangement for either power or data transmission.

U.S. patent application 20050006132A1 by Clark, and assigned to CDT/Mohawk, describes a method of manufacture of a data cable wherein the step of extruding the core includes stretching the core material at a plurality of intervals during extrusion so as to form a corresponding plurality of pinch points along a length of the core such that a diameter of the core at the pinch points is substantially reduced relative to a maximum diameter of the core.

U.S. patent application 20050051355A1 by Bricker, et. al., describes a jacket comprising at least one spline projecting inward from an inner surface of the jacket, wherein at least a portion of a conductive twisted pair is positioned between the spline and a center core, thereby preventing relative movement of the jacket with respect to the core.

U.S. patent application 20050029007A1 by Nordin, et. al., and assigned to Panduit Corp., describes a system for reducing alien crosstalk in a communication network via patch cords to attenuate signals between communications media.

U.S. patent application 20050023028A1 by Clark, describes data communication cable comprising: a plurality of twisted pairs of insulated conductors, each twisted pair comprising two electrical conductors, each surrounded by an insulating layer and twisted together to form the twisted pair; and a jacket substantially enclosing the plurality of twisted pairs of insulating conductors; wherein the insulating layer includes a dielectric material comprising a plurality of microparticles.

U.S. patent application 20040216914A1 by Gavriel, et. al., and assigned to NORDX/CDT, describes a cable wire comprising a conductor and at least one inner insulating layer surrounding the conductor with at least one of the inner layers being a nano-composite comprising nano-sized platelets and a flame and smoke retardant additive package dispersed within a polyolefin matrix.

U.S. patent application 20040118593A1 by Augustine, et. al., describes an electrical data cable having reduced crosstalk characteristics comprising at least two generally flat tape separators placed in between the plurality of twisted conductor pairs.

U.S. patent application 20040055781A1 by Comibert, et. al., and assigned to NORDX/CDT, describes a cable separator spline wherein a pair of longitudinally extending walls includes a first wall substantially thicker than a second wall.

U.S. patent application 20040055779A1 by Wiekhorst, et. al., describes a cable construction of components extending along a longitudinal axis and including at least one first channel wherein the component is grooved.

U.S. patent application 20040256139A1 by Clark, et. al., describes an insulated conductor comprising a conductive core and a first insulating layer surrounding the conductive core and the conductive core has an irregularly shaped outer circumference.

U.S. patent application 20050056454A1 by Clark, describes a cabling scenario wherein a first twisted pair of conductors is wrapped with an insulative material of a measured dielectric constant, a second twisted pair of a second dielectric constant and a third pair of a third dielectric constant by wrapping the twisted pairs with cumulative layers of various dielectric constant electrical properties.

U.S. Pat. No. 5,821,466 by Clark, et. al., describes a cable system whereby a first twisted pair of conductors is wrapped in a second pair of twisted pair of conductors with substantial contact and a third twisted pair of conductors is substantially wrapped around the second twisted pair of conductors to increase mechanical stability of the concentrically twisted pairs of conductors.

U.S. Pat. No. 5,544,270 by Clark, et. al., describes a twisted pair of conductors substantially wrapped around a central core and a jacket wherein a second pair of twisted conductors is wrapped around the first and subsequently wrapped in a second jacket.

International patent application WO2004/021,367 by Schuman, et. al., and assigned to Belden Technologies, describes multi-member cables which are compromised of jacketed cables whose jackets are adhered together without the use of an adhesive element, such as by co-forming the jackets, and methods for manufacturing such cables are also discussed. Generally, the components will be separated from the multi-member cable by an installer.

International patent application WO1996/024143 by Hardie, et. al., and assigned to W L Gore, describes a high speed data transmission with a cable differential pair comprising two conductors generally 180 degrees apart from each other wherein the distance between any of the conductors and the shield is substantially equal to or greater than the distance between that conductor and the center axis of the cable.

International patent application WO2004/042446A1 by Ishikawa, et. al., and assigned to and assigned to Sumitomo Electric Inc. Ltd., describes an optical fiber ribbon comprising a plurality of optical fibers which are arranged in parallel and a resin which integrates the plurality of optical fibers over the whole length of the optical fibers.

Japan patent application JP07122123A2 by Kazuhiro, et. al., and assigned to Sumitomo Electric Co, Ltd., describes a ribbon cable that is rolled to form a unit cable around a central core.

European patent application EP0957494B1 by Keller, and assigned to Alcatel, describes a composite cable for providing electrical signals and optical signals comprising twisted pairs of wires and optical fiber media.

Finally, U.S. Pat. No 4,523,970 by Toy, and assigned to Raytheon, and hereby incorporated by reference into the body of this specification, describes the use of ethylene-vinyl acetate copolymer and ethylene-vinyl acetate-methacrylic acid terpolymer and a rubber component comprising butyl rubber to provide am adhesive-like inner surface of components that are extruded. The use of this "tacky" adhesive like surface is part of the instant invention in that the cable and/or support-separator can make use of this technique to ensure that conductive and non-conductive media may be intentionally placed properly and also removed as desired during installation.

A broad range of electrical conductors and electrical cables are installed in modern buildings for a wide variety of uses. Such uses include data transmission between computers, voice communications, as well as control signal transmission for building security, fire alarm, and temperature control systems. These cable networks extend throughout modern office and industrial buildings, and frequently extend through the space between the dropped ceiling and the floor above. Ventilation system components are also frequently extended through this space for directing heated and chilled air to the space below the ceiling and also to direct return air exchange. The space between the dropped ceiling and the floor above is commonly referred to as the plenum area. Electrical conductors and cables extending through plenum areas are governed by special provisions of the National Electric Code ("NEC").

In building designs, many precautions are taken to resist the spread of flame and the generation of and spread of smoke throughout a building in case of an outbreak of fire. Clearly, the cable is designed to protect against loss of life and also minimize the costs of a fire due to the destruction of electrical and other equipment. Therefore, conductive media and cables for building installations are required to comply with the various flammability requirements of the National Electrical Code (NEC) in the U.S. as well as International Electrotechnical Commission (EIC) and/or the Canadian Electrical Code (CEC).

Cables intended for installation in the air handling spaces (i.e. plenums, ducts, etc.) of buildings are specifically required by NEC/CEC/IEC to pass the flame test specified by Underwriters Laboratories Inc. (UL), UL-910, or its Canadian Standards Association (CSA) equivalent, the FT6. The UL-910, FT-6, and the NFPA 262 represent the top of the fire rating hierarchy established by the NEC and CEC respectively. Also important are the UL 1666 Riser test and the IEC 60332-3C and D flammability criteria. Cables possessing these ratings, generically known as "plenum" or "plenum rated" or "riser" or "riser rated", may be substituted for cables having a lower rating (i.e. CMR, CM, CMX, FT4, FTI or their equivalents), while lower rated cables may not be used where plenum or riser rated cables are required.

In 1975, the NFPA recognized the potential flame and smoke hazards created by burning cables in plenum areas, and adopted in the NEC a standard for flame retardant and smoke suppressant cables. This standard, commonly referred to as "the Plenum Cable Standard", permits the use of cable without conduit, so long as the cable exhibits low smoke and flame retardant characteristics. The test method for measuring these characteristics is commonly referred to as the Steiner Tunnel Test. The Steiner Tunnel Test has been adapted for the burning of cables according to the following test protocols: NFPA 262, Underwriters Laboratories (U.L.) 910, or Canadian Standards Association (CSA) FT-6. The test conditions for each of the U.L. 910 Steiner Tunnel Test, CSA FT-6, and NFPA 262 are as follows: a 300,000 BTU/hour flame is applied for 20 minutes to ten 24-foot lengths of test cables mounted on a horizontal tray within a tunnel. The criteria for passing the Steiner Tunnel Test is as follows:

A. Flame spread—flame travel less than 5.0 feet.

B. Smoke generation:

1. Maximum optical density of smoke less than 0.5.

2. Average optical density of smoke less than 0.15.

Because of concerns that flame and smoke could travel along the extent of a plenum area in the event the electrical conductors and cable were involved in a fire, the National Fire Protection Association ("NFPA") has developed a standard to reduce the amount of flammable material incorporated into insulated electrical conductors and jacketed cables. Reducing the amount of flammable material would, according to the NFPA, diminish the potential of the insulating and jacket materials from spreading flames and evolving smoke to adjacent plenum areas and potentially to more distant and widespread areas throughout a building.

The products of the present invention have also been developed to support the evolving NFPA standard referenced as NFPA 255 entitled "Limited Combustible Cables" with less than 50 as a maximum smoke index and/or NFPA 259 entitled "Heat of Combustion" which includes the use of an oxygen bomb calorimeter that allows for materials with less than 3500 BTU/lb. for incorporation into the newer cable (and conductors and separators within these cables) designs. The proposed materials of the present invention are for inclusion with high performance support-separators and conduit tubes designed to meet the new and evolving standards proposed for National Electrical Code (NEC) adoption in 2005. Table 4 below provides the specific requirements for each of the Cables conforming to NEC/CEC/IEC requirements are characterized as possessing superior resistance to ignitability, greater resistant to contribute to flame spread and generate lower levels of smoke during fires than cables having lower fire ratings. Often these properties can be anticipated by the use of measuring a Limiting Oxygen Index (LOI) for specific materials used to construct the cable. Conventional designs of data grade telecommunication cable for installations in plenum chambers have a low smoke generating jacket material, e.g. of a specially filled PVC formulation or a fluoropolymer material, surrounding a core of twisted conductor pairs, each conductor individually insulated with a fluorinated insulation layer. Cable produced as described above satisfies recognized plenum test requirements such as the "peak smoke" and "average smoke" requirements of the Underwriters Laboratories, Inc., UL910 Steiner tunnel test and/or Canadian Standards Association CSA-FT6 (Plenum Flame Test) while also achieving desired electrical performance in accordance with EIA/TIA-568 A, B, and C for high frequency signal transmission.

The newer standards are forcing industrial "norms" to change and therefore require a new and unique set of materials that will be required to achieve the new standards. These materials are the subject of the present invention and include nano-composites of clay and other inorganics such as ZnO and $TiO_2$ both also as nano-sized particles. In addition, the use of insulative or semi-conductive Buckminster fullerenes and doped fullerenes of the $C_{60}$ family, nanotubes of the same and the like are part of the present invention and offer unique properties that allow for maintaining electrical integrity as well as providing the necessary reduction in flame retardance and smoke suppression.

While the above described conventional cable, due in part to its use of fluorinated polymers, meets all of the above design criteria, the use of fluorinated polymers is extremely expensive and may account for up to 60% of the cost of a cable designed for plenum usage. A solid core of these communications cables contributes a large volume of fuel to a potential cable fire. Forming the core of a fire resistant material, such as with FEP (fluorinated ethylene-propylene), is very costly due to the volume of material used in the core, but it should help reduce flame spread over the 20-minute test period. Reducing the mass of material by redesigning the core and separators within the core is another method of reducing fuel and thereby reducing smoke generation and flame spread. For the commercial market in Europe, low smoke fire retardant polyolefin materials have been developed that will pass the EN (European Norm) 502666-Z-X Class B relative to flame spread, total heat release, related heat release, and fire growth rate. Prior to this inventive development, standard cable constructions requiring the use of the aforementioned expensive fluorinated polymers, such as FEP, would be needed to pass this rigorous test. Using low smoke fire retardant polyolefins for specially designed separators used in cables that meet the more stringent electrical requirements for Categories 6 and 7 and also pass the new norm for flammability and smoke generation is a further subject of this invention. Tables 3A, 3B, and 4 indicate categories for flame and smoke characteristics and associated test methods as discussed above.

TABLE 3A

International Classification and Flame Test Methodology for Communications Cable

| Class | Test Methods | Classification Criteria | Additional Classification |
|---|---|---|---|
| $A_{ca}$ | EN ISO 1716 | PCS ≦ 2.0 MJ/kg (1) and PCS ≦ 2.0 MJ/kg (2) | |
| $B_{1ca}$ | $FIPEC_{20}$ Scenario 2 (6) and | FS ≦ 1.75 m and $THR_{1200}$ ≦ 10 MJ and Peak HRR ≦ 20 kW and FIGRA ≦ 120 $Ws^{-1}$ | Smoke production (3, 7) and Flaming droplets/particles (4) and Acidity (5) |
| | EN 50285-2-1 | H ≦ 425 mm | |
| $B_{2ca}$ | $FIPEC_{20}$ Scenario 1 (6) and | FS ≦ 1.5 m and $THR_{1200}$ ≦ 15 MJ and Peak HRR ≦ 30 kW and FIGRA ≦ 150 $Ws^{-1}$ | Smoke production (3, 8) and Flaming droplets/particles (4) and Acidity (5) |
| | EN 50285-2-1 | H ≦ 425 mm | |
| $C_{ca}$ | $FIPEC_{20}$ Scenario 1 (6) and | FS ≦ 2.0 m and $THR_{1200}$ ≦ 30 MJ and Peak HRR ≦ 60 kW and FIGRA ≦ 300 $Ws^{-1}$ | Smoke production (3, 8) and Flaming droplets/particles (4) and Acidity (5) |
| | EN 50285-2-1 | H ≦ 425 mm | |
| $D_{ca}$ | $FTPEC_{20}$ Scenario 1 (6) and | $THR_{1200}$ ≦ 70 MJ and Peak HRR ≦ 400 kW and FIGRA ≦ 1300 $Ws^{-1}$ | Smoke production (3, 8) and Flaming droplets/particles (4) and Acidity (5) |
| | EN 50285-2-1 | H ≦ 425 mm | |

TABLE 3A-continued

| International Classification and Flame Test Methodology for Communications Cable | | | |
|---|---|---|---|
| Class | Test Methods | Classification Criteria | Additional Classification |
| Eca | EN 50285-2-1 | H ≦ 425 mm | Acidity (5) |
| Fca | | No Performance Determined | |

(1) For the product as a whole, excluding metallic materials.
(2) For any external component (ie. Sheath) of the product.
(3) S1 = $TSP_{1200}$ ≦ 50 $M^2$ and peak SPR ≦ 0.25 $m^2/s$
S2 = $TSP_{1200}$ ≦ 400 $M^2$ and peak SPR ≦ 1.5 $m^2/s$
S3 = Not S1 or S2
(4) For $FIPEC_{20}$ Scenarios 1 and 2:
d0 = No flaming droplets/particles within 1200 s
d1 = No flaming droplets/particles persisting longer than 10 s within 1200 s
d3 = not d0 or d1
(5) EN 50285-2-1: (?)
A1 = conductivity < 2.5 μS/mm and pH > 4.3
A2 = conductivity < 10 μS/mm and pH > 4.3
A3 = not A1 or A2
No declaration = No Performance Determined
(6) Airflow into chamber shall be set to 8000 +/− 800 l/min.
$FIPEC_{20}$ Scen.1 = prEN50399-2-1 with mounting and fixing according to Annex 2
$FIPEC_{20}$ Scen.2 = prEN50399-2-2 with mounting and fixing according to Annex 2
(7) The smoke class declared in class B1ca cables must originate from the $FIPEC_{20}$ Scen.2 test
(8) The smoke class declared in class B2ca cables must originate from the $FIPEC_{20}$ Scen.1 test

TABLE 3B

| International Classification and Test Methodology for Communications Cable | | |
|---|---|---|
| Pending CPD Euro-Classes for Cables | | |
| PCS = gross calorific potential | | FIGRA = fire growth rate |
| FS = flame spread (damaged length) | | TSP = total smoke production |
| THR = total heat release | | SPR = smoke production rate |
| HRR = heat release rate | | H = flame spread |
| Pending CPD Euro-Classes for Communications & Energy Cables | | |
| [A1] | EN ISO 1716 | Mineral Filled Circuit Integrity Cables |
| [B1] | FIPEC Sc.2/EN 50265-2-1 | LCC/HIFT - type LAN Comm. Cables |
| [B2] | FIPEC Sc.1/EN 50265-2-1 | Energy Cables |
| [C] | FIPEC Sc.1/EN 50265-2-1 | High FR/Riser-type Cables |
| [D] | FIPEC Sc.1/EN 50265-2-1 | IEC 332.3C type Cables |
| [E] | EN 50265-2-1 | IEC 332.1/VW1 type Cables |
| [F] | | No Requirement |

TABLE 4

| Flammability Test Methods and Level of Severity for Wire and Cable | | | |
|---|---|---|---|
| Test Method | Ignition Source Output | Airflow | Duration |
| UL2424/NFPA 259/255/UL723 | 8 MJ/kg (35,000 BTU/lb.) | — | — |
| Steiner Tunnel UL 910/NFPA 262 | 88 kW (300 k BTU/hr.) | 73 m/min. (240 ft/min.) forced | 20 min. |
| RISER UL2424/NFPA 259 | 154 kW (527 K BTU/hr.) | Draft | 30 min. |

TABLE 4-continued

| Flammability Test Methods and Level of Severity for Wire and Cable | | | |
|---|---|---|---|
| Test Method | Ignition Source Output | Airflow | Duration |
| Single Burning Item | 30 kW (102 k BTU/hr.) | 36 $m^3$/min. | 30 min. (20 min burner) |
| Modified IEC 60332-3 | 30 kW (102 k BTU/hr.) (Backboard behind ladder (heat impact)) | 8 $m^3$/min. | 20 min. |
| IEC 60332-3 | 20.5 kw (70 k BTU/hr.) | 5 $m^3$/min. | 20 min |
| Vertical Tray | 20.5 kw (70 k BTU/hr.) | Draft | 20 min |
| IEC 60332-1/ULVW-1 | Bunsen Burner | — | 1 min (15 sec. Flame) |

Evolution of Fire Performance (Severity Levels)

VW 1/IEC 60332-1/FT-1/CPD Class E (least severe)
UL 1581 Tray/IEC 60332-3/FT-2/CPD Class D
UL 1666 Riser/FT-4/CPD Class C & B2
NFPA 262/EN 50289/FT-6/CPD Class B1/UL 910
NFPA 255 & NFPA 259/LC/CPD Class B1+/UL 2424 (most severe)

Table 5 indicates material requirements for wire and cable that can meet some of the test method criteria as provided in Table 4. "Low smoke and flame compound A" is a fluoropolymer based blend that includes inorganics known to provide proper material properties such that NFPA 255 and NFPA 259 test protocols may be met.

TABLE 5

Material Requirements and Properties for Plenum, Riser, and Halogen Free Cables

| Properties | Low Smoke and Flame Compound A NFPA 255/259 LC | LSFR PVC HIFT/NFPA 262 Euro Class B1 | (Halogen Free) IEC 332.2C Class C/D | (Halogen Free) IEC 332.1 Euro Class E |
|---|---|---|---|---|
| Specific Gravity | 2.77 g/cc | 1.65 g/cc | 1.61 g/cc | 1.53 g/cc |
| Durometer D Aged, Inst/15 sec. | 69/61 | 72/63 | 59/49 | 53/47 |
| Tensile Strength, 20"/min. | 2,250 psi/ 15.5 Mpa | 2,500 psi/ 17.2 Mpa | 1,750 psi/ 12.1 Mpa | 1,750 psi/ 12.1 Mpa |
| Elongation, 20"/min. | 250% | 180% | 180% | 170% |
| Oxygen Index, (0.125") | 100+% | 53% | 53% | 35% |
| Brittle point, deg C. | −46 | −5 | −22 | −15 |
| Flexural Modulus, 0.03"/min. | 202000 psi/ 1400 Mpa | 56000 psi/ 390 Mpa | 41000 psi/ 280 Mpa | 49000 psi/ 340 MPa |
| UL Temp Rating, deg C. | 125+ | 60 | 90 | 75 |
| Dielectric Constant, 100 MHz | 2.92 | 3.25 | 3.87 | 3.57 |
| Dissipation Factor, 100 MHz | 0.012 | 0.014 | 0.015 | 0.014 |
| 4 pr UTP Jkt Thickness | 9-11 mils/ .23-.28 mm | 15-17 mils/ .38-.43 mm | 30-40 mils/ .76-1.02 mm | 20-24 mils/ .50-.60 mm |

Table 6 is provided as an indicator of low acid gas generation performance for various materials currently available for producing wire and cable and cross-web designs of the present invention. The present invention includes special polymer blends that are designed to significantly reduce these values to levels such as those shown for low smoke and flame Compound A as listed above in Table 5.

TABLE 6

Acid Generation Values for Wire and Cable Insulation Materials

| Material | % Acid | PH |
|---|---|---|
| FEP | 27.18 | 1.72 |
| ECTFE | 23.890 | 1.64 |
| PVDF | 21.48 | 2.03 |
| LSFR PVC | 13.78 | 1.90 |
| Low Smoke and Flame Compound A | 1.54 | 3.01 |
| 48% LOI HFFR | 0.35 | 3.42 |
| 34% LOI HFFR | .024 | 3.94 |

Solid flame retardant/smoke suppressed polyolefins may also be used in connection with fluorinated polymers. Commercially available solid flame retardant/smoke suppressed polyolefin compounds all possess dielectric properties inferior to that of FEP and similar fluorinated polymers. In addition, they also exhibit inferior resistance to burning and generally produce more smoke than FEP under burning conditions. A combination of the two different polymer types can reduce costs while minimally sacrificing physio-chemical properties. An additional method that has been used to improve both electrical and flammability properties includes the irradiation of certain polymers that lend themselves to crosslinking. Certain polyolefins are currently in development that have proven capable of replacing fluoropolymers for passing these same stringent smoke and flammability tests for cable separators, also known as "cross-webs". Additional advantages with the polyolefins are reduction in cost and toxicity effects as measured during and after combustion. The present invention utilizes blends of fluoropolymers with primarily polyolefins as well as the use of "additives" that include $C_{60}$ fullerenes and compounds that incorporate the fullerenes and substituted fullerenes including nanotubes as well as inorganic clays and metal oxides as required for insulative or semi-conductive properties in addition to the flame and smoke suppression requirements. The use of fluoropolymer blends with other than polyolefins is also a part of the present invention and the incorporation of these other "additives" will be included as the new compounds are created. Reduction of acid gas generation is another key feature provided by the use of these blends as shown in Table 6 and another important advantage presented in the use of the cables and separators of the present invention. Price and performance characteristics for the separators and conduit tubes will determine the exact blend ratios necessary for these compounds.

A high performance communications data cable utilizing twisted pair technology must meet exacting specification with regard to data speed, electrical, as well as flammability and smoke characteristics. The electrical characteristics include specifically the ability to control impedance, near-end crosstalk (NEXT), ACR (attenuation cross-talk ratio) and shield transfer impedance. A method used for twisted pair data cables that has been tried to meet the electrical characteristics, such as controlled NEXT, is by utilizing individually shielded twisted pairs (ISTP). These shields insulate each pair from NEXT. Data cables have also used very complex lay techniques to cancel E and B (electric and magnetic fields) to control NEXT. In addition, previously manufactured data cables have been designed to meet ACR requirements by utilizing very low dielectric constant insulation materials. Use of the above techniques to control electrical characteristics have inherent problems that have lead to various cable methods and designs to overcome these problems. The blends of the present invention are designed such that these key parameters can be met.

Recently, as indicated in Tables 1, 2A and 2B, the development of "high-end" electrical properties for Category 6 and 7 cables has increased the need to determine and include power sum NEXT (near end crosstalk) and power sum ELFEXT (equal level far end crosstalk) considerations along with attenuation, impedance, and ACR values. These developments have necessitated more highly evolved separators that can provide offsetting of the electrical conductor pairs so that the lesser performing electrical pairs can be further separated from other pairs within the overall cable construction.

Recent and proposed cable standards are increasing cable maximum frequencies from 100-200 MHz to 250-700 Mhz. Recently, 10 Gbit over copper high-speed standards have been proposed. The maximum upper frequency of a cable is that frequency at which the ACR (attenuation/cross-talk ratio) is essentially equal to 1. Since attenuation increases with frequency and cross-talk decreases with frequency, the cable designer must be innovative in designing a cable with sufficiently high crosstalk. This is especially true since many conventional design concepts, fillers, and spacers may not provide sufficient cross-talk at the higher frequencies. Proposed limits for alien crosstalk have also been added to the present standards as shown in Table 2G. Such limits in many cases can only be met using the separators of the present invention.

Current separator designs must also meet the UL 910 flame and smoke criteria using both fluorinated and non-fluorinated jackets as well as fluorinated and non-fluorinated insulation materials for the conductors of these cable constructions. In Europe, the trend continues to be use of halogen free insulation for all components, which also must meet stringent flammability regulations. The use of the blends of the present invention for both separators and tube conduits will allow for meeting these requirements.

In plenum applications for voice and data transmission, electrical conductors and cables should exhibit low smoke evolution, low flame spread, and favorable electrical properties. Materials are generally selected for plenum applications such that they exhibit a balance of favorable and unfavorable properties. In this regard, each commonly employed material has a unique combination of desirable characteristics and practical limitations. Without regard to flame retardancy and smoke suppressant characteristics, olefin polymers, such as polyethylene and polypropylene, are melt extrudable thermoplastic materials having favorable electrical properties as manifested by their very low dielectric constant and low dissipation factor.

Dielectric constant is the property of an insulation material which determines the amount of electrostatic energy stored per unit potential gradient. Dielectric constant is normally expressed as a ratio. The dielectric constant of air is 1.0, while the dielectric constant for polyethylene is 2.2. Thus, the capacitance of polyethylene is 2.2 times that of air. Dielectric constant is also referred to as the Specific Inductive Capacity or Permittivity.

Dissipation factor refers to the energy lost when voltage is applied across an insulation material, and is the cotangent of the phase angle between voltage and current in a reactive component. Dissipation factor is quite sensitive to contamination of an insulation material. Dissipation factor is also referred to as the Power Factor (of dielectrics).

Fluorinated ethylene/propylene polymers exhibit electrical performance comparable to non-halogenated to olefin polymers, such as polyethylene, but are over 15 times more expensive per pound. Polyethylene also has favorable mechanical properties as a cable jacket as manifested by its tensile strength and elongation to break. However, polyethylene exhibits unfavorable flame and smoke characteristics.

Limiting Oxygen Index (ASTM D-2863) ("LOI") is a test method for determining the percent concentration of oxygen that will support flaming combustion of a test material. The greater the LOI, the less susceptible a material is to burning. In the atmosphere, there is approximately 21% oxygen, and therefore a material exhibiting an LOI of 22% or more cannot burn under ambient conditions. As pure polymers without flame retardant additives, members of the olefin family, namely, polyethylene and polypropylene, have an LOI of approximately 19. Because their LOI is less than 21, these olefins exhibit disadvantageous properties relative to flame retardancy in that they do not self-extinguish flame, but propagate flame with a high rate of heat release. Moreover, the burning melt drips on the surrounding areas, thereby further propagating the flame.

Table 7 below summarizes the electrical performance and flame retardancy characteristics of several polymeric materials. Besides fluorinated ethylene/propylene, other melt extrudable thermoplastic generally do not provide a favorable balance of properties (i.e., high LOI, low dielectric constant, and low dissipation factor). Moreover, when flame retardant and smoke suppressant additives are included within thermoplastic materials, the overall electrical properties generally deteriorate.

TABLE 7

| Fire Retardancy Characteristics | | | | | |
|---|---|---|---|---|---|
| | Electrical Properties | | | | |
| | Dielectric Constant | Dissipation Factor | | NBS Smoke Values Optical Density, DMC | |
| Material | 1 MHz, 23 Deg. C. | 1 MHz, 23 Deg. C. | LOI % | Flaming | Non-flaming |
| PE | 2.2 | .00006-.0002 | 19 | 387 | 719 |
| FRPE | 2.6-3.0 | .003-.037 | 28-32 | — | — |
| FEP | 2.1 | .00055 | >80 | — | — |
| PVC | 2.7-3.5 | .024-.070 | 32 | 740 | 280 |
| RSFRPVC | 3.2-3.6 | .018-.080 | 39 | 200 | 190 |
| LSFRPVC | 3.5-3.8 | .038-.080 | 49 | <200 | <170 |

In the above table, PE designates polyethylene, FRPE designates polyethylene with flame retardant additives, FEP designates fluorinated ethylene/propylene polymer, PVC designates polyvinylchloride, RSFRPVC designates reduced smoke flame retardant polyvinylchloride, LSFRPVC designates low smoke flame retardant polyvinylchloride, LOI designates Limiting Oxygen Index, NBS designates the National Bureau of Standards, and DMC designates Maximum Optical Density Corrected.

In general, the electrical performance of an insulating material is enhanced by foaming or expanding the corresponding solid material. Foaming also decreases the amount of flammable material employed for a given volume of material. Accordingly, a foamed material is preferably employed to achieve a favorable balance of electrical properties and flame retardancy.

In addition to the requirement of low smoke evolution and flame spread for plenum applications, there is a growing need for enhanced electrical properties for the transmission of voice and data over twisted pair cables. In this regard, standards for electrical performance of twisted pair cables are set forth in Electronic Industry Association/Telecommunications Industry Association (EIA/TIA) document TSB 36 and 40. The standards include criteria for attenuation, impedance, crosstalk, and conductor resistance.

In the U.S. and Canada, the standards for flame retardancy for voice communication and data communication cables are stringent. The plenum cable test (U.L. 910/CSA FT-6) and riser cable test U.L. 1666 are significantly more stringent than the predominantly used International fire test IEC 332-3, which is similar to the IEEE 383/U.L. 1581 test.

Table 8 already summarizes the standards required for various U.L.(Underwriters Laboratories and CSA (Canadian Standards Authority) cable designations.

TABLE 8

| U.L./CSA | | |
|---|---|---|
| Designation | Cable Fire Test | Flame Energy |
| CMP/MPP | Plenum U.L. 910<br>CSA FT-6 Horizontal Riser | 300,000 BTUH |
| CMR/MPR | U.L. 1666 Vertical | 527,000 BTUH |
| CMG/MPG | FT-4 Vertical | 70,000 BTUH<br>Burner angle 20 degrees |
| CM/MP | IEEE 1581 Vertical | 70,000 BTUH<br>Burner angle 0 degrees |

As indicated above, current separator designs must also meet the UL 910 flame and smoke criteria using both fluorinated and non-fluorinated jackets as well as fluorinated and non-fluorinated insulation materials for the conductors of these cable constructions. The UL 910 criteria has been included in the recently adopted NFPA 262 criteria and extended with more severity in the NFPA 255 and 259 test criteria. To ensure that the test criteria is met, the use of the separators of the current invention is not only useful but often necessary. For meeting the NFPA 72 test criteria for circuit integrity cable, the support-separators and the materials from which they will be produced is an integral part of the present invention. The reduction in material loading (lbs/MFT) as shown in Table 9 can be an essential aspect in meeting this demand. Substantial reduction of this load by the use of separators can be achieved. The use of the polymer blends of the present invention for both separators and conduit tubes will allow for meeting the requirements for not only current circuit integrity cables but also for cables that must meet the newer more stringent requirements in the future.

TABLE 9

Insulation Material Criteria For Circuit Integrity Cable

| Number of Conductors | AWG size | Insulation Thickness (mils) | Jacket Thickness (mils) | Cable Diameter (in) | Approximate Weight (lbs/MFT) | Nominal Cable Lay (in./twist) |
|---|---|---|---|---|---|---|
| 2 | 16 | 35 | 40 | .34 | 59 | 3.7 |
| 2 | 14 | 35 | 40 | .36 | 75 | 4.0 |
| 2 | 12 | 35 | 50 | .42 | 106 | 4.4 |

Principal electrical criteria can be satisfied based upon the dielectric constant and dissipation factor of an insulation or jacketing material. Secondarily, the electrical criteria can be satisfied by certain aspects of the cable design such as, for example, the insulated twisted pair lay lengths. Lay length, as it pertains to wire and cable, is the axial distance required for one cabled conductor or conductor strand to complete one revolution about the axis of the cable. Tighter and/or shorter lay lengths generally improve electrical properties.

Individual shielding is costly and complex to process. Individual shielding is highly susceptible to geometric instability during processing and use. In addition, the ground plane of individual shields, 360° in ISTP's—individually shielded twisted pairs is also an expensive process. Lay techniques and the associated multi-shaped anvils of the present invention to achieve such lay geometries are also complex, costly and susceptible to instability during processing and use. Another problem with many data cables is their susceptibility to deformation during manufacture and use. Deformation of the cable geometry, such as the shield, also potentially severely reduces the electrical and optical consistency.

Optical fiber cables exhibit a separate set of needs that include weight reduction (of the overall cable), optical functionality without change in optical properties and mechanical integrity to prevent damage to glass fibers. For multi-media cable, i.e. cable that contains both metal conductors and optical fibers, the set of criteria is often incompatible. The use of the present invention, however, renders these often divergent set of criteria compatible.

Specifically, optical fibers must have sufficient volume in which the buffering and jacketing plenum materials (FEP and the like) covering the inner glass fibers can expand and contract over a broad temperature range without restriction, for example −40 C. to 80 C. experienced during shipping. It has been shown by Grune, et. al., among others, that cyclical compression and expansion directly contacting the buffered glass fiber causes excess attenuation light loss (as measured in dB) in the glass fiber. The design of the present invention allows for designation and placement of optical fibers in clearance channels provided by the support-separator having multiple shaped profiles. It would also be possible to place both glass fiber and metal conductors in the same designated clearance channel if such a design is required. In either case the forced spacing and separation from the cable jacket (or absence of a cable jacket) would eliminate the undesirable set of cyclical forces that cause excess attenuation light loss. In addition, fragile optical fibers are susceptible to mechanical damage without crush resistant members (in addition to conventional jacketing). The present invention addresses this problem by including the use of both organic and inorganic polymers as well as inorganic compounds blended with fluoropolymers to achieve the necessary properties in a non-conventional separator design.

The need to improve the cable and cable separator design, reduce costs, and improve both flammability and electrical properties continues to exist.

OBJECT OF THE INVENTION

An object of the invention is a high performance, multi-media communications cable and initially flat cable support-separator and/or jacket.

A primary objective of this invention is an initially flat communications cable comprising cable support members or structures attached to an essentially flat backing portion with each cable support member having one or more external and internal radial and axial surfaces wherein conductive media may be placed and whereby the conductive media and the initially flat cable support-separator may be rolled into an eccentric or concentric shape to form a high performance, multi-media communications cable, cable support-separator and/or jacket.

Another objective is that the support members extend along a longitudinal length of a communications cable support-separator.

Another objective of the invention is that the initially flat communications cable has a central region when the initially flat communications cable, cable support-separator and/or jacket is rolled-up or folded and that a central region then also extends along a longitudinal length of the communications cable.

Another objective of the invention is that the initially flat communications cable support-separator and/or jacket can be inversely rolled-up or folded and have one or more cable support members outwardly extended from the central region to form an inversely concentric or eccentric cable support-separator in that the support-separator(s) are formed on an outer surface of said roll-up.

Another objective of the invention is where a cable support-separator and/or jacket includes top-hat shaped features on a top portion of longitudinally hollow structures or optionally solid structures that provide extended surfaces to support an additional jacket that may be attached or extruded to the backing surface wherein the hollow structures allow for insertion of various conductive or non-conductive media.

Additionally an objective of the invention provides for an initially primarily flat flexible cable support-separator and/or jacket functional support-separators including equally or non-equally spaced hollow structures, extruded or molded or adhered or otherwise attached integrally to a primarily flat backing surface with the surface extending to one or more lateral ends of the hollow structures, each of the hollow structures having a gap allowing for insertion, containment and separation of non-conductive or conductive media comprising twisted pair, co-axial, WIFI antennae, power, and/or fiber optic conductors in advance of, during, or after installation and the hollow structures may be left empty.

Additionally an objective of the initially primarily flat flexible cable support-separator and functional support-separators would be that up to six or more equally or non-equally spaced hollow structures may be individually constructed of various diameters and/or thicknesses to contain and support varying diameter media, on the top or the bottom of the flat backing surface, and be of conductive and/or non-conductive media, and the structures may include within a central region a support-separator and they may be of any shape or form useful in providing primarily randomness to further mitigate pair-to-pair coupling thereby improving any crosstalk performance including alien crosstalk.

Another objective includes the use of a thicker shell of a hollow structure that may itself act as a strength member or as a drain wire and where the hollow structures or thicker shell may be used for insertion of conductive media with or without internal cable support-separators or may remain hollow.

Another objective of the invention provides for an initially primarily flat flexible cable support-separator and functional support-separators with hollow structures that may include an overlap downwardly positioned feature extruded or molded into one extended end of the flat backing surface and may also include an overlap upwardly positioned feature extruded or molded into an opposite extended end of the flat backing surface where they would be able to be joined together when rolled or folded.

Another objective of the present invention is to create a hollow structure bud similar to the hollow structures, but smaller, that is attached externally and integrally to the outer surface of any hollow structure previously described so that the bud is situated at a preferential angle with respect to the flat backing surface where the hollow structure bud may have an optional gap for insertion of media.

Another objective of the present invention includes allowing for a roll-up cable support separator from either or both of the lateral ends to encircle the hollow structures with the flat backing surface as an outside surface of the hollow structure to form a concentric or eccentric cable support-separator with an essentially curved backing surface and that the lateral ends may be joined and ground wire may be added to provide electrical continuity within an outer insulated layer or jacket that may include an adhesive and may be joined or unjoined and provide either partial or full coverage of the conductors when rolled-up.

Additionally an objective includes allowing a greater material thickness shell attached to a flat backing surface to be rolled so that the shell is more or less centrally located between several hollow shells of nominal thickness and the greater material shell is basically centrally located within the rolled-up cable support-separator.

Another objective provides for a backing surface that creates a cable support-separator that itself is rolled around a typical cross-shaped cable support-separator providing a concentric or an eccentric cable bundle.

Another objective would be to provide a backing surface of a cable support-separator with an inner rifled surface and a smooth outer surface or an inner rifled surface and rifled outer surface and wherein the support-separator itself may be used as a wrap or jacket encapsulating conductive media bundles.

Another objective provides for combining such that they will complete an overlap similar in appearance to that of a cigarette wrapper or a spiral wrap, wound around conductive media wherein a trailing edge overlaps a leading edge and there may be an overlapped interlocked or over-wrapped tape-like layer and wherein the cable support-separator may be overlapped in a singular fashion where the lateral ends make contact with each other including a zipper-like closure or wherein the backing surface is rolled to provide said cable support-separator that is itself rolled around a cross-shaped cable support-separator creating a concentric or eccentric shaped bundle.

An additional objective includes providing a backing surface that includes a top and a bottom surface where the backing surface that may be inversely rolled or folded from each of the ends to encircle an underside surface of the backing surface such that the hollow structures form one or more inversely concentric or eccentric cable support-separators on an outer surface.

An additional objective includes the use of hollow structures of varying diameters and thicknesses wherein a support-separator comprised of smaller and thinner hollow structures may be used primarily for installations in constrained spaces or for reducing mass and therefore reducing smoke and flame spread.

Another objective includes the ability to fabricate concentric or eccentric sets of structures that contain a gap that allows for formation of a support-separator and also allows for media to be inserted and readily peeled from the cable support-separator whereby routing, installation and termination of individual conductive media is improved.

An additional objective is to provide a cable support-separator to support a conduit tube which may exist within or exterior to the central region of the cable support-separator and also extend along the longitudinal length of the cable support-separator and the conduit tubes provide either an eccentric or concentric cable.

Another objective provides for conduit tubes are of various shapes and random in diameter and size, and when laid or wound along a longitudinal length of a cable support-separator varying the cable overall diameter and reducing or eliminating cross-talk Another objective of this invention includes the fact that the conduit tube may be helically wound around the cable support-separator or internal to a communications cable, with variable patterns and of variable tensions and may be wrapped or jacketed with conventional wrap or jacketing materials and processes.

An objective of this invention is to provide an extruded or molded, wrapped or jacketed outer shell portion that may have non-conductive, semi-conductive or conductive properties encapsulating a conductive media, bundle and/or cable support-separator and includes a corrugated or rifled inner surface and a smooth outer surface and where the rifled inner surface provides a smaller contact surface area within the outer surface allowing for reduced friction when pulling or inserting conductive media and additional spacing from adjacent cabling thereby reducing cross-talk. This also allows for the use of less insulation material thereby reducing combustibility and wherein the wrap or jacket may also comprise locking features and may be over wrapped with a tape-like layer.

Additionally an objective of the present invention is to provide a corrugated or rifled inner backing surface and a corrugated or rifled outer backing surface to create a double rifled backing and wherein the rifled inner surface and rifled outer surface of the double rifled backing allows for interlocking of the backing lateral ends inner and outer surfaces alternating between peaks and valleys wherein an adhesive may or may not be used between surfaces when overlapped.

Another objective of this invention is to provide a high performance communications cable support-separator when rolled or folded comprises a hollow center where a cross-type support-separator may be inserted to additionally support conductive media.

Another objective of this invention is providing a cable support-separator that is conductive, semi-conductive, or non-conductive, filled and either solid or foamed or foamed with a solid skin layer, metal, conductive or non-conductive polymer media, providing electrical grounding or earthing, or primarily of organic or inorganic polymers or combinations of inorganic and organic polymer blends.

Another objective of this invention includes the development and use of a cable support-separator may be a combination of inorganic fillers or additives with inorganic and/or organic polymers or combinations including inorganic and organic polymer blends, homo and copolymers of ethylene, propylene, or polyvinyl chloride or fluorinated ethylene propylene, fluorinated ethylene, chlorinated ethylene propylene, fluorochloronated ethylene, perfluoroalkoxy, fluorochloronated propylene, a copolymer of tetrafluoroethylene and perfluoromethylvinylether (MFA), a copolymer of ethylene and chlorotrifluoroethelyene (ECTFE), as well as homo and copolymers of ethylene and/or propylene with fluorinated ethylene, polyvinylidene fluoride (PVDF), as well as blends of polyvinyl chloride, polyvinylidene chloride, nylons, polyesters, polyurethanes as well as unsubstituted and substituted fullerenes primarily comprised of $C_{60}$ molecules including nano-composites of clay and other inorganics such as ZnO, $TiO_2$, MgOH, and ATH (ammonium tetrahydrate), calcium molybdates, ammonium octyl molybdate and the like and may also be employed as nano-sized particles including tube shaped particles, wherein any and all combinations may be utilized to provide polymer blends, wherein the cable support-separator comprises conductive media or nanotubes of $C_{60}$ in the form of fibers or substituted/unsubstituted fullerenes or fullerene compounds and like nano-composites or both and the conductive media or nanotubes of $C_{60}$ in the form of fibers or substituted/unsubstituted fullerenes or fullerene compounds and like nano-composites or both are imbedded the cable support-separator.

Additionally an objective includes a cable support-separator comprised of a combination of metal oxides including magnesium trioxides, metal hydrates, including magnesium hydrates, silica or silicon oxides, brominated compounds, phosphated compounds, metal salts including magnesium hydroxides, ammonium octyl molybdate, calcium molybdate, or any and all effective combinations.

Another objective of this invention includes a cable support-separator also comprised of compounds such as acid gas scavengers that scavenge gasses such as hydrogen chloride and hydrogen fluoride or other halogenated gasses occurring during combustion of the cable support-separator, conduit tube or jacketing.

Another objective of this invention is that the cable support-separator may be comprised of organic and/or inorganic polymers that each may include the use of recycled or reground thermoplastics in an amount up to 100%.

Another objective of this invention is that the cable support-separator is comprised of a polymer blend ratio of fluorinated or otherwise halogenated polymers or copolymers to ethylene or vinyl chloride polymers or copolymers of from 0.1% to up to 99.9% of fluorinated or otherwise halogenated polymers or copolymers to ethylene or vinyl chloride polymers or copolymers or foamed polymer blend including a nucleating agent of polytetrafluoroethylene, carbon black, color concentrate, or boron nitride, boron triflouride, direct injection of air or gas into an extruder, chloroflurocarbons (CFCs), or more environmentally acceptable alternatives such as pentane or other acceptable nucleating or blowing agents, Another objective of this invention is that the cable support-separator comprise solid, partially solid, or partially or fully foamed organic or inorganic dielectric materials, wherein the dielectric materials may include a solid skin surface with any one of a number of dielectric materials and wherein the cable support-separator, conduit tube and jacketing may include an adhesive surface.

Another alternative objective of the present invention includes a high performance, multi-media communications cable or cable support-separator with a sealant coated dimensionally and heat-recoverable dual layer of the cable or separator comprising selecting a first polymer composition comprising a cross-linkable polymer; forming a second polymer composition by admixing a thermoplastic component and a rubber-like component in proportions such that a composition comprises 30 to 95% of the thermoplastic component and 5 to 70% of the rubber-like component with the second composition being convertible to a sealant composition.

Additionally an objective of the invention includes potential deformation of the high performance, multi-media communications cable or cable support-separator, comprising extruding a first and second polymer composition to form a unitary dual layer possessing an outer tubular layer formed from the first crosslinkable polymer composition disposed concentrically around an inner tubular layer formed from the second convertible polymer composition and being in a first configuration at a temperature below the crystalline melt temperature of the first composition into the second configuration and exposing the high performance, multi-media communications cable or cable support-separator to a source of energy to initiate formation of chemical bonds between adjacent polymer chains in the first composition, and inducing a chemical change in the second composition, thereby converting the second composition from a melt processable composition to a sealant composition and rendering the first composition recoverable in that the sealant composition is more easily recoverable as a first configuration upon subsequent heating.

Another objective of this invention is that the cable support-separator is capable of providing conductive media that transmit data up to and greater than 10 Gbit/second while substantially mitigating or completely eliminating all forms of crosstalk, including alien crosstalk.

Another objective of the invention is that the non-conductive or conductive substrate of the support-separator or cable such as metallized thermoplastic film, would be at a nominal 50 ohms per square (50 $\Omega/cm^2$) resistance and are attached, laminated, molded, extruded or co-extruded to the backing surface and where the flat backing surface itself may be comprised of imbedded non-conductive or conductive substrate such as metallized thermoplastic film at a nominal 50 ohms per square (50 $\Omega/cm^2$) resistance, where the metallized thermoplastic film may include a drain wire of a preferred AWG or a braided shield in contact with the metallized film.

Another objective of the invention provides for a cable support-separator or conduit tube may be severed by a knife or other sharp tool in order to separate the set of structures from each other to ease in routing, installation and termination of selected conductive media and where the conductive media may also be pulled from the set of structures through a gap for easy separation of conductive media at an end of said cable.

Another objective includes a cable support-separator backing surface provides for unshielded internal EME/RFI (electromagnetic emissions/radio frequency interference) directed to a center of the cable support-separator and provides for a barrier from external EME/RFI, and wherein an optional ground wire in contact with the cable support-separator shielded surface(s) may provide additional EMI/RFI (electromagnetic interference/radio frequency interference) protection, Another objective of the invention includes development and use of a high performance, multi-media communications cable or cable support-separator comprised of polyolefin or other thermoplastic based polymers and blends thereof capable of meeting specific flammability and smoke generation requirements as defined by UL 910, NFPA 255, 259 or 262, and EN 50266-2-x, class B test specifications as well as NFPA 72 test criteria for circuit integrity, wherein said test criteria is met by either a rolled-up version or an initially flat state of the cable support-separator.

Included in the objective of this invention is a method for producing a communications cable support-separator comprising support members attached to a flat backing with each of the support members comprising external and internal radial and axial surfaces with support members extending along a longitudinal length of a communications cable. The support members form a central region when the flat backing of the communications cable support-separator is rolled-up or folded. The cable support-separator extends along a longitudinal length a communications cable where pulling of the cable support-separator from a reel or cobb into a closing die mates the support members with one or more twisted pair or any other conductive or non-conductive media and/or conduit tubes. The media is nested and shielding as necessary such that one or more twisted pair or other media are provided with single or double twist bunching which, may include a binder for holding a twisted bunch with optional shielding, or may include a single or two-step process potentially followed by use of an binder for holding the twisted bunch in place and may be jacketed via extrusion or wrapping or both with a final take up on a final take-up reel, wherein the method provides a rolled-up version of an initially flat, cable support-separator or multi-media cable.

Also included in the objective of this invention is a method for wrapping or jacketing wherein binder wrapping may include one or more of several methods including single tape winding such as a cigarette tape wrap, spiral wrapping such as a notebook binder with a tighter or looser configuration or varying tensions or where the binder may simply comprise extruding a thin skin thermoplastic or a thicker skin thermoplastic or thermoset or the like over the high performance, multi-media communications cable.

An additional objective includes a method where the binder can be a corrosive and/or chemical resistant barrier protecting the cable assembly and conductive or non-conductive media from severe environments.

SUMMARY OF THE INVENTION

This invention provides a lower cost communications cable, conductor support-separator, and in some cases a conduit tube exhibiting improved electrical, flammability, and optionally, optical properties. The cable has an interior support and in some cases a conduit tube extending along the longitudinal length of the communications cable. The interior support has a central region extending along the longitudinal length of the interior support. In the preferred configuration, the cable separator support is initially a flat or ribbon-like design that could be a cable with hollow features that are generally not closed that aid in the insertion of conductive media, such as twisted pairs, WIFI, co-axial cables, blown fiber, fiber optics, data transmission media, drain wire and the like and allow the user easy separation of the conductors, cables, and the like, from the central cable support-separator. Another unique feature in the preferred embodiment is the ability for convert the cross-sectional shape from a flat or ribbon shape to either a preferred concentric or eccentric (non-concentric) shape by rolling the lateral ends around the hollow features or by inversely rolling the hollow features around the flat cable backing.

Additionally the invention includes a geometrically optional concentric or eccentric core support-separator with a plurality of either solid or foamed multi-shaped sections that extend radially outward from the central region along the longitudinal or axial length of a cable's central region. The core support-separator is optionally foamed and has an optional hollow center. These various shaped sections of the core support-separator may be helixed as the core extends along the length of the communications cable. Each of the adjacent shaped sections defines a clearance which extends along the longitudinal length of the multi-shaped core support-separators. The clearance provides a channel for the conductive media used within the cable as well as for the optional conduit tubes that may be initially empty so that conductors can be later placed there within. The clearance channels formed by the various shaped core support-separators extend along the same length of the central portion. The channels are either semi-circular or nearly fully circular toward the center portion of the core and optionally opened or closed surfaces exist at the outer radial portion of the same core. Optionally opened surfaces allow for the user to easily, selectively optionally, remove the captured cables and conductors from the cable support-separator core for ease of placement and termination. Adjacent channels are separated from each other to provide a chamber for at least a pair of conductors or an optical fiber or optical fibers. Conduit channels of various shapes may be used in addition to or in lieu of the adjacent channels The various shaped core support-separators of this invention provides a superior crush resistance to the protrusions of the standard "X" or other similar supports. A superior crush resistance is obtained by the arch-like design for the circular shaped hollow separators. Flat manufacture of the cable support-separator ensures ease of die development and eventual extrusion and application of metallized backing. The flexibility of the configuration of the core also allows for ease of customization by cable manufacturers and accommodation of an overall external shield.

Eccentricity of the hollow spaces in the cable support-separators can be set apart per cable manufacturers specifications so that individual or sets of pairs can be spaced closer or farther from one another, allowing for better power sum values of equal level far end and near end crosstalk. This "offsetting" between conductor pairs in a logical, methodological pattern to optimize electrical properties is an additional benefit associated with the cable support-separators of this invention.

According to one embodiment, the cable includes a plurality of transmission media with metal and/or optical conductors that are individually disposed, and an optional outer jacket maintaining the plurality of data transmission media in proper position with respect to the core. The core is comprised of a support-separator having an open circular-shaped profile that defines a clearance to maintain spacing between transmission media or transmission media pairs in the finished cable. The core may be formed of a conductive or insulative material to further reduce crosstalk, impedance, and attenuation. It may be solid, foamed, foamed with a solid skin, and composed of a blend of non-halogenated as well as halogenated polymers that also include inorganic fillers as described above.

Accordingly, the present invention provides for a communications cable, conductor separator and in some cases a conduit tube, with a multi-shaped support-separator, that meets the exacting specifications of high performance data cables and/or fiber optics or the possibility of including both transmission media in one cable, has a superior resistance to deformation during manufacturing and use, allows for control of near-end cross-talk, controls electrical instability due to shielding, is capable of 200 and 1 Ghz (Categories 6 and 7 and beyond) transmission with a positive attenuation to cross-talk ratio (ACR ratio) of typically 3 to 10 dB.

Additionally, it has been known that the conductor pair may actually have physical or chemical bonds that allow for the pair to remain intimately bound along the length of the cavity in which they lie. U.S. Pat. No 6,639,152, herein incorporated by reference, describes a means by which the conductor pairs are adhered to or forced along the cavity walls by the use of grooves. This again increases the distance, thereby increasing the volume of air or other dielectrically superior medium between conductors in separate cavities. As discussed above, spacing between pairs, spacing away from jackets, and balanced spacing all have an effect on final electrical cable performance.

It is an object of the present invention to provide a data/multi-media cable that has a specially designed interior support that accommodates conductors with a variety of AWG's, impedances, improved crush resistance, controlled near end cross talk (NEXT), controlled electrical instability due to shielding, increased breaking strength, and allows the conductors, such as twisted pairs, to be spaced in a manner to achieve positive ACR ratios using non-conventional composite compound blends that include halogenated and non-halogenated polymers together with optional inorganic and organic additives that include inorganic salts, metallic oxides, silica and silicon oxides as well as any number of substitute and unsubstituted fullerenes in all forms including nanotubes.

It is still another object of the invention to provide a cable that does not require individual shielding and that allows for the precise spacing of conductive media such as twisted pairs and/or fiber optics with relative ease. In the present invention, the cable may include individual glass fibers as well as conventional metal conductors as the transmission medium that would be either together or separated in clearance channel chambers provided by sections of the core support-separator or could be placed either immediately or at a later time into separate conduit tubes.

Another embodiment of the invention includes having a multi-shaped core support-separator with a central region that is either solid or partially solid. Again this support-separator and any conduit tube would be comprised of the special composite compound blends described in detail above. This again includes the use of a foamed core and/or the use of a hollow center of the core, which in both cases significantly reduces the material required along the length of the finished cable. The effect of foaming and/or producing a support-separator with a hollow center portion should result in improved flammability of the overall cable by reducing the amount of material available as fuel for the UL 910 test, improved electrical properties for the individual non-optical conductors, and reduction of weight of the overall cable.

A further embodiment includes the fully opened surface sections defining the core clearance channels which extend along the longitudinal length of the core support-separator as provided in U.S. Pat. No. 6,639,152. This clearance provides half-circular channel walls for each of the conductors/optical fibers or conductor pairs used within the cable. A second version of this embodiment includes a semi-closed or semi-opened surface section defining the same core clearance channel walls. These channel walls would be semi-circular to the point that at least 300 degrees of the potential 360-degree wall enclosure exists. Typically, these channels walls would include an opening of 0.005 inches to 0.011 inches wide. A third version of this embodiment includes either a fully closed channel or an almost fully closed channel of the circular shaped core support-separator such that this version could include the use of a "flap-top" initially providing an opening for insertion of conductors or fibers and thereafter providing a covering for these same conductors or fibers in the same channel. The flap-top closure can be accomplished by a number of manufacturing methods including heat sealing during extrusion of the finished cable product or a compatible adhesive. Other methods include a press-fit design, taping of the full assembly, or even a thin skin extrusion that would cover a portion of the circular shaped separator. All such designs could be substituted either in-lieu of a separate cable jacket or with a cable jacket, depending on the final property requirements. All such designs of the present invention would incorporate the use if the special composite compound blends as previously described.

Yet another embodiment provided in U.S. Pat. No. 6,639,152 that is included in the present invention allows for interior corrugated or rifled clearance channels provided by the multi-shaped sections of the core support-separator. This corrugated internal section has internal axial grooves that allow for separation of conductor pairs from each other or even separation of single conductors from each other as well as separation of optical conductors from conventional metal conductors. Alternatively, the edges of said grooves may allow for separation thus providing a method for uniformly locating or spacing the conductor pairs with respect to the channel walls instead of allowing for random floating of the conductor pairs.

Each groove can accommodate at least one twisted pair. In some instances, it may be beneficial to keep the two conductors in intimate contact with each other by providing grooves that ensure that the pairs are forced to contact a portion of the wall of the clearance channels. The interior support provides needed structural stability during manufacture and use. The grooves also improve NEXT control by allowing for the easy spacing of the twisted pairs. The easy spacing lessens the need for complex and hard to control lay procedures and individual shielding. Other significant advantageous results such as: improved impedance determination because of the ability to precisely place twisted pairs: the ability to meet a positive ACR value from twisted pair to twisted pair with a cable that is no larger than an individual shielded twisted pair (ISTP) cable; and an interior support which allows for a variety of twisted pair and optical fiber dimensions.

Alternatively, depending on manufacturing capabilities, the use of a tape or polymeric binding sheet may be necessary in lieu of extruded thermoplastic jacketing. Taping or other means may provide special properties of the cable construction such as reduced halogen content or cost of such a construction.

Yet another related embodiment includes the use of a strength member together with, but outside of the core support-separator running parallel in the longitudinal direction along the length of the communications cable. In a related embodiment, the strength member could be the core support-separator itself, or in an additional related embodiment, the strength member could be inserted in the hollow center-portion of the core.

According to another embodiment of the invention an earthing wire or optionally a conductive polymer may be inserted on the outer surface of the cable support-separator to ensure proper and sufficient electrical grounding preventing electrical drift.

It is possible to leave the separator cavities empty in that the separator itself or within a jacket would be pulled into place and left for future "blown fiber" or other conductors along the length using compressed air or similar techniques such as use of a pulling tape or the like It is to be understood that each of the embodiments above could include a flame-retarded, smoke suppressant version, and that each could include the use of recycled or reground thermoplastics in an amount up to 100%.

A method of producing the communications cable, introducing any of the multi-shaped core separators as described above, into the cable assembly, is described as first passing a plurality of transmission media and a core through a first die which aligns the plurality of transmission media with surface features of the core and prevents or intentionally allows twisting motion of the core. Sequentially, the method bunches the aligned plurality of transmission media and core using a second die which forces each of the plurality of the transmission media into contact with the surface features of the core, which maintain a spatial relationship between each of a plurality of transmission media. Finally, the bunched plurality of transmission media and core are optionally twisted to allow for enclosure of the bundled transmission media, and the enclosure may then be optionally jacketed.

Another embodiment of this invention is the variable diameter hollow tube that may be inserted along the outside surface of any of the cable support-separators in order to induce variable spacing of the cable support-separator from adjacent cabling. This random variation is useful in reducing alien cross talk between conductive elements. The variable diameter tube may optionally be solid and comprised of metallic, conductive or non-conductive polymer, imbedded with nano tubes or fullerenes.

Yet another embodiment of this invention is to provide a wrap, tape or jacketing material to enclose the multimedia conductors within a cable described earlier wherein the jacketing incorporates one or more corrugated surfaces useful in material reduction for flammability purposes and for spacing from adjacent cabling to reduce NEXT. This two-sided embodiment of the present invention may additionally incorporate locking or binding features when the sections are overlapped upon each other as shown in FIGS. 13A and 13B.

Other desired embodiments, results, and novel features of the present invention will become more apparent from the following drawings and detailed description and the accompanying claims.

DETAILED DESCRIPTION OF THE DRAWINGS

The following description will further help to explain the inventive features of the cable and the interior support portion of the cable.

Figure 1:
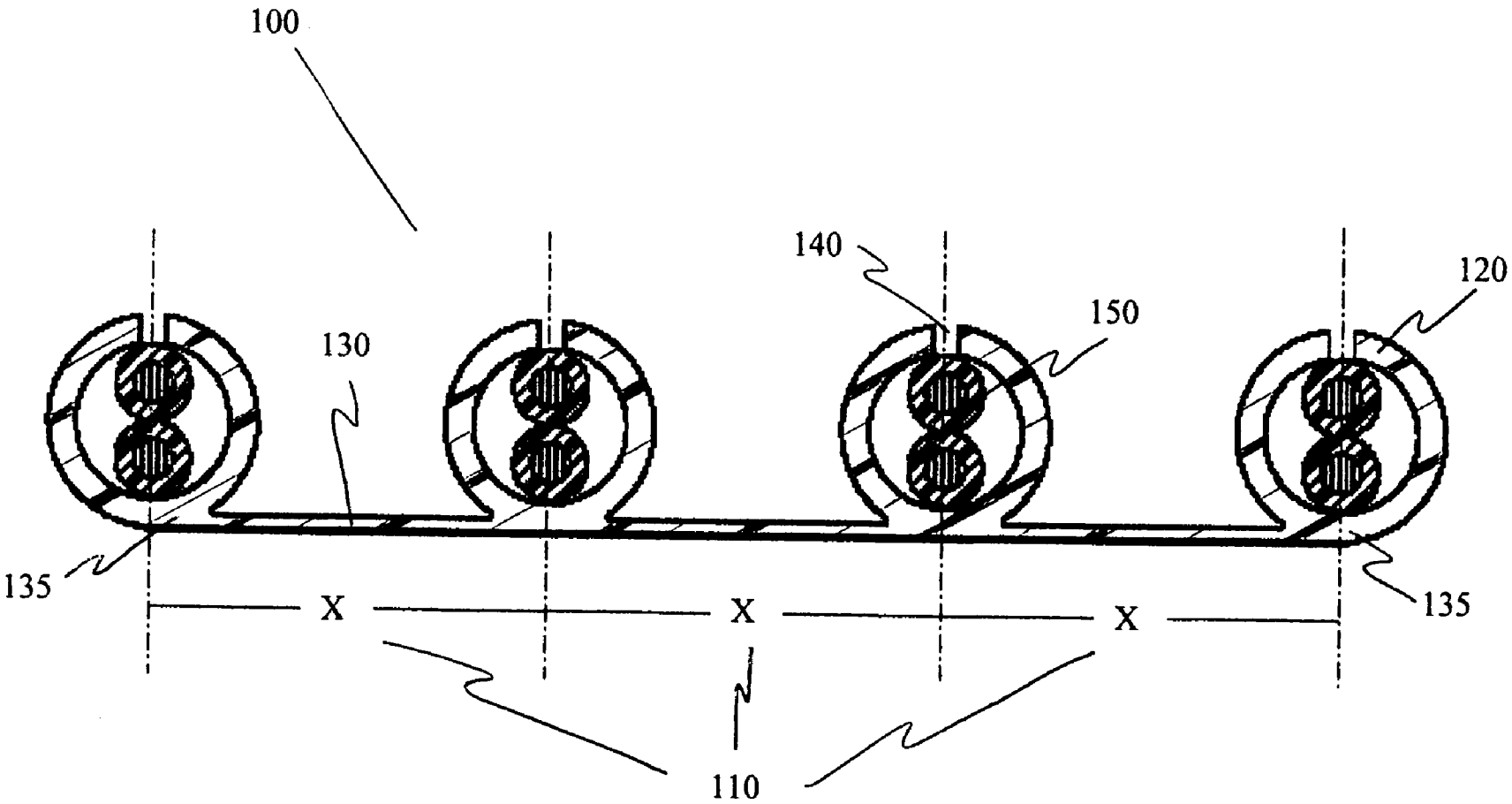
FIG. 1 is a cross-section view of a flat or ribbon cable including support-separators exhibiting essentially equally spaced hollow circular structural features with gaps optionally moulded or extruded integrally together with an essentially flat backing surface or substrate.

FIG. 1 is a cross-section view of an essentially flexible flat or ribbon cable support-separator [100] exhibiting essentially equally spaced [110] hollow structures [120], optionally extruded or moulded integrally to an essentially flat backing surface [130] extending to the lateral end [135] of the hollow structures [120], that individually have a gap [140] allowing optionally for insertion, containment and separation of non-conductive or conductive media [150] comprising twisted pair conductors, co-axial, WIFI antennae, power, and/or fiber optic conductors (in advance, during or after installation), or they may be left optionally empty and can be constructed of conductive, semi-conductive, or non-conductive material. The hollow structures [120] may optionally individually be constructed of various diameters to contain and support varying diameter conductive media [150]. For illustration purposes only, conductive media [150] is generally shown to be twisted pair of primarily copper conductors.

Figure 2A:
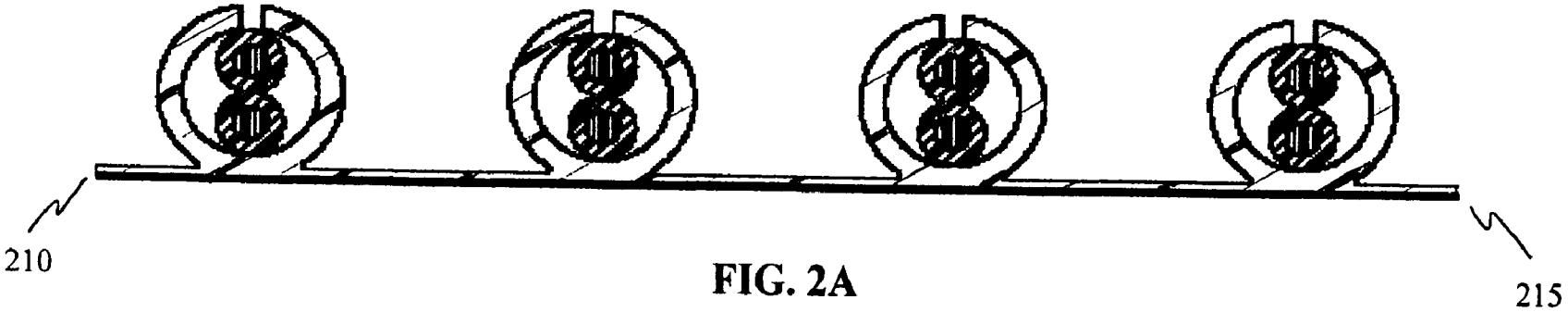
FIG. 2A is a cross-section view of a flat or ribbon cable including support-separators exhibiting essentially hollow circular structural features, optionally moulded or extruded integrally together with an essentially flat backing surface or substrate, the surface of which extends beyond the end of the hollow structures.

FIG. 2A is a cross-section view of an alternative essentially flexible flat or ribbon cable support-separator [100] exhibiting essentially hollow structures [120], optionally extruded or moulded integrally to an essentially flat backing surface [130] to the extended end [210, 215] of the hollow structures [120], that has a gap [140] allowing for optional insertion, containment and separation of non-conductive or conductive media [150] comprising twisted pair conductors, co-axial, WIFI antennae, power, and/or fiber optic conductors (in advance, during or after installation), or they may be left optionally empty and can be constructed of conductive, semi-conductive, or non-conductive material.

Figure 2B:
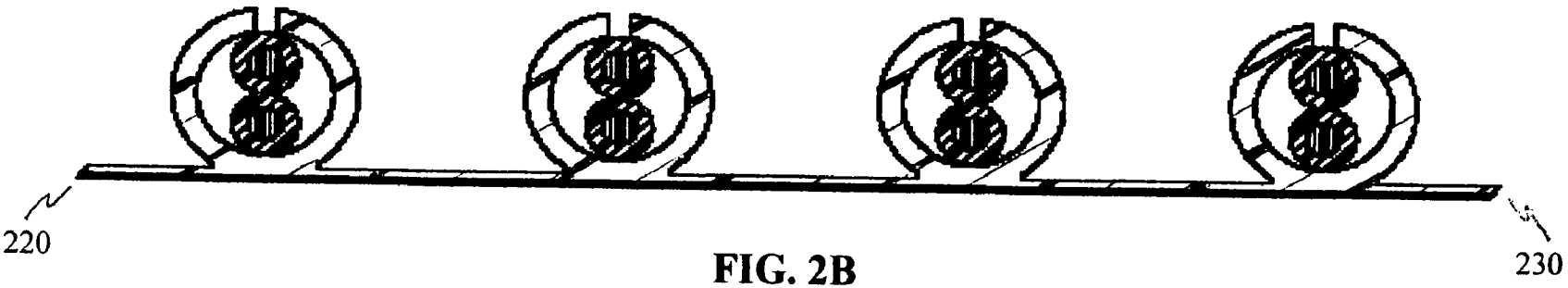
FIG. 2B is a cross-section view of an essentially flat or ribbon cable including support-separators with an overlap feature moulded or extruded into the ends of the flat backing surface or substrate.

FIG. 2B is a cross-section view of an essentially flexible flat or ribbon cable support-separator [100] with an overlap downwardly positioned feature [220] extruded or moulded into one extended end [210] and an overlap upwardly positioned feature [230] extruded or moulded into the opposite extended end [215] of the essentially flat backing surface or substrate [130].

Figure 2C:
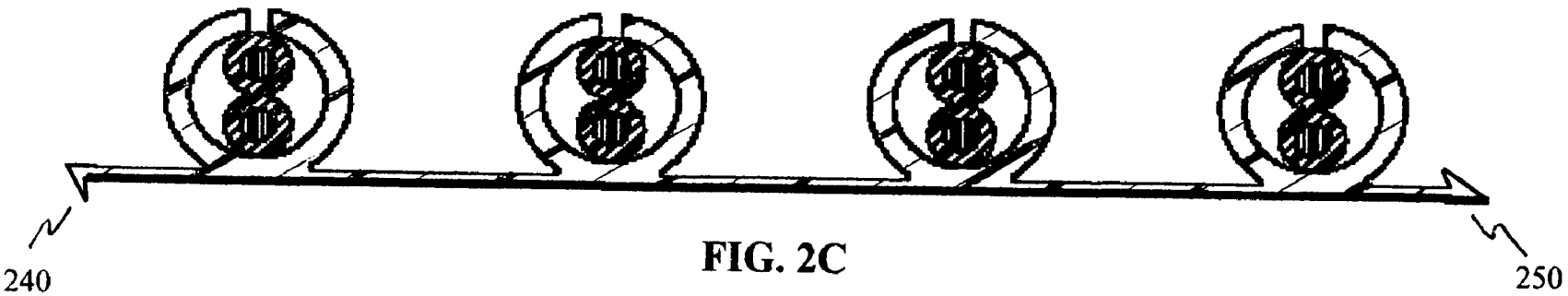
FIG. 2C is a cross-section view of an essentially flat or ribbon cable with a locking feature moulded or extruded into the ends of the flat backing surface or substrate.

FIG. 2C is a cross-section view of an essentially flexible flat or ribbon cable support-separator [100] with a downwardly positioned locking feature [240] extruded or moulded into one extended end [210] and an upwardly positioned locking feature [250] extruded or moulded into the opposite extended end [215] of the flat backing surface or substrate [130].

Figure 3:
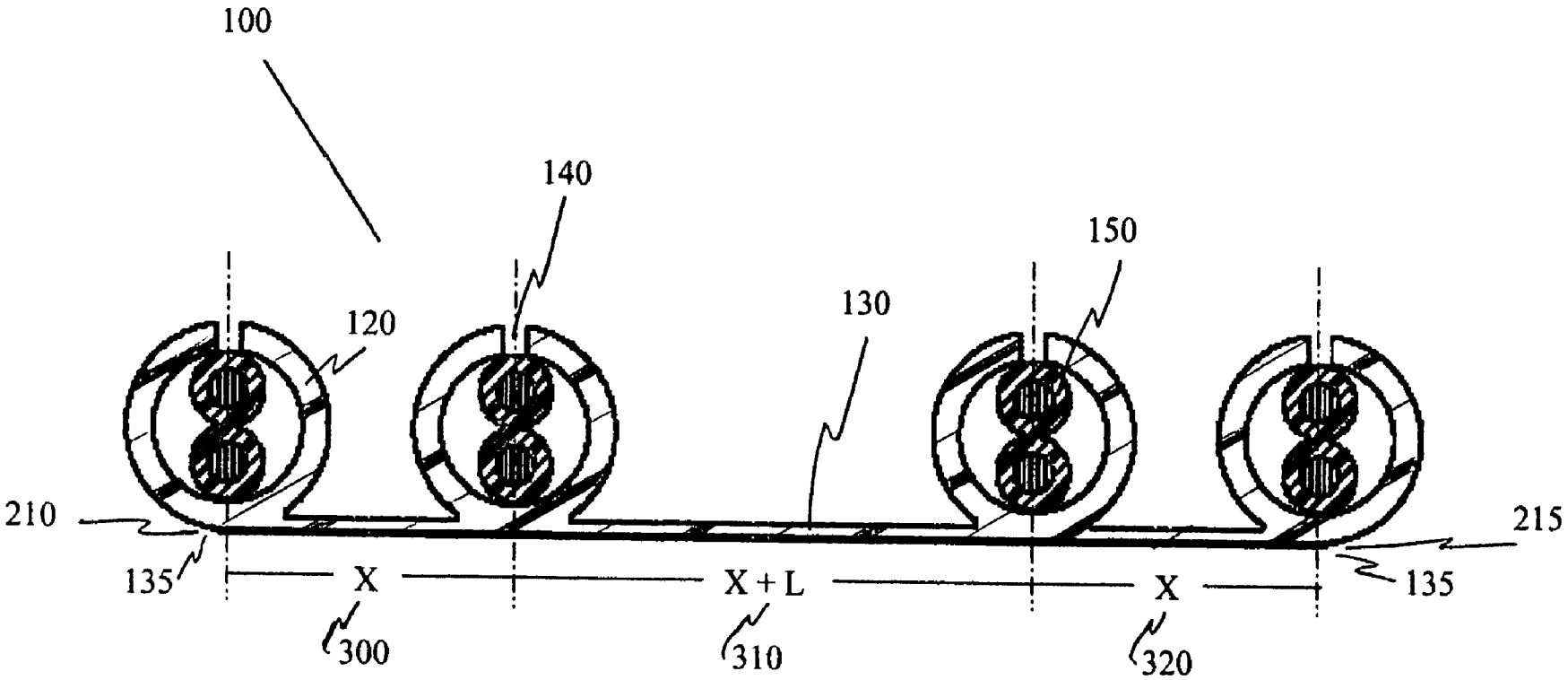
FIG. 3 is a cross section view of an essentially flat or ribbon cable exhibiting unequally spaced hollow structural features along the flat backing or substrate as described in FIG. 1.

FIG. 3 is a cross section view of an alternative essentially flexible flat or ribbon cable support-separator [100] exhibiting essentially unequally spaced [300, 310, 320] hollow structures [120], optionally extruded or moulded integrally to an essentially flat backing surface [130] extending to the lateral end [135] or beyond [210, 215] the hollow structures [120], that individually have a gap [140] allowing optionally for insertion, containment and separation of non-conductive or conductive media [150] comprising twisted pair conductors, co-axial, WIFI antennae, power, and/or fiber optic conductors (in advance, during or after installation). The hollow structures [120] may optionally individually be constructed of various diameters to contain and support varying diameter conductive media [150]. The hollow structures [120] may also be of any shape or form that is useful in providing both conductivity as well as smoke and flame integrity.

Figure 4:
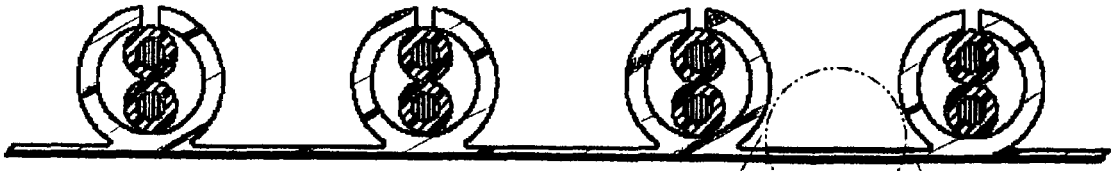
FIG. 4 is a cross section representation of FIGS. 1, 2A, 2B, 2C and 3 with a magnified callout to better detail optional construction and materials for the flat backing or substrate as described in FIG. 1.

FIG. 4 is a cross section of the embodiment of FIGS. 1, 2A, 2B, 2C and 3 with a magnified callout to better detail optional construction methods shown in FIGS. 4A, 4B, 4C, and 4D of the cable support-separator.

Figure 4A:
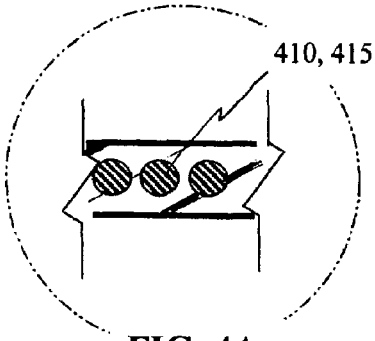
FIG. 4A is a cross section of FIGS. 1, 2A, 2B, 2C and 3 with optional conductive media or nanotubes imbedded longitudinally in the essentially flat or ribbon cable backing or substrate.

FIG. 4A is optionally a cross section of an essentially flexible flat or ribbon cable support-separator [100] representing FIGS. 1, 2A, 2B, 2C and 3 with optional conductive media [410] or nanotubes of $C_{60}$ and like nano-composites [415] or both imbedded longitudinally in the essentially flat backing surface or substrate [130].

Figure 4C:
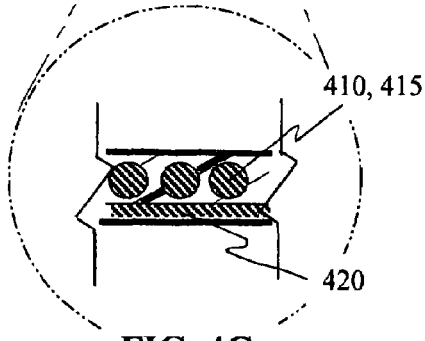
FIG. 4C is a cross section of FIGS. 1, 2A, 2B, 2C and 3 with optional wires imbedded longitudinally and with an optional metallized thermoplastic film (such as Mylar®) attached or molded or extruded within the essentially flat or ribbon cable backing or substrate.
Figure 4B:
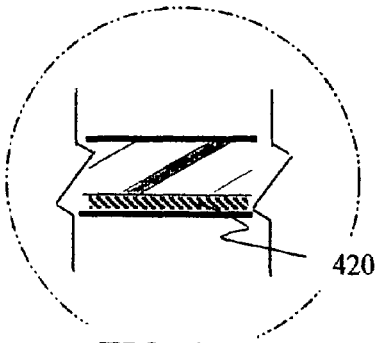
FIG. 4B is a cross section of FIGS. 1, 2A, 2B, 2C and 3 with an optional metallized thermoplastic Mylar® film attached to the essentially flat or ribbon cable backing or substrate.

FIG. 4B is optionally a cross section of an essentially flexible flat or ribbon cable support-separator [100] representing FIGS. 1, 2A, 2B, 2C and 3 with an optional non-conductive or conductive substrate such as metallized thermoplastic Mylar® film [420] at a nominal 50 ohms per square (50 $\Omega/cm^2$) resistance attached, laminated, moulded, extruded or co-extruded to the essentially flat backing surface or substrate [130].

FIG. 4C is optionally a cross section of an essentially flexible flat or ribbon cable support-separator [100] representing FIGS. 1, 2A, 2B, 2C and 3 comprising an integrated structure [430] with optional conductive media [410] imbedded longitudinally and with an optional metallized thermoplastic Mylar® film [420] attached or moulded or extruded to the essentially flat backing surface or substrate [130]. Optionally, as depicted in FIG. 5A, a drain wire [525], of a preferred AWG, or a braided shield in lieu of the imbedded conductive media [410] may be placed in contact with the Mylar® film [420].

Figure 4D:
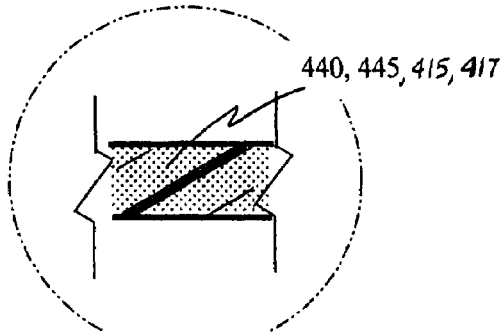
FIG. 4D is a cross section of FIGS. 1, 2A, 2B, 2C and 3 with optional metallic or conductive polymer, $C_{60}$ in the form of fibers, nanotubes, substituted fullerenes or braided cable shielding imbedded in the cable support-separator backing surface or substrate.

FIG. 4D is optionally a cross section of an essentially flexible flat or ribbon cable support-separator [100] representing FIGS. 1, 2A, 2B, 2C and 3 with imbedded metallic or conductive polymers [440], nanotubes of $C_{60}$ and like nano-composites [415], $C_{60}$ in the form of fibers [417] or substituted/unsubstituted fullerenes or fullerene compounds [445].

Figure 5A:
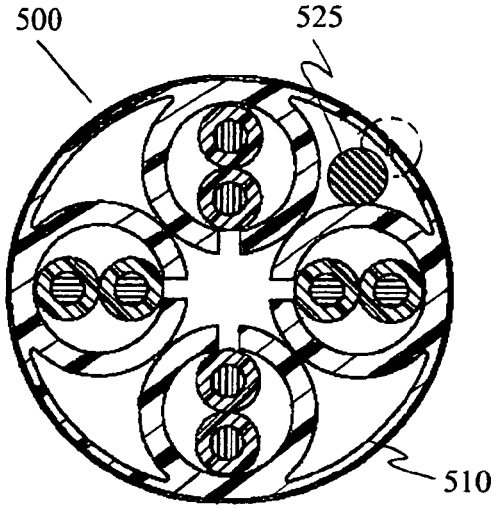
FIG. 5A is a cross-section view wherein the essentially flat or ribbon cable, as exhibited in FIGS. 1, 2A, 2B, 2C, 3, and optionally constructed as shown in FIGS. 4A, 4B, 4C and 4D may optionally be rolled from the lateral edges in order to enclose the essentially hollow structures with the essentially flat backing surface or substrate forming an outer shell in order to form a concentric cable support-separator within the curved backing surface.
Figure 5D:
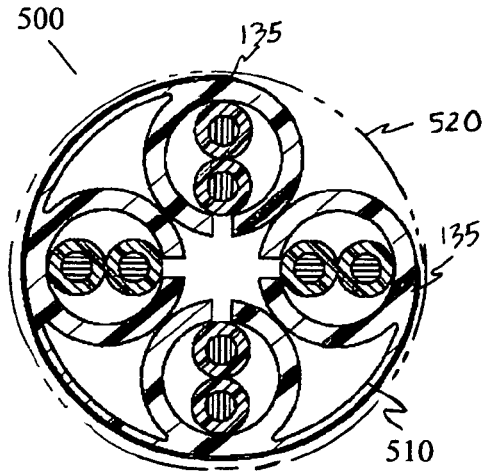
FIG. 5D is a rolled cross section of FIG. 1 that is purposely unjoined at the lateral ends.
Figure 5B:
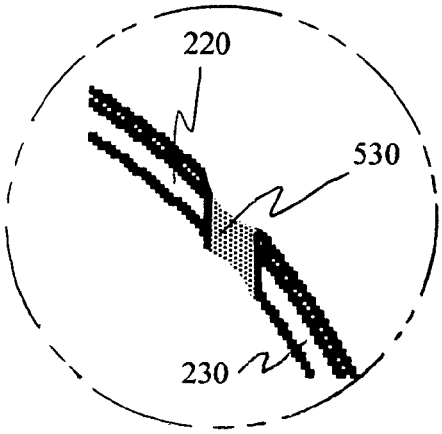
FIG. 5B is an enlarged cross section of FIG. 5A exhibiting the overlap feature shown in FIG. 2B.
Figure 5C:
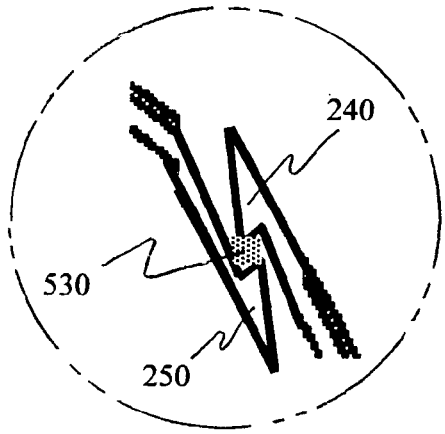
FIG. 5C is an enlarged cross section of FIG. 5A exhibiting a locking feature shown in FIG. 2C.

FIG. 5A is a cross-section view wherein the essentially flexible flat or ribbon cable support-separator [100], comprised of FIGS. 1, 2A, 2B, 2C, 3, and constructed optionally as shown in FIGS. 4A, 4B, 4C and 4D, may optionally be rolled beginning at either or both of the lateral ends [135], or extended ends [210, 215, 220, 230, 240, 250] to encircle the essentially hollow structures [120] with the essentially flat backing surface or substrate [130] on the outside to form a concentric cable support-separator [500] within an essentially curved backing surface [510]and may be joined at the lateral ends [210, 215, 220, 230, 240, 250] as described in FIGS. 5B and 5C. An optional ground wire [525] may be added to provide continuity. This arrangement may optionally be covered within an outer insulated layer or jacket [520].

FIG. 5B is an enlarged cross section of FIG. 5A exhibiting the overlap feature [220, 230] described in FIG. 2B. This arrangement may optionally use adhesive [530] or be covered within an outer insulated layer or jacket [520].

FIG. 5C is an enlarged cross section of FIG. 5A exhibiting the use of a locking feature [240,250] as described in FIG. 2C. This arrangement may optionally use adhesive [530] or be covered within an outer insulated layer or jacket [520].

FIG. 5D is a rolled cross section of FIG. 1 wherein the concentric cable support-separator [500] is within an essentially curved backing surface [510]. The concentric cable support-separator [500] may optionally be enjoined at the lateral ends [135]. This arrangement may also optionally be covered within an outer insulated layer or jacket [520].

Figure 6A:
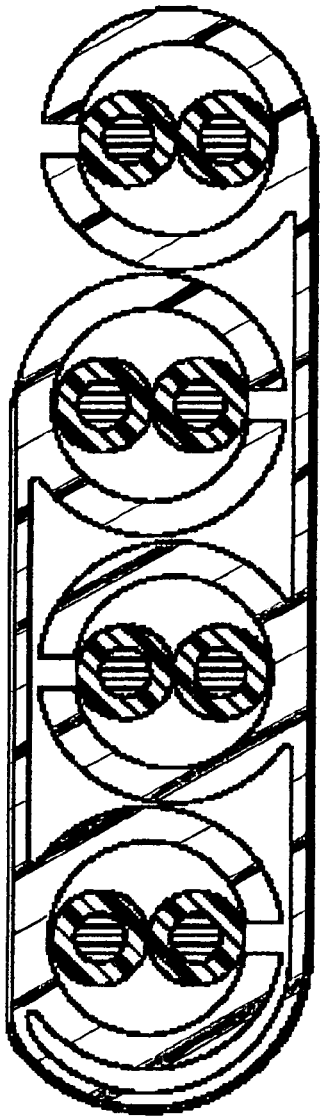
FIG. 6A is a cross-section view wherein optionally the essentially flat or ribbon cable, as exhibited in FIG. 1 may optionally be rolled from the lateral ends to enclose the hollow structures to form an eccentric cable support-separator.

FIG. 6A is a cross-section view wherein optionally the essentially flexible flat or ribbon cable support-separator [100], as exhibited in FIG. 1 may optionally be constructed with varying distances [300, 310, 320] between the hollow structures [120] wherein the essentially flat backing surface or substrate [130] may optionally be rolled from the lateral ends [135], or extended ends [210, 215] to enclose the hollow structures [120] with the flat backing surface [130] to form an eccentric cable support-separator [600] within a combined flat backing surface [130] and a curved backing surface [510]. The hollow structures [120] may optionally individually be constructed of various diameters and distances apart as described in FIG. 3 which may aid in customizing the cable eccentricity. This arrangement may be constructed optionally using an overlap feature [220, 230], locking feature [240,250] or of any construction as described in FIGS. 4A, 4B, 4C or 4D or optionally be covered within an outer insulated layer or jacket [520].

Figure 6B:
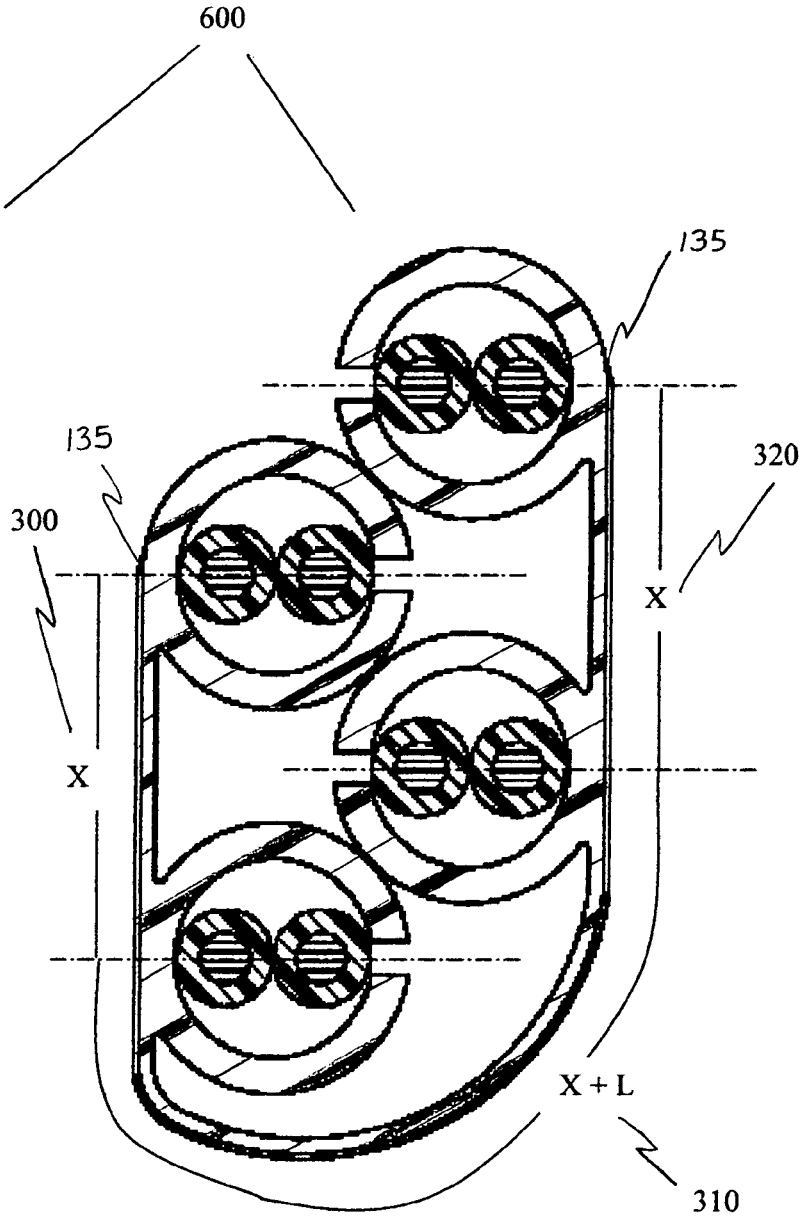
FIG. 6B is a cross-section view wherein optionally the essentially flat or ribbon cable, as exhibited in FIG. 1 may optionally be constructed with varying distances between the hollow structures and may optionally be rolled from a lateral ends to enclose the hollow structures.

FIG. 6B is a cross-section view wherein optionally the essentially flexible flat or ribbon cable support-separator [100], as exhibited in FIG. 1 may optionally be constructed with varying distances [300, 310, 320] between the hollow structures [120] wherein the essentially flat backing surface or substrate [130] may optionally be rolled from either or both of the lateral ends [135], or extended ends [210, 215] to enclose the hollow structures [120] with the flat backing surface [130] to form an eccentric cable support-separator [600] within a combined flat backing surface [130] and a curved backing surface [510]. This drawing exhibits the configuration wherein the distances [300, 310, 320] between the hollow structures [120] is smaller than the outside diameter of the hollow structures [120]. This arrangement may be optionally constructed using an overlap feature [220, 230], locking feature [240,250] or of any construction optionally as described in FIGS. 4A, 4B, 4C or 4D or optionally be covered within an outer insulated layer or jacket [520].

Figure 7:
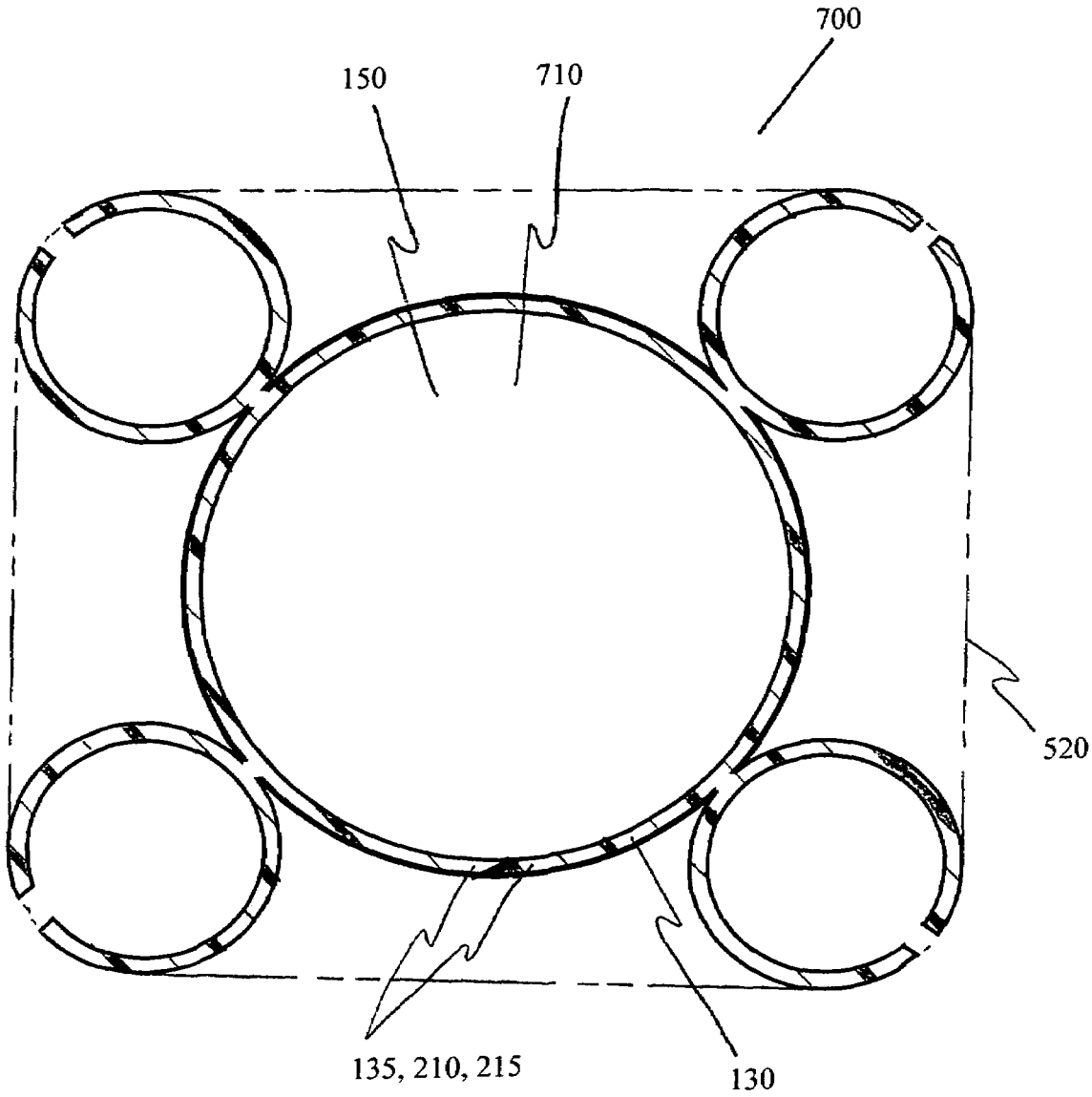
FIG. 7 is a cross-section view wherein the essentially flat or ribbon cable, as exhibited in FIGS. 1, 2A, 2B, 2C, 3, and optionally constructed as shown in FIGS. 4A, 4B, 4C and 4D may optionally be rolled inversely from the lateral ends to enclose the essentially flat backing inside the hollow structures to form a concentric cable support-separator.

FIG. 7A is a cross-section view wherein the essentially flexible flat or ribbon cable support-separator as exhibited in FIGS. 1, 2A, 2B, 2C, 3, and constructed optionally as shown in FIGS. 4A, 4B, 4C and 4D may optionally be rolled inversely from the lateral ends [135], or extended ends [210, 215] as described in FIG. 5A and 5C, to encircle the essentially flat backing surface or substrate [130] inside the hollow structures [120] to form an inversely concentric cable support-separator [700]. This arrangement may be optionally constructed using an overlap feature as described in FIG. 5B, locking feature as described in FIG. 5C or constructed of any materials as described in FIGS. 4A, 4B, 4C or 4D or optionally be covered within an outer insulated layer or jacket [520]. The hollow central portion [710] formed by the inversely concentric cable support-separator [700] may optionally be filled with air blown fiber (ABF) which is comprised of solid, semi-solid, foamed or hollow polymeric smooth internal and external surfaces or with a non-conductive element or conductive media [150] or allowing optionally for insertion, containment and separation of non-conductive or conductive media [150] comprising twisted pair, co-axial, WIFI antennae, power, and/or fiber optic conductors (in advance, during or after installation).

Figure 8A:
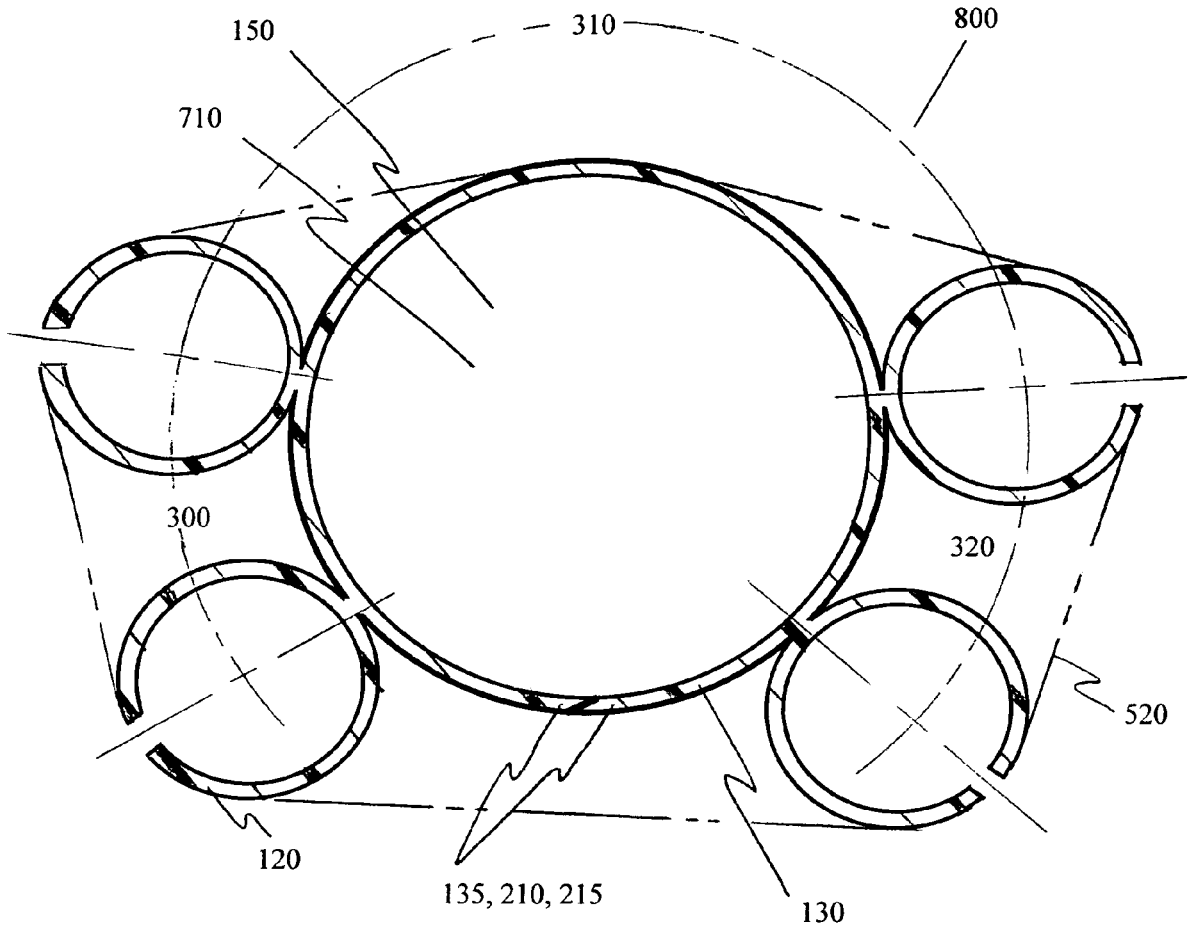
FIG. 8A is a cross-section view wherein optionally the essentially flat or ribbon cable, as exhibited in FIG. 1 may optionally comprise varying distances between the hollow structures wherein the essentially flat or ribbon cable may optionally be rolled inversely from the lateral ends to enclose the essentially flat backing inside the hollow structures to form an eccentric cable support-separator.

FIG. 8A is a cross-section view wherein optionally the essentially flexible flat or ribbon cable support-separator [100] as exhibited in FIG. 1 that may optionally be constructed with unequally spaced [300, 310, 320], hollow structures [120] as shown in FIG. 3, wherein the essentially flat backing surface [130] may optionally be laid essentially flat inversely from the lateral ends [135], or extended ends [210, 215] to enclose the essentially flat backing surface or substrate [130] inwardly from the hollow structures [120] to form an inversely eccentric cable support-separator [800] which may optionally be covered with an outer insulated layer or jacket [520]. The hollow central portion [710] formed by this configuration may optionally be filled with non-conductive or conductive media [150] comprising twisted pair, co-axial, WIFI antennae, power, and/or fiber optic conductors (in advance, during or after installation).

Figure 8B:
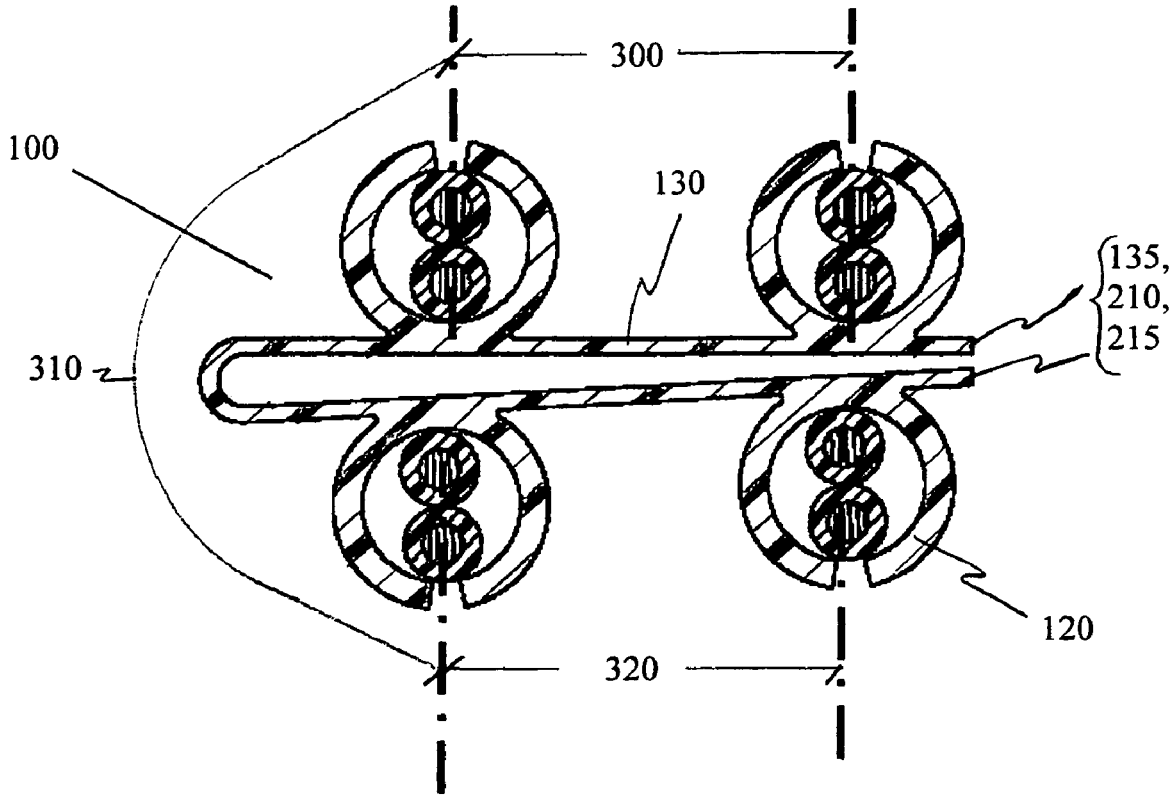
FIG. 8B is a cross-section view wherein optionally the essentially flexible flat or ribbon cable support-separator as exhibited in FIG. 1 that may optionally comprise unequally spaced hollow structures wherein the essentially flat backing surface may optionally be laid essentially flat inversely from the ends.

FIG. 8B is a cross-section view wherein optionally the essentially flexible flat or ribbon cable support-separator [100], as exhibited in FIG. 1 may optionally be constructed with unequally spaced [300, 310, 320], as shown in FIG. 3, hollow structures [120] wherein the essentially flat backing surface [130] may optionally be laid essentially flat inversely from the lateral ends [135], or extended ends [210, 215].

Figure 8C:
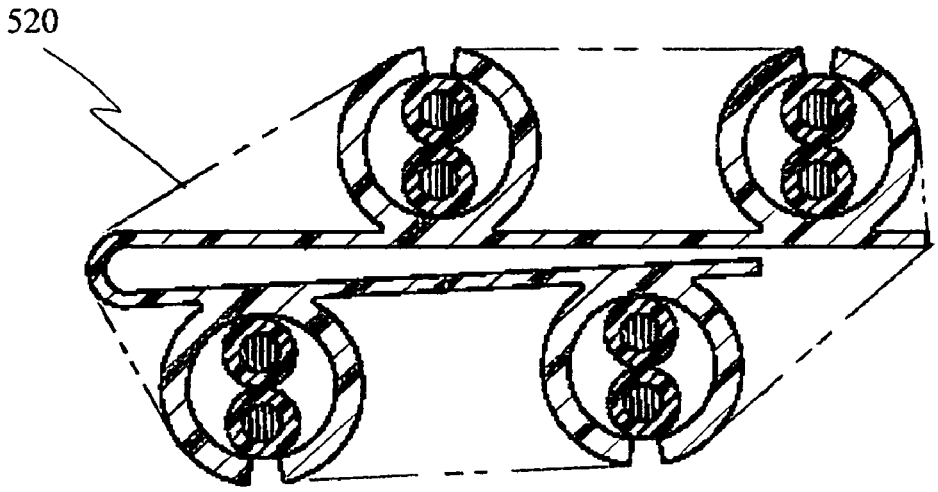
FIG. 8C is a configuration of FIG. 8B which is optionally covered within an outer insulated layer or jacket.

FIG. 8C is an optional figure of FIG. 8B which is optionally covered within an outer insulated layer or jacket [520].

Figure 9A:
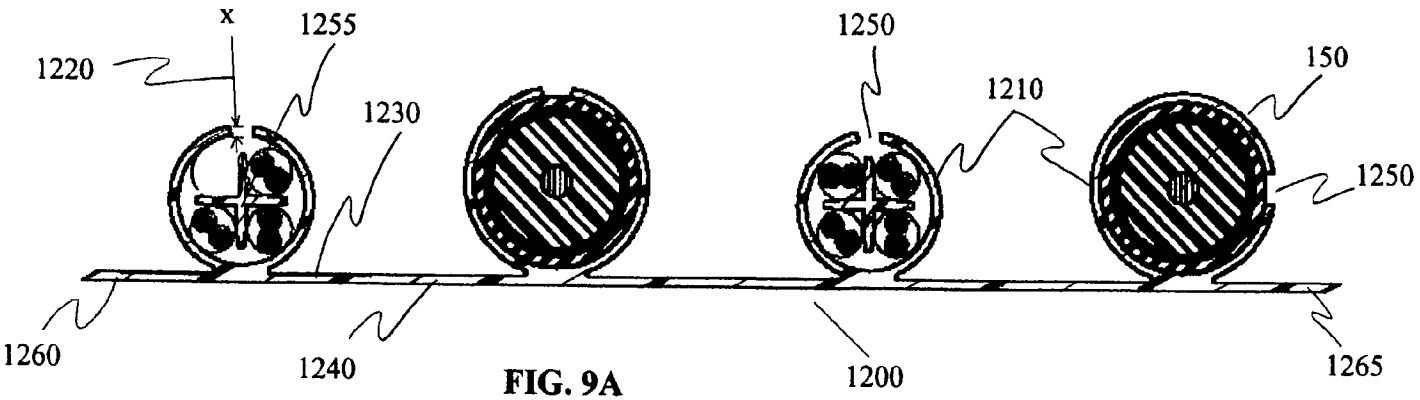
FIG. 9A is a cross-section view of a flat or ribbon cable exhibiting essentially equally spaced, diametrically different, hollow structures with an essentially flat backing surface extending to the end of the hollow structures that may have a gap in varying locations allowing optionally for insertion of conductive media.

FIG. 9A is a cross-section view of a flat or ribbon cable [1200] exhibiting essentially equally spaced, with varying diameters, hollow structures [1210], of nominal material thickness [1220] optionally moulded integrally to the front [1230] of an essentially flat backing surface [1240] with ends [1260, 1265] extending optionally beyond the hollow structures [1210]. The hollow structures [1210] may have a single gap [1250] at varying degrees allowing optionally for insertion of conductive media [150] comprising twisted pair jacketed or un-jacketed, RG-6, Category 6 or 7, optical fiber co-axial, WIFI antennae, power, and/or fiber optic conductors (in advance, during or after installation) or combined with additional cross or X-type cable support-separators [1255]. This arrangement may be optionally constructed using an overlap feature [220, 230] described in FIG. 5B, locking feature [240, 250] as described in FIG. 5C or of any material construction as described in FIGS. 4A, 4B, 4C or 4D.

Figure 9B:
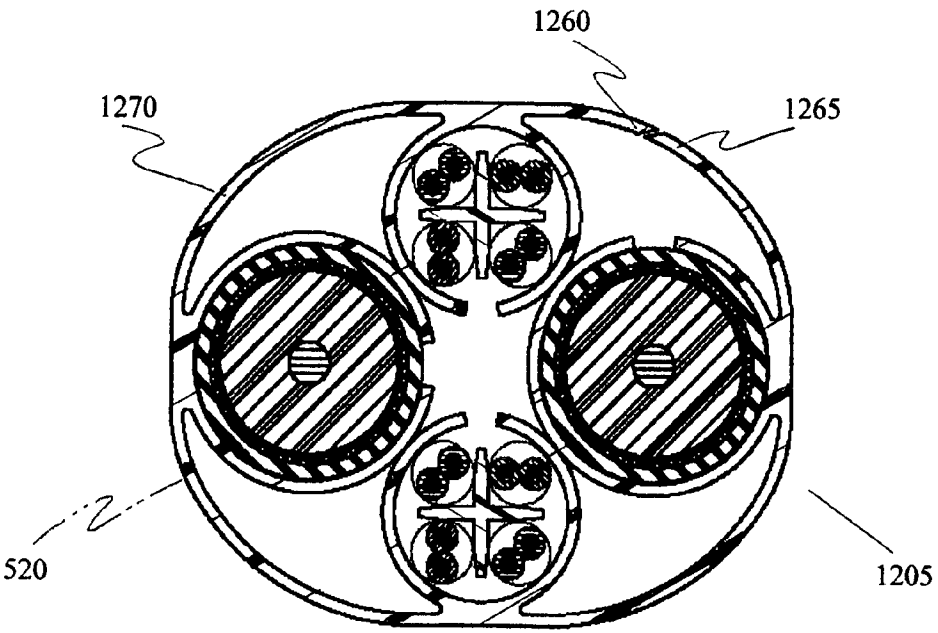
FIG. 9B is a cross-section view wherein the essentially flat or ribbon cable, as exhibited in FIG. 9A may optionally be rolled from the lateral edges to enclose the essentially hollow structures with the essentially flat backing surface on the outside to form a cable support-separator within a curved backing surface.

FIG. 9B is a cross-section view of a cable support-separator [1205] wherein the essentially flat or ribbon cable [1200], as exhibited in FIG. 9A may optionally be rolled from the lateral edges [1260, 1265] to enclose the essentially hollow structures [1210] with the essentially flat backing surface [1240] to form a cable support-separator [1205] within a curved backing surface [1270]. This arrangement may optionally be unjoined as in FIG. 5D or closed using configurations described in FIGS. 5A, 5B and SC or may optionally be covered within an outer insulated layer or jacket [520].

Figure 9C:
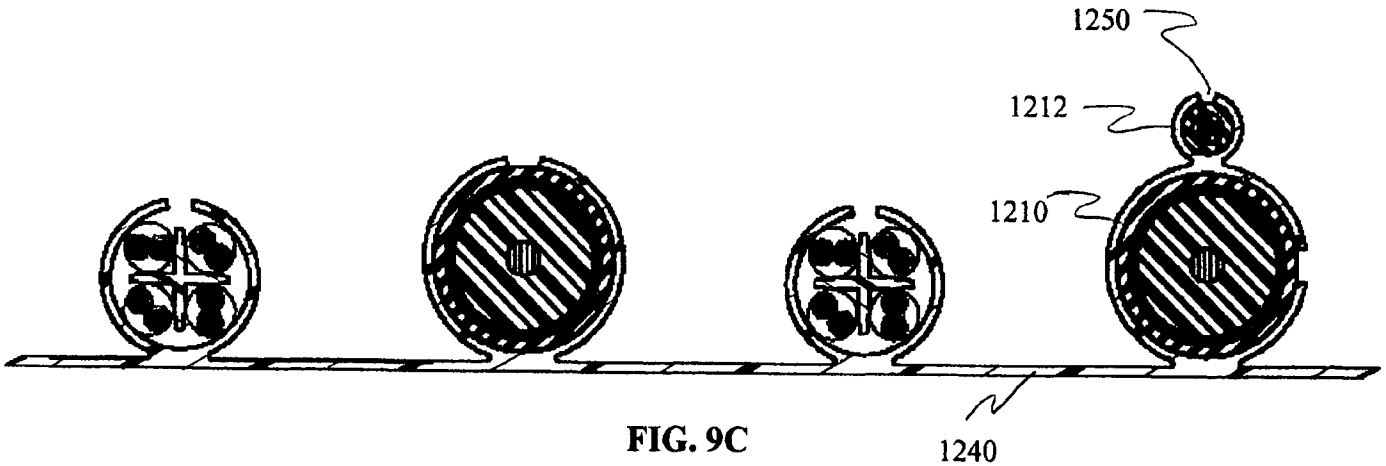
FIG. 9C is a cross-section variation of FIG. 9A wherein an additional hollow structure feature is optionally moulded or extruded integrally with an existing hollow structure.

FIG. 9C is a cross-section variation of FIG. 9A wherein a hollow structure bud [1212] comprising a gap [1250] is moulded externally integrally to the outer surface of a hollow structure [1210] at a preferential right angle from the essentially flat backing surface [1240]. This additional hollow structure bud [1212] may be inserted with twisted pair, co-axial, WIFI antennae, power, and/or fiber optic conductors (in advance, during, or after installation).

Figure 9D:
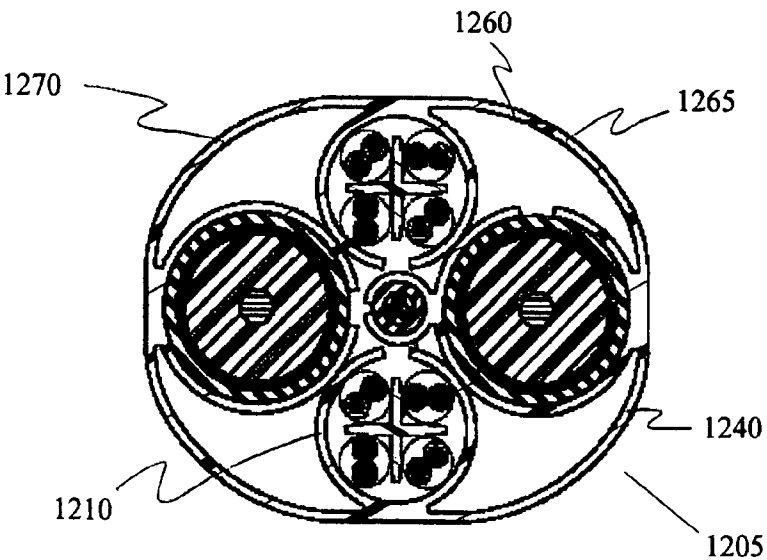
FIG. 9D is a cross-section variation of FIG. 9B wherein an additional hollow structure feature is optionally moulded or extruded integrally to a hollow structure and optionally rolled from the lateral ends to enclose the essentially hollow structures.

FIG. 9D is a cross-section variation of FIG. 9C wherein the hollow structures [1210] are rolled from the lateral edges [1260, 1265] to encircle the hollow structures [1210] with the essentially flat backing surface [1240] on the outside to form a cable support-separator [1205] within a curved backing surface [1270].

Figure 9E:
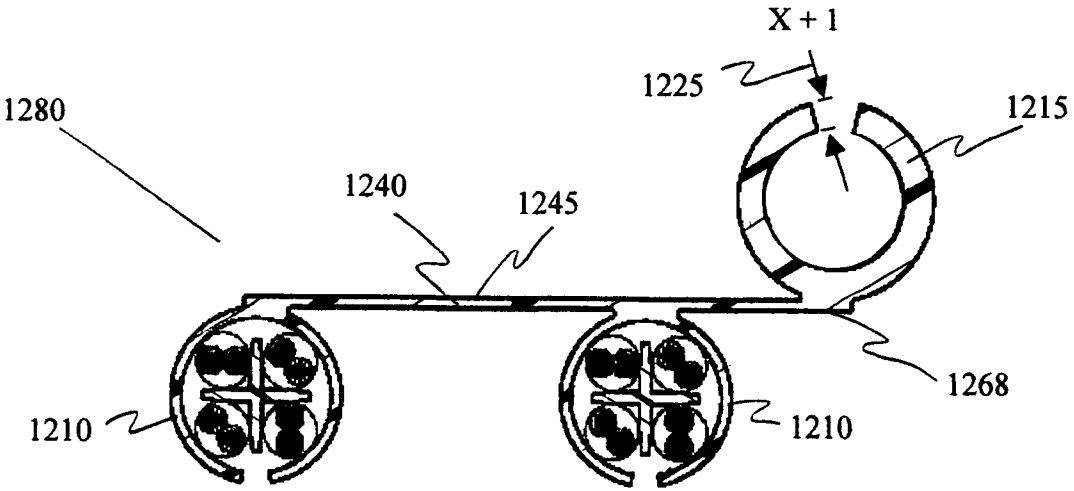
FIG. 9E is a cross-section variation of FIG. 9A wherein additional material is added to an essentially hollow structure extruded to the back of the flat surface to increase thickness.

FIG. 9E is a cross-section of a cable support-separator [1280] wherein additional material thickness [1225] is added to an essentially hollow structure [1210] to create a thicker hollow structure [1215] extruded or molded to the back [1245] of the essentially flat backing surface [1240]. This hollow structure [1215] is to ensure axial alignment of the other hollow structures [1210] when rolled, as described in FIG. 9F, and may be used for insertion of twisted pair, co-axial, WIFI antennae, power, and/or fiber optic conductors (in advance, during or after installation).

Figure 9F:
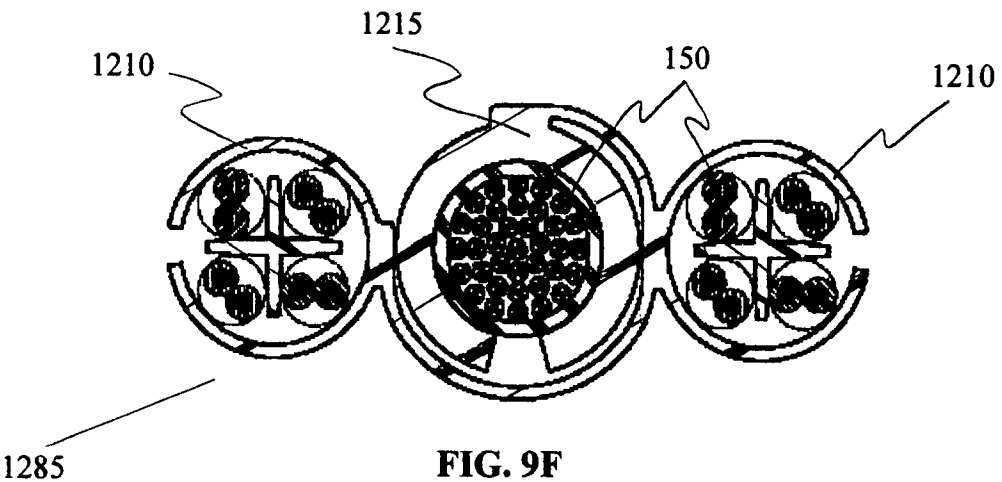
FIG. 9F is a cross-section variation of FIG. 9E wherein the cable support-separator is optionally rolled from the lateral ends to create an essentially flat cable support-separator.

FIG. 9F is a cross-section variation of FIG. 9E wherein the cable support-separator [1280] is rolled from the lateral ends [1268] to create an essentially flat cable support-separator [1285] with the thicker hollow structure [1215] between the nominal material thickness hollow structures [1210]. The thicker hollow structure [1215] may act as a strength member or optionally as a drain wire depending on the material used and described in FIGS. 4A, 4B, 4C, or 4D. The hollow structures [1210] or thicker hollow structure [1215] may optionally be used for insertion of twisted pair, co-axial, WIFI antennae, power, and/or fiber optic conductors or other conductive media [150] with or without internal cable support-separators or left optionally hollow.

Figure 9G:
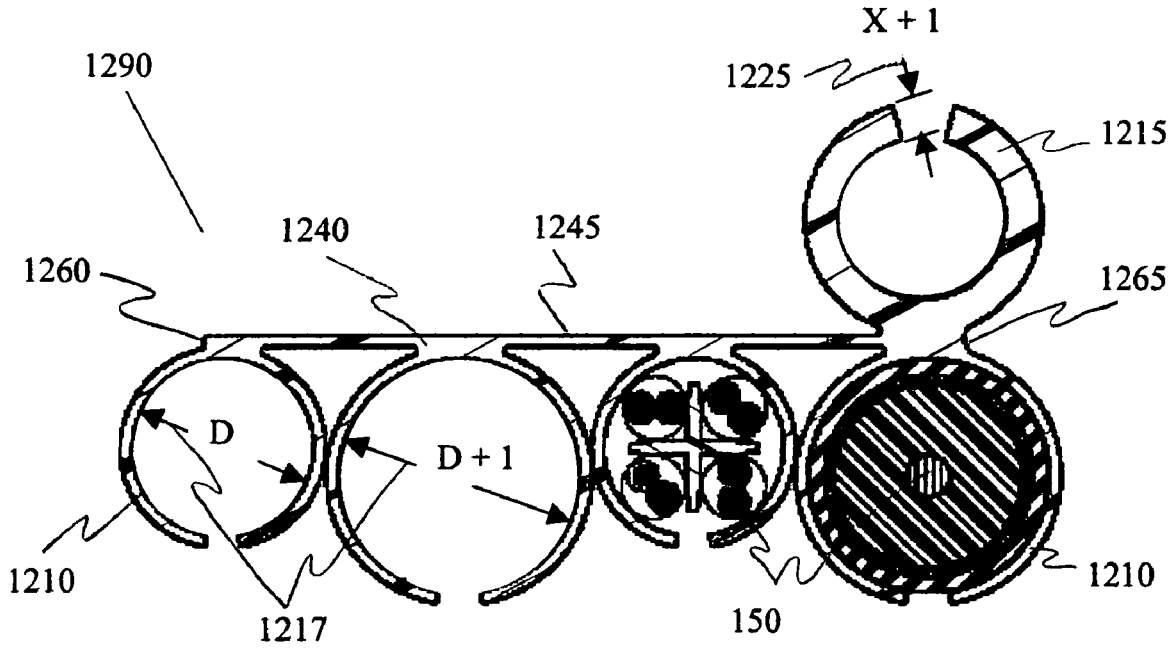
FIG. 9G describes a combination of FIG. 9A and FIG. 9E wherein a cable support-separator has hollow structures that exhibit different diameters with an additional thicker hollow structure moulded to the back of the essentially flat backing surface.

FIG. 9G describes a combination of FIG. 9A and FIG. 9E wherein a cable support-separator [1290] exhibiting essentially equally spaced, nominal material thickness hollow structures [1210], that exhibit different diameters [1217] moulded integrally to an essentially flat backing surface [1240] extending to the lateral ends [1260, 1265] of the nominal thickness hollow structures [1210]. A thicker hollow structure [1215] with additional material thickness [1225] is extruded or moulded to the back [1245] of the essentially flat backing surface [1240]. This thicker hollow structure [1215] may be used for insertion of twisted pairs of wire, co-axial, WIFI antennae, power, and/or fiber optic conductors (in advance, during or after installation) or other conductive media [150].

Figure 9H:
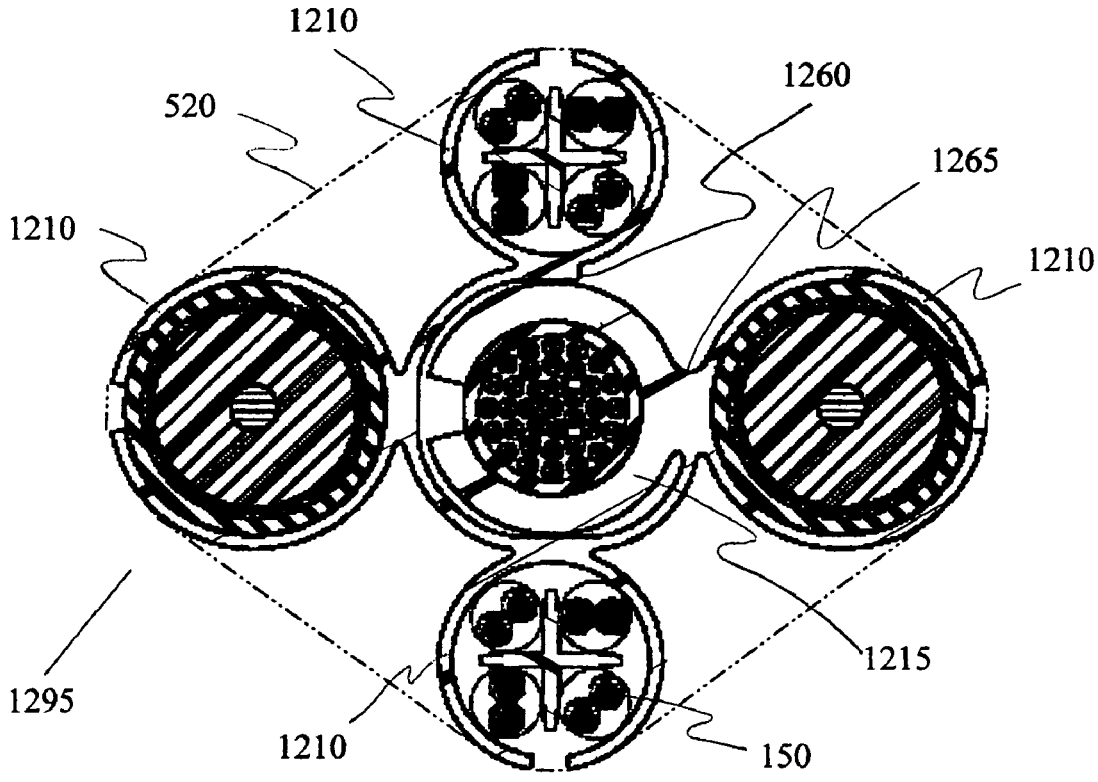
FIG. 9H is a cross-section variation of cable support-separator shown in FIG. 9G wherein the cable support-separator is optionally rolled from the lateral ends to create an essentially cross-shaped cable support-separator.

FIG. 9H is a cross-section variation of a cable support-separator [1290] shown in FIG. 9G wherein the cable support-separator [1290] is rolled from the lateral edges [1260, 1265] to create an essentially cross shaped cable support-separator [1295] with an additional material thickness hollow structure [1215] in addition to the nominal material thickness hollow structures [1210] wherein the additional material thickness hollow structure [1215] is more or less centrally located between the nominal thickness hollow structures [1210] and may act as a strength member depending on the material used and described in FIGS. 4A, 4B, 4C, or 4D. The nominal material thickness hollow structures [1210] may optionally be used for insertion of twisted pair, co-axial, WIFI antennae, power, and/or fiber optic conductors (in advance, during or after installation) or other conductive media [150] or left hollow. The essentially cross-shaped cable support-separator [1295] may be enclosed in an insulated jacket [520].

Figure 10:
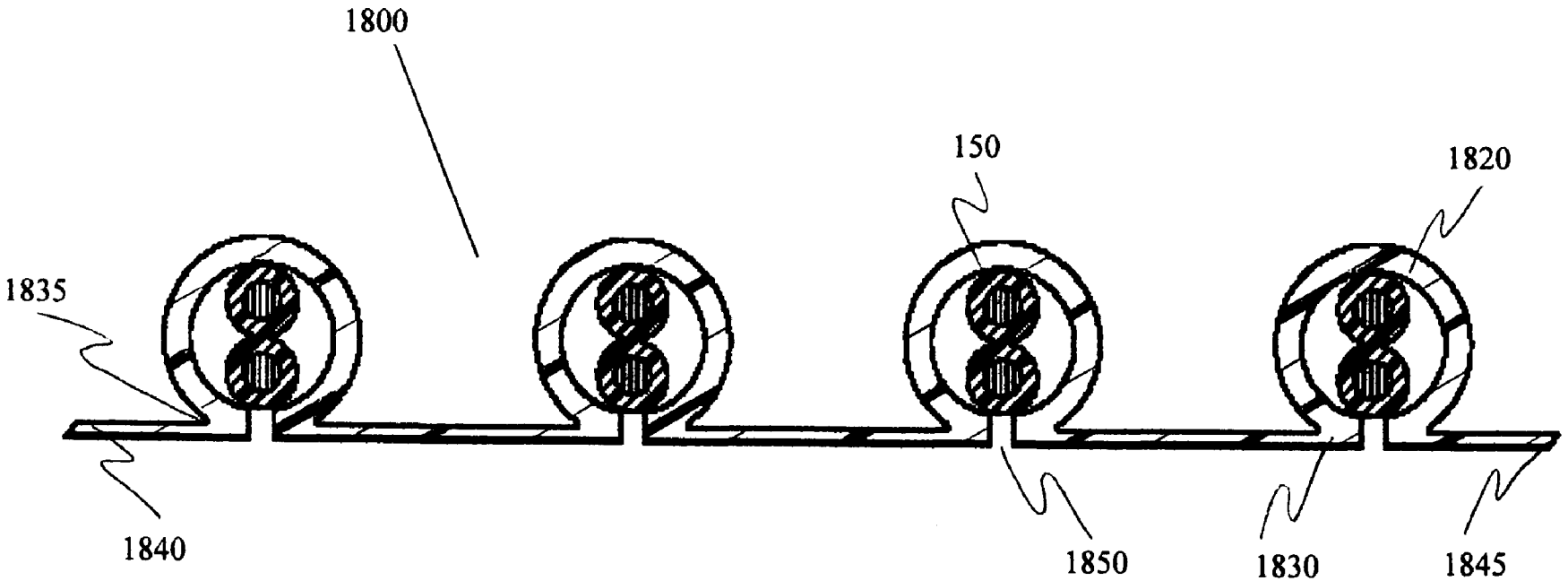
FIG. 10 is a cross-section view of an essentially flexible flat or ribbon cable support-separator exhibiting essentially equally spaced hollow structures that has a gap extending through the flat backing surface may be shielded internally or externally or optionally via section construction.

FIG. 10 is a cross-section view of an essentially flexible flat or ribbon cable support-separator [1800] exhibiting primarily equally spaced hollow structures [1820] extruded or moulded integrally to an essentially flat backing surface [1830] extending to lateral ends [1835] or beyond [1840, 1845] the hollow structures [1820] that individually have a gap [1850] allowing for insertion, containment and separation of non-conductive or conductive media [150] comprising twisted pair of conductors such as co-axial, WIFI antennae, power, and/or fiber optic conductors (in advance, during or after installation), or they may be left empty and can be constructed of conductive, semi-conductive, or non-conductive material as described in FIGS. 4A, 4B, 4C, and 4D and may be used with features described in FIGS. 5A, 5B, 5C and 5D. For illustration purposes only, conductive media [150] are shown as twisted conductors and gaps [1850] are shown through an essentially flat substrate-backing surface [1830].

Figure 11:
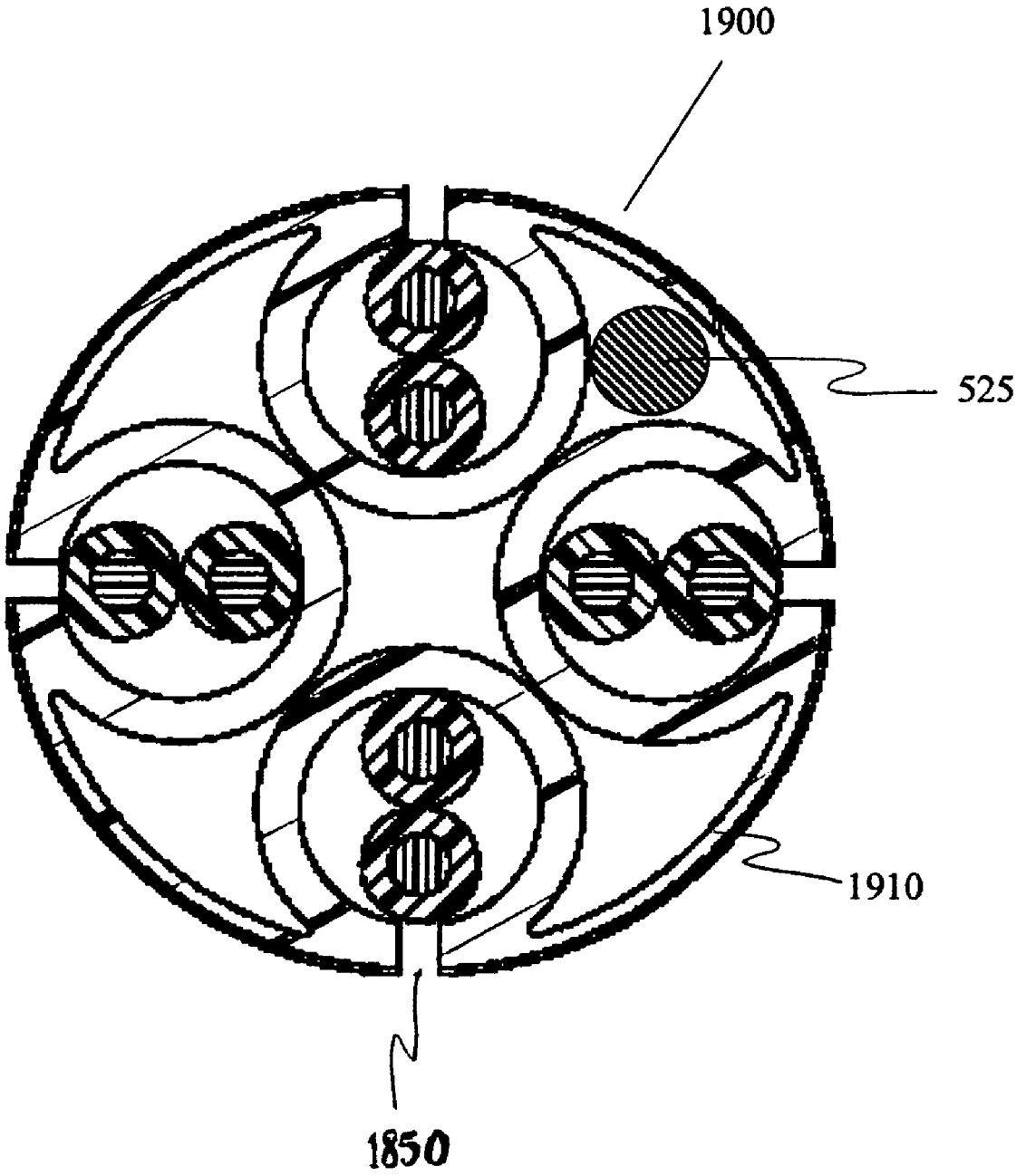
FIG. 11 is a cross-section view wherein the essentially flexible flat or ribbon cable-support-separator, comprised of FIG. 10, to form a concentric cable support-separator. The gaps face outward for ease of removal of the individual media from the cable support-separator.

FIG. 11 is a cross-section view wherein the essentially flexible flat or ribbon cable support-separator of FIG. 10 is rolled to form a concentric cable support-separator [1900] within an essentially curved backing surface [1910]. The concentric cable support-separator [1900] may be unjoined or joined at the ends. Depending on the materials used as in FIGS. 4A, 4B, 4C and 4D the cable support-separator [1900] provides for unshielded EME/RFI to be directed to the center of the cable support-separator [1900] effectively canceling out the non-desirous effects of EMI/RFI. Inversely, depending on the construction and materials of the cable support-separator [1900] the central area may be shielded from external EMI/RFI interference. A ground wire [525] in contact with the cable support-separator [1900] shielded surface(s) may be added to provide additional EMI/RFI protection. Removability, via "peeling", of the conductive media by the end user through a gap [1850] adds to the ease of installation for routing and termination of the individual conductive media This arrangement may optionally be covered within an outer insulated layer or jacket.

Figure 12A:
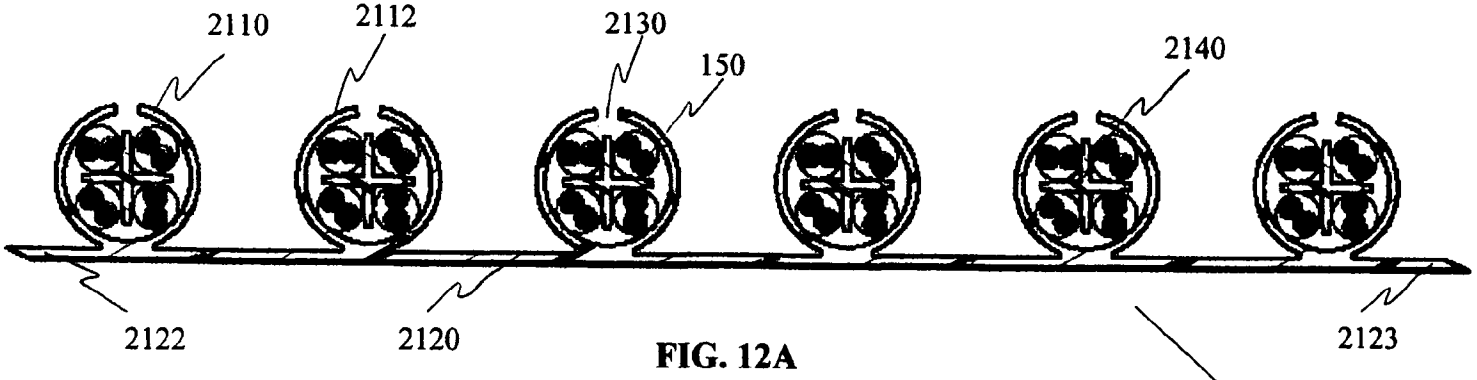
FIG. 12A is a cross-section view of an essentially flexible flat or ribbon cable support-separator exhibiting six essentially equally spaced hollow structures extruded or to an essentially flat backing surface.

FIG. 12A is a cross-section view of an essentially flexible flat or ribbon cable support-separator [2100] exhibiting six essentially equally spaced hollow structures [2110] of various material wall thickness [2112], extruded or moulded integrally to an essentially flat backing surface [2120] having lateral ends [2122, 2123] beyond that of the hollow structures [2110] that have a gap [2130] allowing for insertion, containment and separation of non-conductive or conductive media [150] shown with cable support-separators [2140] generally separating conductive media [150] comprising conductors comprising twisted pair, co-axial, WIFI antennae, power, and/or fiber optic conductors (in advance, during or after installation), or they may be left optionally empty and can be constructed in a manner as described in FIGS. 4A, 4B, 4C, or 4D and may optionally be used with features as described in FIGS. 5A, 5B, 5C and 5D.

Figure 12B:
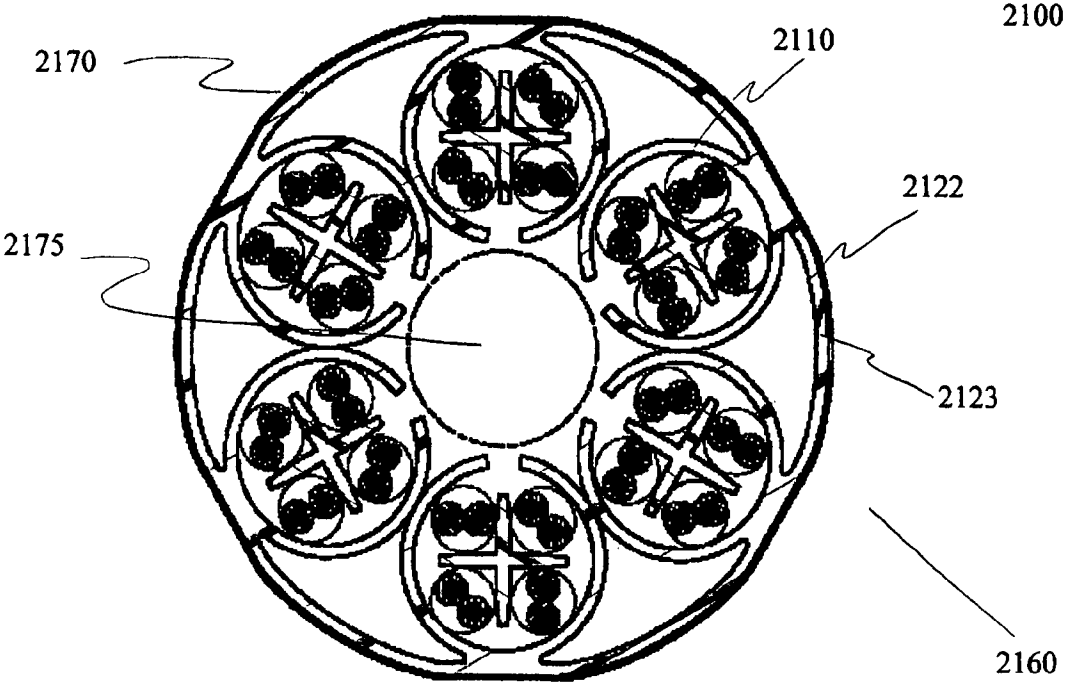
FIG. 12B is a cross-section view wherein the essentially flexible flat or ribbon cable-support-separator, comprised of FIGS. 12A rolled from the lateral ends to enclose the hollow structures.

FIG. 12B is a cross-section view wherein the essentially flexible flat or ribbon cable-support-separator [2100], comprised of FIG. 12A, and constructed similarly with materials and with features as described in FIGS. 2A, 2B, 2C, 3, 4A, 4B, 4C, 4D 5A, 5B, 5C and 5 and which may be rolled from the ends [2122, 2123] to enclose the essentially hollow structures [2110] on the inside to form a concentric cable support-separator [2160] within an essentially curved backing surface [2170]. The as-rolled cable support-separator [2160] may contain six or more types of conductive media [150] within the essentially hollow structures [2110] as well as non-conductive media within the central area [2175] of the rolled configuration.

Figure 13A:
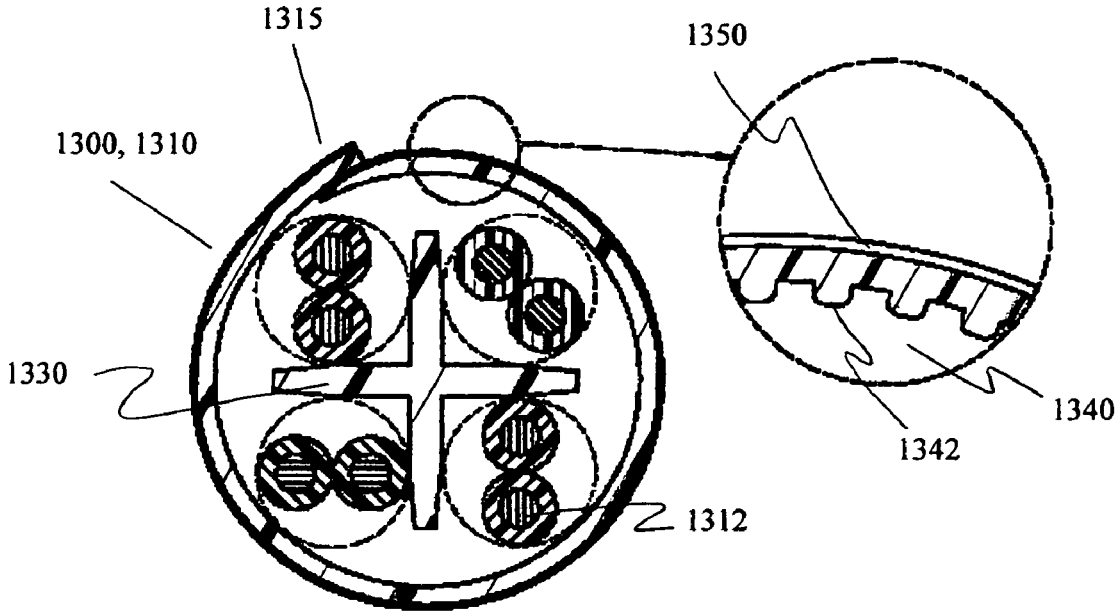
FIG. 13A is a cross section of a cable jacket or wrap for a conductive media bundle and cable support-separator wherein the cable jacket or wrap has a rifled top surface and a smooth bottom surface.

FIG. 13A is a cross section of an extruded, or molded, wrap [1300] or cable jacket [1310] that may have non-conductive, semi-conductive or conductive properties for encapsulating a conductive media [1312], bundle [1315] and cable support-separator [1330] wherein the wrap [1300] or cable jacket [1310] has a corrugated or rifled top surface [1340] and a smooth bottom surface [1350]. The rifled top surface [1340] provides a smaller contact surface area [1342] within the wrap [1300] or cable jacket [1310] allowing for reduced friction when pulling or inserting conductive media [1312] and additional spacing from adjacent cabling thereby reducing crosstalk and allowing for the use of less material to reduce the amount of combustible materials. The wrap [1300] or cable jacket [1310] may be comprised of conductive media or nanotubes imbedded longitudinally in the substrate. Other conductive media such as metallized thermoplastic Mylar(& film, attached, molded or extruded within the wrap or jacket, wires imbedded longitudinally or metallic or conductive polymer, $C_{60}$ in the form of fibers, nanotubes, substituted fullerenes or braided cable shielding imbedded in the wrap or jacket surface or substrate. Additional non-conventional composite compound blends that include halogenated and non-halogenated polymers together with optional inorganic and organic additives that include inorganic salts, metallic oxides, silica and silicon oxides as well as any number of substitute and unsubstituted fullerenes in all forms including nanotubes. The lateral ends of the essentially flat cable jacket may contain locking features such as an overlap feature, a locking feature or inner rifling and outer rifling that join the lateral ends, with or without the use of adhesives, taping or further jacketing.

Figure 13B:
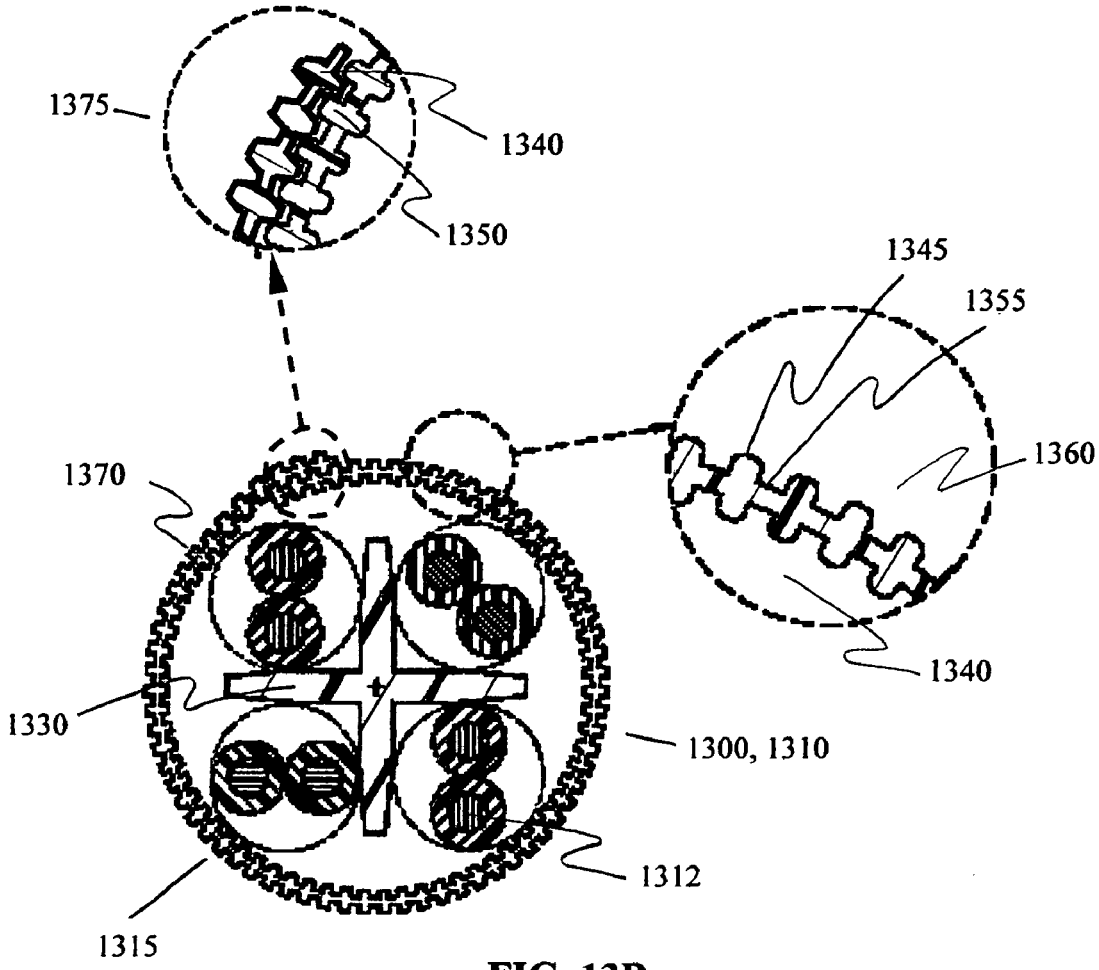
FIG. 13B is a cross section of a cable jacket or wrap for a conductive media bundle and cable support-separator wherein the cable jacket or wrap has a rifled top and bottom surface.

FIG. 13B is a cross section of an extruded, or molded, wrap [1300] or cable jacket [1310] that may have non-conductive, semi-conductive or conductive properties for a conductive media [1312] bundle [1315] and cable support-separator [1330] wherein the wrap [1300] or cable jacket [1310] has a corrugated or rifled top surface [1340] and a corrugated or rifled bottom surface [1360] to create a double rifled jacket [1370]. The rifled top surface [1340] and rifled bottom surface [1350] of the double rifled cable jacket [1370] allow for interlocking [1375] of the surfaces [1340, 1350] alternating the surfaces [1340, 1350] between peaks [1345] and valleys [1355] wherein an adhesive may or may not be used between surfaces [1340, 1350] when overlapped (illustrated). The wrap [1300] or cable jacket [1310] may be comprised of materials as described in FIG. 1A.

Figure 14A:
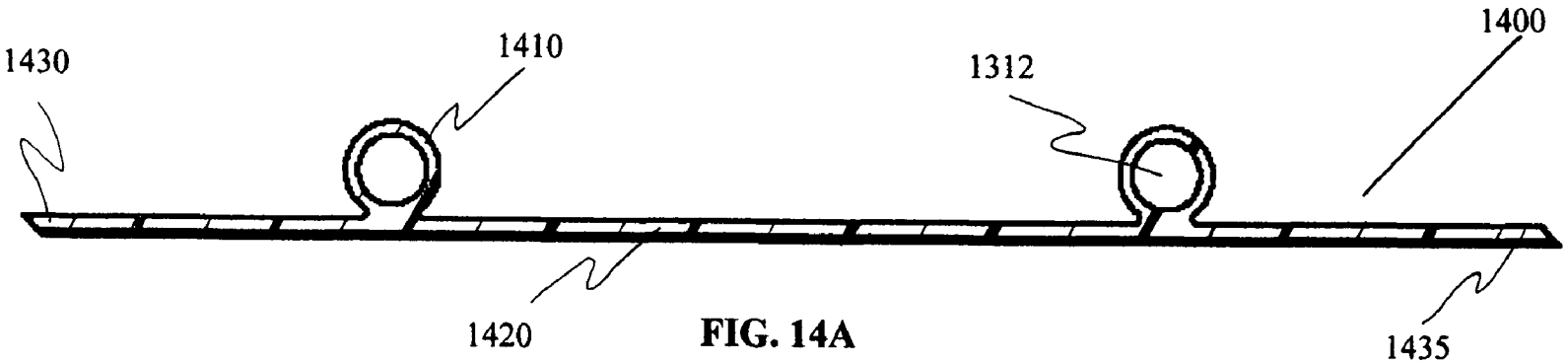
FIG. 14A is a cross section view of a cable jacket or wrap and/or cable support-separator exhibiting several spaced hollow or solid structures.

FIG. 14A is a cross section view of an essentially flat cable jacket or wrap [1400] exhibiting severally spaced hollow or solid structures [1410], extruded or molded integrally to an essentially flat backing surface [1420] extending to lateral ends [1430, 1435]. The hollow structures [1410] allow for insertion, containment and separation of non-conductive or conductive media [1312] comprising twisted pair, co-axial, WIFI antennae, power, and/or fiber optic conductors (in advance, during or after installation). The hollow structures [1410] may individually be constructed of various diameters to contain and support varying diameter conductive media [1312]. The cable jacket or wrap [1400] may be constructed of materials including conductive media or nanotubes imbedded longitudinally in the substrate, other conductive media such as metallized thermoplastic Mylar® film, attached, molded or extruded within the cable jacket or wrap, wires imbedded longitudinally or metallic or conductive polymer, $C_{60}$ in the form of fibers, nanotubes, substituted fullerenes or braided cable shielding imbedded in the cable jacket or wrap surface or substrate. Additional non-conventional composite compound blends that include halogenated and non-halogenated polymers together with inorganic and organic additives that include inorganic salts, metallic oxides, silica and silicon oxides as well as any number of substitute and unsubstituted fullerenes in all forms including nanotubes. The lateral ends of the essentially flat cable support-separator, cable jacket or wrap may contain interlocking features such as an overlap feature, a locking feature or inner rifling and outer rifling that join the lateral ends, with or without the use of adhesives, taping or further jacketing.

Figure 14B:
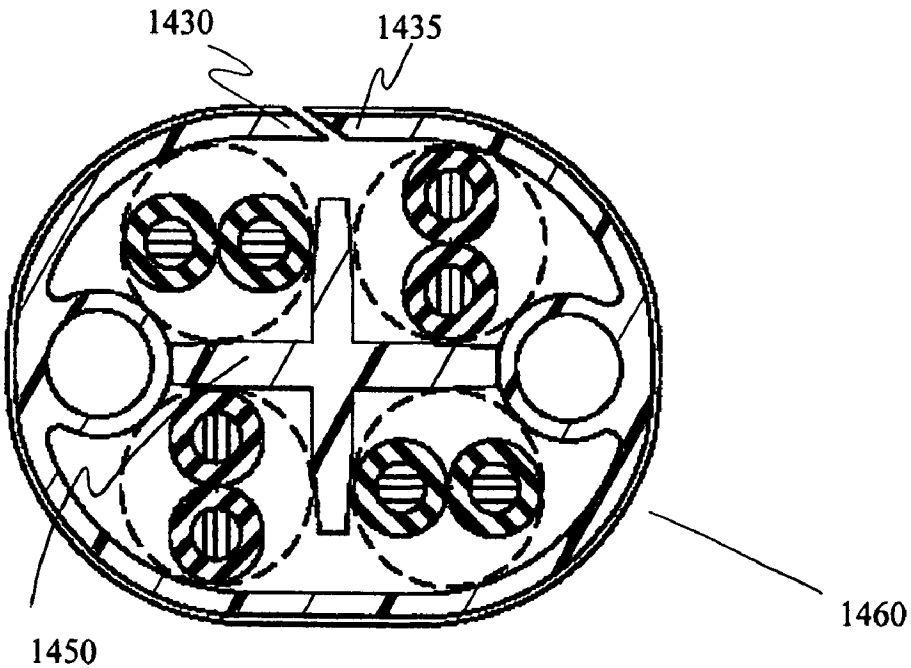
FIG. 14B is a cross section view of FIG. 14A wherein the cable jacket or wrap becomes useful as a cable support-separator when it is rolled or wrapped around a traditional X or cross-shaped cable support-separator to create an eccentric cable bundle.

FIG. 14B is a cross section view of FIG. 14A wherein the cable jacket or wrap [1400] is rolled around a traditional X or cross-shaped [1450] cable support-separator to create an eccentric cable bundle [1460] allowing for insertion, containment and separation of non-conductive or conductive media [1312] comprising twisted pair, co-axial, WIFI antennae, power, and/or fiber optic conductors (in advance, during or after installation). The lateral ends [1430, 1435] may be overlapped as shown in FIG. 2A, interlocked as shown in FIG. 2B or may be over wrapped with a tape-like layer. The wrap or jacket [1400] may contain locking features as described in FIG. 2A as in a zipper-like closure, combining the lateral ends [1430, 1435] to complete the overlap to have a similar appearance to that of a cigarette wrapper or spirally, in a helical fashion, wound around the conductive media [1312] bundle [13 15] with a trailing edge overlapping a leading edge. The methodology of enclosure is dependent on individual mechanical integrity requirements.

Figure 15A:
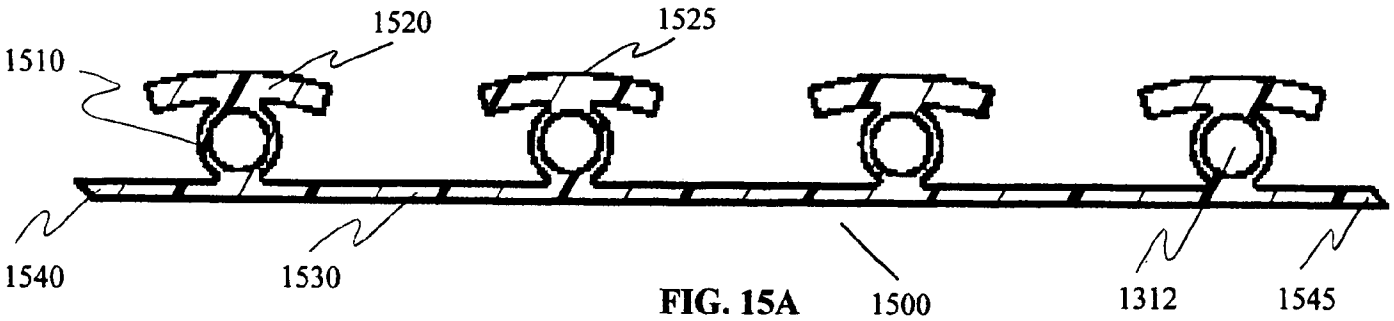
FIG. 15A is a cross section view of an cable jacket or wrap or cable support-separator exhibiting several hollow structures with a top-hat feature extruded to an hollow structure disposed on the backing surface.

FIG. 15A is a cross section view of an essentially flat cable jacket or wrap [1500] exhibiting severally spaced solid or hollow structures [S 150] with a top-hat shaped feature [1520], the hollow structures [1510] are extruded or molded integrally to an essentially flat backing surface [1530] extending to lateral ends [1540, 1545]. The top-hat feature [1520] may be molded or extruded from the centerline of the hollow structures [1510] to the edge of the adjacent top-hat feature [1520] or of any length therein. The hollow structures [S 150] allow for insertion of various conductive media [1312]. The cable jacket or wrap [1400] may be constructed of materials including conductive media or nanotubes imbedded longitudinally in the substrate or other conductive media such as metallized thermoplastic Mylar® film, attached, molded or extruded within the wrap or jacket, wires imbedded longitudinally or metallic or conductive polymer, $C_{60}$ in the form of fibers, nanotubes, substituted fullerenes or braided cable shielding imbedded in or on the cable jacket or wrap surface or substrate. Additional non-conventional composite compound blends that include halogenated and non-halogenated polymers together with inorganic and organic additives that include inorganic salts, metallic oxides, silica and silicon oxides as well as any number of substitute and unsubstituted fullerenes in all forms including nanotubes. The lateral ends of the essentially flat cable jacket, wrap or cable support-separator may contain interlocking features such as an overlap feature, a locking feature or inner rifling and outer rifling that join the lateral ends, with or without the use of adhesives, taping or further jacketing.

Figure 15B:
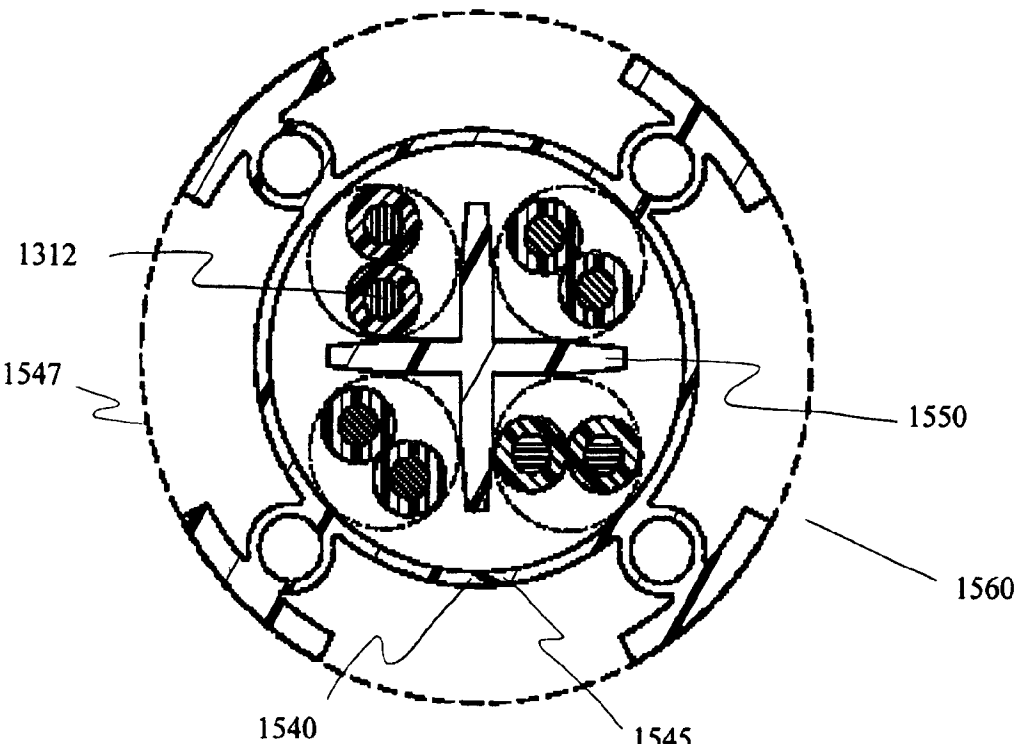
FIG. 15B is a cross section view of FIG. 15A wherein the cable jacket or wrap becomes a cable support-separator when it is rolled or wrapped inversely around a traditional X or cross-shaped cable support-separator to create a concentric cable bundle.

FIG. 15B is a cross section view of FIG. 15A wherein the cable support-separator [1500] is rolled around a traditional X or cross-shaped [1550] cable support-separator to create a concentric cable bundle [1560] allowing for insertion, containment and separation of non-conductive or conductive media [13 12] comprising twisted pair wire, coax, WIFI, or fiber optic conductors, or other conductive media (in advance, during or after installation). The lateral ends [1540, 1545] may be used with interlocking features and/or be constructed of various media as described in FIG. 3. The top-hat shaped feature [1520] provides an extended surface [1525] to support an additional outer insulated layer, cable jacket or wrap [1547] adding to the distance from adjacent cabling, thereby reducing cross-talk.

One skilled in the art will readily recognize that features indicated, such as the materials as described in FIGS. 4A, 4B, 4C, and 4D, features as described in 5A, 5B, 5C, 5D and mouldable patterns such as corrugation, rifling, ridges, flat and concave features for drain wire installation are applicable to any and all of the previously described and illustrated configurations of the invention.

The invention may be used in any configuration including flat or ribbon to enclosed as—rolled from the lateral edges. It is to be noted and understood that one configuration does not preferentially preclude the use of the present inventive entities over other configurations. If optionally rolled the support-separators may be rolled in a helical or spiral overlapping process or using an edge overlapping configuration, similar to that of a cigarette paper-wrap, providing a surface appearance of spiraled or smooth textures and may enclose the conductive media in varying tensions creating cabling that is "loose" or "tight".

It will, of course, be appreciated that the embodiments which have just been described have been given simply by the way of illustration, and the invention is not limited to the precise embodiments described herein; various changes and modifications may be effected by one skilled in the art without departing from the scope or spirit of the invention as defined in the appended claims.

What is claimed is:

1. A high performance, multi-media communications cable, cable support-separator and/or jacket comprising;

cable support members attached to and extending along a single initially flat backing surface along a longitudinal length of said cable support-separator wherein said cable support members are separated by a space, wherein said initially flat backing surface of said cable support-separator is flexible and may be rolled or folded or inversely rolled or folded thereby forming a central region, said central region extending along said longitudinal length of said high performance, multi-media communications cable and an outer shell or jacket;

said cable support members comprising radial and axial surfaces defined by shapes of hollow structures, said radial and axial surfaces also including a gap that remains open wherein said gap allows for insertion and removal of conductive or non-conductive multi-media into and out of said hollow structures;

and wherein said initially flat backing surface remains flat, is rolled or folded or inversely rolled or folded with or without said hollow structures of said cable support-separator contain said conductive or non-conductive multi-media to form said high performance, multi-media communications cable.

2. The high performance, multi-media communications cable, cable support-separator and/or jacket of claim 1, wherein said initially flat backing surface comprising said cable support members or hollow structures are attached to said initially flat backing surface whereby said initially flat backing surface and said cable support members or said hollow structures comprise a flat cable support-separator and/or jacket.

3. The high performance, multi-media communications cable, cable support-separator and/or jacket of claim 2, wherein said flat cable support-separator is rolled or folded forming said central region extending along said longitudinal length of said cable support-separator and/or said jacket.

4. The high performance, multi-media communications cable, cable support-separator and/or jacket of claim 2, wherein said flat cable support-separator said inversely rolled or folded and whereby one or more said cable support members outwardly extend from said central region thereby forming an inversely concentric or eccentric cable support-separator and/or said jacket.

5. The high performance, multi-media communications cable, cable support-separator and/or jacket of claim 2, wherein said flat cable support-separator and said cable support members including said hollow structures are equally or non-equally spaced and attached to said initially flat backing surface by extrusion, molding or adhered integrally to said initially flat backing surface with said initially flat backing surface extending to one or more lateral ends beyond said hollow structures, wherein each or all of said hollow structures may be hollow and said hollow structures each preferentially comprise a gap along said longitudinal length allowing for insertion, containment and separation of conductive or non-conductive multi-media comprising twisted pair, co-axial, WIFI antennae, power, and/or fiber optic conductors in advance of, during, or after installation and wherein said hollow structures may be left empty.

6. The high performance, multi-media communications cable, cable support-separator and/or jacket of claim 5, wherein said lateral ends combined comprise an overlap similar in appearance to that of a cigarette wrapper or a spiral wrap, wound around said conductive or non-conductive multi-media wherein said first lateral end overlaps said second lateral end thereby overlapping and interlocking or providing an over wrapped tape-like layer and wherein said cable support-separator may be overlapped in a singular fashion wherein said first lateral end overlaps said second lateral end and wherein said initially flat backing surface may include a zipper-like closure or wherein said initially flat backing surface is said rolled or folded to provide said cable, cable support-separator and/or jacket thereby providing an enclosure around said cable support-separator thereby creating said concentric or eccentric high performance, multi-media communications cable.

7. The high performance, multi-media communications cable, cable support-separator and/or jacket of claim 2, wherein said flat cable support-separator comprises up to or greater than six equally or non-equally spaced hollow structures of the same or various diameters and/or thicknesses to contain and support various diameter conductive or non-conductive multi-media wherein said hollow structures are attached to said initially flat backing surface on a top or bottom side and wherein said flat cable support-separator is comprised of conductive and/or non-conductive media, and said hollow structures may be of any shape or form useful in providing randomness primarily to further mitigate pair-to-pair coupling thereby improving any crosstalk performance of said conductors or cables or both, including alien crosstalk.

8. The high performance, multi-media communications cable, cable support-separator and/or jacket of claim 2, wherein said flat cable support-separator ends at attachment points of said hollow structures and said initially flat backing surface and wherein said flat cable support-separator is folded forming a ribbon-like cable support-separator or an eccentric ribbon cable support-separator.

9. The high performance, multi-media communications cable, cable support-separator and/or jacket of claim 1, wherein each of said cable support members comprises one or more external and internal radial and axial surfaces such that said conductive or non-conductive multi-media may be placed therein and whereby said conductive or non-conductive multi-media and said flat cable support-separator may be rolled into a concentric or eccentric shape to form a high performance, multi-media communications cable.

10. The high performance, multi-media communications cable, cable support-separator and/or jacket of claim 1, wherein said hollow structures may comprise buds of various diameters and/or thicknesses attached to said hollow structures to contain and support various diameter conductive or non-conductive multi-media wherein said buds are comprised of conductive and/or non-conductive media and said buds may be of any shape or form useful in providing randomness primarily to further mitigate pair-to-pair coupling thereby improving any crosstalk performance of said conductors or cables or both, including alien crosstalk.

11. The high performance, multi-media communications cable, cable support-separator and/or jacket of claim 10, wherein said buds may comprise a thicker material thereby acting as a strength member or as a drain wire and wherein said buds may be used for inserting conductive or non-conductive multi-media with or without additional cable support-separators or may remain hollow.

12. The high performance, multi-media communications cable, cable support-separator and/or jacket of claim 1, wherein said initially flat backing surface and said cable support-separator comprises said lateral ends extending beyond said hollow structures comprising an overlap downwardly positioned feature extruded or molded into a first lateral end of said initially flat backing surface and an overlap upwardly positioned feature extruded or molded onto a second lateral end of said initially flat backing surface wherein said downwardly positioned feature of said first lateral end joins together with said upwardly positioned feature of said second lateral end when said first lateral end and said second lateral end are rolled or folded thereby integrating said first lateral end and said second lateral end into said concentric or eccentric high performance, multi-media communications cable.

13. The high performance, multi-media communications cable, cable support-separator and/or jacket of claim 1, wherein said buds are attached externally and integrally to said hollow structure outer surface at a preferential angle with respect to said initially flat backing surface whereby said buds may include a gap for insertion of conductive or non-conductive multi-media.

14. The high performance, multi-media communications cable, cable support-separator and/or jacket of claim 1, wherein said cable, cable support separator and/or jacket is said rolled or folded inwardly from either or both of said lateral ends to encapsulate said hollow structures with said initially flat backing surface as an outside surface forming an essentially curved backing surface with said hollow structures to form a concentric or eccentric cable support-separator whereby a ground wire is added therein to provide electrical continuity within an outer insulated layer or jacket that may include an adhesive and may be joined or unjoined and provide either partial or full coverage of said conductive or non-conductive multi-media.

15. The high performance, multi-media communications cable, cable support-separator and/or jacket of claim 1, wherein said hollow structures comprise an essentially central circular structure with a greater material thickness attached to said initially flat backing surface whereby said essentially central circular structure is located centrally more or less between several said hollow structures of nominal thickness and wherein said essentially central circular structure is located centrally more or less within said cable support-separator when rolled or folded or inversely rolled or folded.

16. The high performance, multi-media communications cable, cable support-separator and/or jacket of claim 15, wherein said essentially curved backing surface encapsulates a typical cross-shaped cable support-separator and said conductive or non-conductive multi-media thereby providing said concentric or eccentric high performance, multi-media communications cable.

17. The high performance, multi-media communications cable, cable support-separator and/or jacket of claim 1, wherein said initially flat backing surface comprises an inner rifled surface and a smooth outer surface or an inner rifled surface and rifled outer surface and wherein said cable, cable support-separator, and/or jacket itself may be used as said jacket or a wrap encapsulating said conductive or non-conductive multi-media.

18. The high performance, multi-media communications cable, cable support-separator and/or jacket of claim 1, wherein said initially flat backing surface includes a top surface and a bottom surface whereby said hollow structures may be attached to either said top surface or said bottom surface and/or both.

19. A high performance, multi-media communications cable, cable support-separator and/or jacket of claim 18, wherein said top surface inwardly directed comprising a rifled surface and said bottom surface outwardly directed comprising a smooth surface or said top surface inwardly directed comprising a rifled surface and said bottom surface outwardly directed comprising a rifled surface and said rifled or unrifled surfaces encapsulate said cable support-separator acting as a jacket or wrap in itself, with or without said cable support-separator thereby allowing for the use of less insulation material and thereby reducing combustibility.

20. The high performance, multi-media communications cable, cable support-separator and/or jacket of claim 18, wherein said top surface inwardly directed comprising a rifled surface and said bottom surface outwardly directed comprising a smooth surface or said top surface inwardly directed comprising a rifled surface and said bottom surface outwardly directed comprising a rifled surface encapsulates said cable support-separator acting as a jacket or wrap in and on itself as a double rifled backing and wherein said rifled inner surface and said rifled outer surface of said double rifled backing allows for interlocking of said lateral ends of said inner and said outer surfaces alternating between peaks and valleys wherein an adhesive may or may not be used between said top and said bottom surface when overlapped.

21. The high performance, multi-media communications cable, cable support-separator and/or jacket of claim 1, wherein said initially flat backing surface with said lateral ends may be rolled or folded from each or both of said lateral ends creating an inner surface within said essentially curved backing surface such that said hollow structures attached to said top surface are inwardly directed and said hollow structures attached to said bottom surface are outwardly directed and whereby said lateral ends may be rolled or folded inversely wherein said top surface is outwardly directed and said bottom surface is inwardly directed.

22. The high performance, multi-media communications cable, cable support-separator and/or jacket of claim 1, wherein said hollow structures comprise smaller diameters and less material thicknesses thereby reducing mass, reducing smoke and flame spread and providing additional usefulness for installations in constrained areas.

23. The high performance, multi-media communications cable, cable support-separator and/or jacket of claim 1, wherein said cable, cable support separator and/or jacket comprise a gap outwardly directed thereby allowing for conductive or non-conductive multi-media to be inserted and readily peeled away from said cable and cable support-separator thereby improving routing, installation and termination of individual conductive or non-conductive multi-media.

24. The high performance, multi-media communications cable, cable support-separator and/or jacket of claim 1, wherein said cable, said cable support-separator and/or said jacket longitudinally support conduit tube(s) existing within or exterior to said central region of said cable, said cable support-separator and/or said jacket wherein said conduit tube(s) assist in providing either an eccentric or concentric cable.

25. The high performance, multi-media communications cable, cable support-separator and/or jacket of claim 1, wherein said cable, cable support separator and/or jacket comprises said conduit tubes of shapes, diameters and sizes that are random or patterned whereby laying or helically winding said conduit tubes with consistent or variable tensions along said longitudinal length of said cable and cable support-separator changes the overall diameter and shape of said cable or cable support separator thereby reducing or eliminating cross-talk.

26. The high performance, multi-media communications cable, cable support-separator and/or jacket of claim 1, wherein said initially flat backing surface said lateral ends may be rolled or folded or inversely rolled or folded from each or both of said lateral ends creating an inner surface within said essentially curved backing surface such that said hollow structures attached to said top surface are inwardly directed and said bottom surface is outwardly directed whereby said cable support-separator provides said outwardly directed surface thereby creating an outer shell portion or jacket that comprises non-conductive, semi-conductive or conductive properties encapsulating said conductive or non-conductive multi-media.

27. The high performance, multi-media communications cable, cable support-separator and/or jacket of claim 1, wherein said cable, cable support separator and/or jacket when rolled or folded comprises said central region wherein additional cross type support-separators may be inserted within said conductive or non-conductive multi-media.

28. The high performance, multi-media communications cable, cable support-separator and/or jacket of claim 1, wherein said cable support-separator may be conductive, semi-conductive, or non-conductive, filled and either solid or foamed or foamed with a solid skin layer, metallic, conductive or non-conductive polymer media, providing electrical grounding or earthing, or is comprised primarily of organic or inorganic polymers or combinations of inorganic and organic polymer blends.

29. The high performance, multi-media communications cable, cable support-separator and/or jacket of claim 1, wherein said high performance, multi-media communications cable, cable support-separator, and/or jacket may be a combination of inorganic fillers or additives with inorganic and/or organic polymers or combinations including inorganic and organic polymer blends, homo and copolymers of ethylene, propylene, or polyvinyl chloride or fluorinated ethylene propylene, fluorinated ethylene, chlorinated ethylene propylene, fluorochloronated ethylene, perfluoroalkoxy, fluorochloronated propylene, a copolymer of tetrafluoroethylene and perfluoromethylvinylether (MFA), a copolymer of ethylene and chlorotrifluoroethelyene (ECTFE), as well as homo and copolymers of ethylene and/or propylene with fluorinated ethylene, polyvinylidene fluoride (PVDF), as well as blends of polyvinyl chloride, polyvinylidene chloride, nylons, polyesters, polyurethanes as well as unsubstituted and substituted fullerenes primarily comprised of $C_{60}$ molecules including nano-composites of clay and other inorganics such as ZnO, $TiO_2$, MgOH, and ATH (ammonium tetrahydrate), calcium molybdates, ammonium octyl molybdate and the like and may also be employed as nano-sized particles including tube shaped particles, and wherein any and all combinations may be utilized to provide polymer blends, and wherein said cable support-separator and/or conductive media insulation utilizing nanotubes of $C_{60}$ in the form of fibers or substituted/unsubstituted fullerenes or fullerene compounds and the like, nano-composites or both and wherein said nano-composites or both are imbedded in said cable support-separator.

30. The high performance, multi-media communications cable, cable support-separator and/or jacket of claim 1, wherein said cable, cable support-separator, and/or jacket may be comprised of, separately or in combination, of metal oxides including magnesium trioxides, metal hydrates, including magnesium hydrates, silica or silicon oxides, brominated compounds, phosphated compounds, metal salts including magnesium hydroxides, ammonium octyl molybdate, calcium molybdate and the like.

31. The high performance, multi-media communications cable, cable support-separator and/or jacket of claim 1, wherein said cable, cable support-separator, and/or jacket may also be comprised of compounds such as acid gas scavengers that scavenge gasses such as hydrogen chloride and hydrogen fluoride or other halogenated gasses occurring during combustion of said high performance, multi-media communications cable support-separator.

32. The high performance, multi-media communications cable, cable support-separator and/or jacket of claim 1, wherein said cable, cable support-separator, and/or jacket may be comprised of organic and/or inorganic polymers such that each may include the use of recycled or reground thermoplastics in an amount up to 100%.

33. The high performance, multi-media communications cable, cable support-separator and/or jacket of claim 1, wherein said cable, cable support-separator, and/or jacket comprises a polymer blend ratio of fluorinated or otherwise halogenated polymers or copolymers to ethylene or vinyl chloride polymers or copolymers of from 0.1% to up to 99.9% of fluorinated or otherwise halogenated polymers or copolymers to ethylene or vinyl chloride polymers or copolymers or foamed polymer blends including a nucleating agent of polytetrafluoroethylene, carbon black, color concentrate, or boron nitride, boron triflouride, direct injection of air or gas into an extruder, chioroflurocarbons (CFCs), or more environmentally acceptable alternatives such as pentane or other acceptable nucleating or blowing agents.

34. The high performance, multi-media communications cable, cable support-separator and/or jacket of claim 1, wherein said cable, cable support-separator, and/or jacket comprise solid, partially solid, or partially or fully foamed organic or inorganic dielectric materials, wherein said dielectric materials may include a solid skin surface with any dielectric material and wherein said cable support-separator may include an adhesive surface.

35. The high performance, multi-media communications cable, cable support-separator and/or jacket of claim 1, wherein said cable, cable support-separator, and/or jacket comprises a sealant coated dimensionally heat-recoverable dual layer of said high performance, multi-media communications cable or cable support-separator comprising selecting a first polymer composition comprising a cross-linkable polymer; forming a second polymer composition by admixing a thermoplastic component and a rubber-like component in proportions such that a composition comprises to 95% of said thermoplastic component and to 70% of said rubber-like component with said second polymer composition being convertible to a sealant composition.

36. The high performance, multi-media communications cable, cable support-separator and/or jacket of claim 1, wherein said cable, cable support-separator, and/or jacket comprises extruding a first and second polymer composition to form a unitary dual layer, wherein said second polymer composition forms an outer tubular layer formed from a crosslinkable polymer composition disposed concentrically around an inner tubular layer and being in a first configuration at a temperature below the crystalline melt temperature of said first polymer composition whereby exposing said conduit tubes or said jacketing to a source of energy initiates formation of chemical bonds between adjacent polymer chains in said first composition, and induces a chemical change in said second composition, thereby converting said second composition from a melt processable composition to a sealant composition and rendering said first composition recoverable in that said sealant composition is more easily recoverable upon subsequent heating.

37. The high performance, multi-media communications cable, cable support-separator and/or jacket of claim 1, wherein said cable, cable support-separator and/or jacket capable of providing for said conductive multi-media transmitting data up to and greater than 10 Gbit/second while substantially mitigating or completely eliminating all forms of crosstalk, including alien crosstalk.

38. The high performance, multi-media communications cable, cable support-separator and/or jacket of claim 1, wherein said cable, cable support-separator, and/or jacket comprises a conductive or non-conductive substrate such as metallized thermoplastic film at a nominal 50 ohms per square ($50\Omega/cm^2$) resistance and are attached, laminated, molded, extruded or co-extruded to said cable support-separator surface and where said cable support-separator surface itself may be comprised of imbedded non-conductive or conductive substrate such as said metallized thermoplastic film at a nominal 50 ohms per square ($50\Omega/cm^2$) resistance, where said metallized thermoplastic film may include a drain wire of a preferred AWG or a braided shield in contact with said metallized thermoplastic film.

39. The high performance, multi-media communications cable, cable support-separator and/or jacket of claim 1, wherein said cable, cable support-separator, and/or jacket wherein said conductive multi-media may also be pulled from said hollow structures through said gap for easy separation during routing, installation and termination of selected conductive multi-media at a preferred end of said high performance, multi-media communications cable.

40. The high performance, multi-media communications cable, cable support-separator and/or jacket of claim 1, wherein said cable, cable support-separator, and/or jacket surface provides either a shielded or unshielded internal EME/RFI (electromagnetic emissions/radio frequency interference) barrier surfaces directed toward a center of said cable support-separator and also provides for a barrier from external EME/RFI, and where ground wire in contact with said cable support-separator shielded or unshielded surfaces may provide additional EMI/RFI (electromagnetic interference/radio frequency interference) protection.

41. The high performance, multi-media communications cable, cable support-separator and/or jacket of claim 1, wherein said cable, cable support-separator, and/or jacket is comprised of polyolefin or other thermoplastic based polymers and blends thereof capable of meeting specific flammability and smoke generation requirements as defined by UL 910, NFPA 255, 259 or 262, and EN 50266-2-x, class B test specifications as well as NFPA 72 test criteria for circuit integrity, wherein said test criteria is met by said high performance, multi-media communications cable support-separator.

42. A method of creating a high performance, multi-media communications cable, cable support-separator and/or jacket comprising;

cable support members attached to and extending along a single initially flat backing surface along a longitudinal length of said cable support-separator wherein said cable support members are separated by a space, wherein said initially flat backing surface of said cable support-separator is flexible and may be rolled or folded or inversely rolled or folded thereby forming a central region, said central region extending along said longitudinal length of said high performance, multi-media communications cable and an outer shell or jacket;

said cable support members comprising radial and axial surfaces defined by shapes of hollow structures comprising a gap that remains open longitudinally wherein said gap allows for insertion and removal of conductive or non-conductive multi-media into and from said hollow structures;

and wherein said initially flat backing surface remains flat, is rolled or folded or inversely rolled or folded with or without said hollow structures of said cable support-separator contain said conductive or non-conductive multi-media to form said high performance, multi-media communications cable.

43. A method of creating a high performance, multi-media communications cable, cable support-separator and/or jacket of claim 42, wherein said method for producing a communications cable support-separator comprises said cable support members attached to said initially flat backing surface with each of said cable support members comprising said external and internal radial and axial surfaces wherein said cable support members extend along said longitudinal length of said high performance, multi-media communications cable, and whereby a flat cable support-separator is rolled or folded and thereby said cable support members form said central region, wherein said cable support-separator extends along said longitudinal length of said high performance, multi-media communications cable allowing for pulling of said cable support-separator from a reel or cobb into a closing die thereby mating said cable support members with one or more twisted pair or any other of said conductive or non-conductive multi-media and/or conduit tubes thereby nesting or shielding said conductive or non-conductive multi-media as necessary such that said one or more twisted pair or said conductive or non-conductive multi-media are providing single or double twisted bunching which may include a binder for holding twisted bunching with optional shielding, or may include a single or two-step process followed by use of said binder for holding said twist bunching in place and jacketing via extrusion or wrapping or both with a final take up on a final take-up reel, wherein implementation of said method provides for completion of said high performance, multi-media communications cable.

44. A method of creating a high performance, multi-media communications cable, cable support-separator and/or jacket of claim 42, comprising a method of forming said jacket by binding or wrapping or both, wherein said wrapping may include one or more of several methods including single tape winding such as a cigarette tape wrap, spiral wrapping such as a notebook binder with a tighter or looser configuration or varying tensions or where said binder method may simply comprise extruding a thin skin thermoplastic or a thicker skin thermoplastic or thermoset over said high performance, multi-media communications cable.

45. A method of creating a high performance, multi-media communications cable, cable support-separator and/or jacket of claim 42, wherein said binder can be a corrosive and/or chemical resistant barrier protecting said high performance, multi-media communications cable and said conductive or non-conductive multi-media from severe environments.

* * * * *